US008893696B2

(12) United States Patent
Kenworthy

(10) Patent No.: US 8,893,696 B2
(45) **Date of Patent: *Nov. 25, 2014**

(54) APPARATUS FOR LAUNCHING SUBCALIBER PROJECTILES AT PROPELLANT OPERATING PRESSURES INCLUDING THE RANGE OF PRESSURES THAT MAY BE SUPPLIED BY HUMAN BREATH

(71) Applicant: Bill Whistler Kenworthy, Algonquin, IL (US)

(72) Inventor: Bill Whistler Kenworthy, Algonquin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/621,546

(22) Filed: Sep. 17, 2012

(65) Prior Publication Data

US 2013/0213377 A1 Aug. 22, 2013

Related U.S. Application Data

(62) Division of application No. 12/018,802, filed on Jan. 24, 2008, now Pat. No. 8,297,268.

(60) Provisional application No. 60/886,320, filed on Jan. 24, 2007, provisional application No. 60/886,295, filed on Jan. 23, 2007.

(51) Int. Cl.
*F41B 1/00* (2006.01)
*F42B 6/00* (2006.01)

(52) U.S. Cl.
CPC .. *F41B 1/00* (2013.01); *F42B 6/003* (2013.01)
USPC ..... 124/62

(58) Field of Classification Search
CPC ..... F41B 1/00; F42B 6/10; A63F 2009/0089
USPC ..... 124/62
See application file for complete search history.

(56) References Cited

U.S. PATENT DOCUMENTS

| | | | | |
|---|---|---|---|---|
| 186,651 | A | 1/1877 | White | |
| 344,915 | A | 7/1886 | Lang et al. | |
| 422,347 | A | 2/1890 | Hyde | |
| 632,838 | A * | 9/1899 | Jacobs | 124/62 |
| 856,813 | A | 6/1907 | Schultz | |
| 873,628 | A | 12/1907 | Stivers | |
| 1,113,338 | A * | 10/1914 | Hartman | 124/62 |
| 2,293,957 | A | 8/1942 | Wells | |
| 2,679,838 | A | 6/1954 | Thompson | |
| 2,888,003 | A | 3/1956 | Swanson | |
| 3,124,119 | A | 3/1964 | Ayala | |
| 3,137,287 | A | 6/1964 | De Arbun | |
| 3,142,294 | A | 7/1964 | Baldwin, Jr. | |
| 3,463,136 | A | 8/1969 | Vadas et al. | |
| 3,536,054 | A | 10/1970 | Stephens et al. | |
| 3,662,686 | A | 5/1972 | Baldini | |
| 3,735,748 | A * | 5/1973 | Gaylord | 124/62 |
| 4,054,120 | A * | 10/1977 | Foley | 124/62 |
| 4,103,893 | A | 8/1978 | Walker | |
| 4,283,061 | A | 8/1981 | Jordan | |

(Continued)

*Primary Examiner* — Daniel J Troy

(57) ABSTRACT

A projectile launcher comprising an elongate barrel provided with a bore, a magnetic detent, an associated discarding sabot, and an associated subcaliber projectile. Pending launch, the magnetic detent exerts a magnetic restraining influence to hold the subcaliber projectile inside the bore within proximity of the sabot. Launch thrust overcomes the magnetic restraining influence of the detent upon the projectile, and the sabot separates from the projectile after launch under the influence of atmospheric drag.

8 Claims, 21 Drawing Sheets

(56) References Cited

U.S. PATENT DOCUMENTS

| | | | |
|---|---|---|---|
| 4,296,687 | A | 10/1981 | Garrett |
| 4,360,954 | A | 11/1982 | Burns et al. |
| 4,419,978 | A | 12/1983 | Loftus |
| 4,434,718 | A | 3/1984 | Kopsch et al. |
| 4,537,176 | A | 8/1985 | Stravitz et al. |
| 4,565,009 | A | 1/1986 | Porter |
| 4,735,148 | A | 4/1988 | Holtman et al. |
| 4,841,867 | A | 6/1989 | Garrett |
| 4,854,294 | A | 8/1989 | Lala |
| 4,860,719 | A | 8/1989 | Scheiterlein |
| 5,150,909 | A | 9/1992 | Fitzwater |
| 5,239,930 | A | 8/1993 | Adam et al. |
| 5,297,492 | A | 3/1994 | Buc |
| 5,359,938 | A | 11/1994 | Campoli et al. |
| 5,481,980 | A | 1/1996 | Engel et al. |
| 5,544,642 | A | 8/1996 | Guthrie |
| 5,718,214 | A | 2/1998 | Altman et al. |
| 5,850,826 | A | 12/1998 | Guthrie |
| 6,073,560 | A | 6/2000 | Stone |
| 6,588,413 | B2 | 7/2003 | Nagasue |
| 6,752,136 | B1 | 6/2004 | Anderson |

* cited by examiner

APPARATUS FOR LAUNCHING SUBCALIBER PROJECTILES AT PROPELLANT OPERATING PRESSURES INCLUDING THE RANGE OF PRESSURES THAT MAY BE SUPPLIED BY HUMAN BREATH

CROSS-REFERENCE TO RELATED APPLICATIONS

This application is a divisional of U.S. patent application Ser. No. 12/018,802, filed 2008 Jan. 24 by the present inventor, now pending, which claims the benefit of provisional patent application U.S. Ser. No. 60/886,295 filed 2007 Jan. 23 by the present inventor, and the benefit of provisional patent application U.S. Ser. No. 60/886,320 filed 2007 Jan. 24 by the present inventor. Each patent application identified above is incorporated here by reference in its entirety, as if set forth at length, to provide continuity of disclosure.

FEDERALLY SPONSORED RESEARCH

Not Applicable

SEQUENCE LISTING OR PROGRAM

Not Applicable

BACKGROUND

Field of Invention

This invention relates to mechanical guns and projectors, specifically to such guns and projectors in which fluid pressure is provided by the user's mouth or lungs. This invention also relates generally to a sabot projectile; more particularly, a sabot projectile suited for use even at low operating pressures such as those provided by human breath.

INTRODUCTION

The inventive apparatus and method for launching subcaliber projectiles is adapted to perform efficiently and smoothly at propellant operating pressures that include the range of pressures that may be supplied by the breath of a human user. Furthermore, in certain embodiments the discarding of the associated sabot means features a very quick, clean separation from the subcaliber projectile, with sabot discarding fully operational at projectile velocities that include the range of velocities attainable by projectiles launched by the breath of a human user from a blowgun. Thus the instant invention is especially well-suited for providing a blowgun which can utilize the breath of the user to efficiently and accurately launch subcaliber projectiles.

Before moving further into this disclosure, it should be noted that the term, full caliber, when used herein to refer to blowgun projectiles, may be understood to mean, essentially full caliber, or, substantially full caliber, in order to include the many examples of full caliber blowgun projectiles met with in practical usage which have an actual caliber or diameter which is slightly less than the caliber of the barrel bore, in order that the widest portion of the projectile may substantially slidingly seal with the barrel bore to prevent excessive leakage of pressurized air or breath during launch, yet slide through the bore without excessive friction or snugness of fit, in order to achieve efficient propulsion. Thus a broadening of the meaning of the term, full caliber, to be inclusive of all three possibilities of projectiles with actual caliber dimension equal to, slightly greater than, or slightly less than the caliber dimension of the barrel bore, applies to the fullness of this disclosure, and will be understood to also apply to information set forth herein concerning the dimensions of full caliber sabot means employed with subcaliber blowgun projectiles.

It will be seen that the instant invention makes possible, in certain embodiments, appropriately low levels of launching resistance of the associated sabot projectile assembly, and appropriately low or very low levels of discarding resistance of the associated sabot means, thereby making the efficient and accurate launching of subcaliber projectiles compatible with the relatively low operating pressures provided by a human user's breath, and with the relatively modest velocities and energies typically attained by blowgun projectiles accelerated by the user's breath.

BACKGROUND

Prior Art

Blowguns work in a known manner to utilize the user's breath to accelerate and launch a projectile. Blowgun performance may be improved by increasing accuracy, power, and range, which is generally accomplished by broad strategies such as increasing launch force or velocity of the projectile, or by modifying the balance characteristics and aerodynamic properties of the projectile. Other broad strategies for improving blowgun performance include providing increased ease of aiming, as with a sighting mechanism, and providing a blowgun which can function as a multi-shot repeater, with the convenience and increased rate of fire compensating in a certain measure for any deficiencies of accuracy or power.

The prior state of the art regarding blowguns and improvements to their performance may be generally established by the following cited patents: U.S. Pat. No. 186,651 to Luther C. White and U.S. Pat. No. 856,813 to John Schultz utilized tapered bores with cooperating compressible dart pistons to provide increased launch force. U.S. Pat. No. 344,915 to Lewis H. Lang & John W. Hart utilized an interior annular shoulder detent in cooperation with a compressible dart piston so as to impose a temporary acceleration delay to boost launch force. U.S. Pat. No. 4,419,978 to Loftus utilized a pultruded barrel construction to facilitate proportioning of the bore for a longer power stroke to increase launch velocity. U.S. Pat. No. 6,588,413 to Yoichi Nagasue utilized an offset mouthpiece to allow sighting alignment of one eye directly along the blowgun barrel instead of the typical offset alignment of the eye when the barrel is aligned directly with the user's mouth. Taking a different approach, U.S. Pat. No. 4,565,009 to Porter utilized a stereoscopic blowgun sighting apparatus which exploits the user's binocular vision to create an illusionistic overlay image for superimposed sighting alignment with the target, suitable for use with a barrel aligned directly with the mouth. U.S. Pat. No. 3,137,287 to Rufo D. De Arbun and U.S. Pat. No. 3,124,119 to Carl Ayala provided repeating blowguns that launched elongate projectiles. U.S. Pat. No. 2,888,003 to Swanson and U.S. Pat. No. 5,850,826 to Guthrie provided repeater blowguns with tubular magazines that launched spherical projectiles. U.S. Pat. No. 5,544,642 to Guthrie provided a revolver-type repeater blowgun that selectively launched spherical or elongate projectiles.

The above cited patents are generally relevant to the prior state of the art. The following patents are more specifically related, each having partial relevance to one or more aspects of the inventive blowgun. U.S. Pat. No. 873,628 to Charles E.

Stivers utilized a conical paper dart piston for improved bore sealing properties. U.S. Pat. No. 4,283,061 to Rolf W. Jordan utilized a dart in which the tapered shaft and light weight of the hollow impeller piston yield a forwardly disposed center of gravity to promote aerodynamic stability of the projectile. Perhaps closest to the instant invention are the immediately following four blowgun-related patents: U.S. Pat. No. 3,735,748 to Gaylord utilized a blowgun having a plurality of magnets to hold darts on the barrel for easy access, with one magnet also holding a dart partially loaded within the barrel bore. U.S. Pat. No. 2,679,838 to Thompson utilized a projectile retaining blowgun which may be considered to include a type of projectile detent. U.S. Pat. No. 4,103,893 to Walker provided a tranquilizer dart especially suited for a blowgun, designed for launch with a sabot described implicitly in the method of use. U.S. Pat. No. 632,838 to Jacobs provided a blowgun that launched subcaliber spherical shot from a blowgun via a full caliber projectile carrier that was retained in the blowgun bore after launch. However, unlike the instant invention, none of these patents described or contemplated embodiments or alternative embodiments which utilized an external magnetic detent or other type of external detent means to assist in locating one or more elements of a sabot projectile assembly within the blowgun bore pending launch acceleration.

U.S. Pat. No. 3,735,748 to Gaylord may be considered to use a type of projectile detent, a magnet mounted near the mouthpiece which may serve to hold a dart partially loaded within the barrel bore. However, it is clearly the intention that the detent should only hold the dart in place within the bore in a partially loaded position, rather than in a fully loaded position. Furthermore, Gaylord does not disclose or contemplate alternative embodiments or methods of use in which such a projectile detent is used to help locate elements of a sabot projectile assembly within the bore and in spatial relation to one another.

U.S. Pat. No. 2,679,838 to Thompson provided a projectile retaining blowgun in the form of a peashooter with a hole in the barrel for partial insertion of the user's fingertip, which together with an interior annular shoulder provided by the mouthpiece, may be considered to function as a type of projectile detent with elements that cooperate in mutual opposition to locate or confine a full caliber projectile within the bore prior to launch and to prevent premature projectile displacement toward the breech or toward the muzzle. However, like Gaylord, Thompson does not disclose alternative embodiments or methods of use in which such a projectile detent is used to locate one or more elements of a sabot projectile assembly. Furthermore, Thompson's type of fingertip detent, although an elegant solution for the peashooter and projectile he discloses, would not be generally applicable to a wide variety of types of blowgun projectiles, particularly certain types of sabot projectiles that include subcaliber projectiles.

Although U.S. Pat. No. 4,103,893, to Walker does not recite or illustrate a sabot as a numbered element, a sabot is implicit in the disclosed method of use, which mentions launching the disclosed dart with a cotton or fibrous pellet inserted into the bore behind the loaded dart. However, Walker makes no provision for a detent to prevent premature sliding of the dart within the bore. Nor would the tranquilizer dart described by Walker exploit the full possibilities of substantial caliber reduction to provide a projectile with sufficiently high sectional density to confer substantial trajectory advantages for long range application. Instead, Walker's principle intention in including a sabot in the method of use seems to be to ensure adequate bore seal of the projectile. The type of cotton pellet sabot described, according to the specified method of use, would not function compatibly with very substantially reduced-caliber projectiles, particularly ones without affixed, substantially full caliber fins to form an interface to prevent blow-past of the sabot around or alongside the subprojectile. No mention is made of alternative embodiments which would employ sabots of reduced parasitic mass and friction and greater structural and dimensional uniformity. Nor are disclosed alternative embodiments to the tranquilizer dart suitable for general sporting applications including target shooting and hunting.

U.S. Pat. No. 632,838 to Jacobs does utilize round-shot projectiles which may be used at a substantial caliber reduction of shot-caliber relative bore-caliber. Spherical shot or pellets may exhibit higher sectional densities than are typical of many elongate full caliber fixed-piston blowgun projectiles. Even so, a spherical projectile, particularly in small shot-caliber sizes, is well recognized as having low sectional densities compared to equally calibered elongate solid-body ammunition. However, Jacobs does not disclose any way to use his blowgun to launch elongate subcaliber projectiles which could be more effectively adapted to exhibit high sectional densities in-flight. Instead, Jacob's principle intention is to exploit the convenience and economy of shot as a replacement for possibly more complex and expensive elongate projectiles such as darts. However, if small caliber shot such as BB shot were launched as full caliber projectiles, the correspondingly small barrel bore would excessively restrict the inflow of the user's breath. On the other hand, at larger caliber sizes, full caliber metal shot would generally be excessively massive for thrust provided by a user's breath. Thus, in order to utilize shot as a projectile source, Jacobs' blowgun exploits increased thrust-to-mass ratio by launching shot in an oversized bore with a full caliber carrier. However, the shot-retention lip and self-centering cavity of the carrier disclosed by Jacobs would not work effectively with elongate projectiles. The carrier's shot-retention lip may be considered as a type of projectile detent. Jacobs does not describe or contemplate any alternative detent means, such as an exterior magnetic detent, to hold the projectile in loaded disposition against the carrier, an arrangement which would allow the shot-retention lip to be eliminated and the cavity to be much smaller and shallower, thus facilitating the reduction of parasitic mass and bearing friction of the carrier. Such an arrangement would also eliminate the self-centering seating movement of the projectile within the carrier at launch initiation, thereby minimizing potential for vibration. Jacobs does not disclose any provision for engaging shot asymmetrically against the carrier, or for letting the shot-projectile ride directly on the bore, arrangements which would offer the possibility of requiring lessened carrier function, so that the nominal carrier might instead function primarily as a pusher plug, thereby offering additional opportunity to reduce the parasitic mass and friction of the carrier or pusher plug. Jacobs also does not disclose any provision to provide the bore with an interior guidance groove to apply enhanced guidance to the shot-projectile or other projectile during launch. Jacobs discloses a ported barrel and a cushioned stop to decelerate and retain the carrier at the completion of its power stroke. However, Jacobs does not describe or contemplate embodiments in which provision is made to engage and decelerate the carrier with a stop means or catching means that is not only yieldingly cushioned, but is also actually structurally displaceable relative the bore, in order to reduce potential of damage to the carrier and blowgun by exploiting conservation of momentum and inelastic collision to reduce the mutual impact shock of the carrier and the carrier stop upon each other. In the blowgun disclosed by Jacobs, the porting holes or slots needed to actuate partial carrier deceleration before reaching the carrier stop causes a shortening of the available power stroke length for a given bore length. Jacobs makes no provision for alternate embodiments in which the carrier may be replaced by, or embodied as, a launchable discarding sabot which is not retained in the bore after launch, thus not requiring in-bore deceleration, and therefore being able to exploit the longest possible power stroke for a given bore length to reach maximum launch velocity. Furthermore, such a discarding sabot might be more lightly structured than the retainable carrier disclosed by Jacobs, again facilitating reduction of parasitic mass and launch friction. Jacobs also discloses no provision for using bore rifling with pre-formed cooperating carrier surfaces to spin the carrier when launching spherical shot or other projectiles and thereby transferring stabilizing spin to the subprojectile.

Sabots generally work in a known manner to launch subcaliber projectiles, effectually decreasing the sectional density of a projectile during launch to achieve higher thrust-to-mass ratio, and by thereafter discarding, restoring a higher level of sectional density to the projectile for in-flight ballistic advantages and possible terminal ballistic advantages.

To achieve efficient and accurate launching of subcaliber projectiles, parasitic mass and bearing friction of the sabot must be kept within acceptable levels for available thrust. Suitable means must be utilized so that various other sources of resistance to launching, sabot disengagement, and sabot discarding are simultaneously limited to acceptable levels compatible with available thrust. Such means must still ensure secure locating of sabot projectile assembly components within the blowgun after loading, pending launch and during handling. Furthermore, to advantageously obtain higher efficiencies in terms of ballistic advantages, in-flight sectional density of the projectile must be made sufficiently high. The applicant knows of no prior-art blowgun able to simultaneously achieve or deliver all of these objects or advantages.

Prior-art blowguns were unable to efficiently launch subcaliber projectiles, and were therefore limited to effective use with full caliber projectiles. Full caliber projectiles, in order to be propelled by the relatively low operating pressures typically provided by a human user's breath, are required to have relatively low sectional densities, since a full caliber projectile with excessively high sectional density would be excessively massive for the available thrust and would thus be accelerated too slowly, achieving low exit velocities, poor trajectories, and probably causing discomfort or strain to the user's airways and lungs. The low sectional density and correspondingly low ballistic coefficients of full caliber blowgun projectiles means that their trajectories are excessively curved, particularly at extended ranges, making maximum range limited and causing targeting compensation at extended ranges to be very difficult due to the large amount of barrel elevation needed to compensate for the excessive amount of vertical drop of the projectile. Using full-caliber projectiles of lighter mass to achieve higher velocities and flattened trajectories may yield improved performance at close ranges, but at extended ranges trajectory will still be excessively curved, since lightening the mass but keeping the caliber constant results in even lower sectional density.

Another problem encountered with full caliber blowgun projectiles is a severe limitation in the ability to adjust projectile properties such as form factor, mass distribution, and configuration of aerodynamic surfaces, in order to improve aerodynamic performance and balance to yield benefits such as reduced drag, reduced sensitivity to cross-winds, increased ballistic coefficient, and improved stability and accuracy. This severe limitation is imposed by the requirement that some fixed portion of the projectile must be suitably shaped and sized to serve as a substantially full caliber piston slidingly sealable with the bore of the blowgun barrel.

Due to the problems set forth above, prior-art blowguns achieved only limited performance. Inadequate ability to improve projectiles in terms of characteristics such as sectional density, form factor, ballistic coefficient, mass distribution, balance, configuration of aerodynamic surfaces, and internal ballistic stability caused significant reduction of the benefits that were intended to be provided by prior-art attempts to improve performance. For example, prior-art strategies that yielded increased projectile velocity were able to provide flatter trajectories at short ranges, and modest increases in maximum range. However, the fact that full caliber projectiles still often had surprisingly low sectional densities and correspondingly poor ballistic coefficients meant that projectile velocity decreased very rapidly in flight, with the result that maximum range remained limited, and trajectories, particularly at extended ranges, remained excessively curved, so that long range targeting compensation was still very difficult due to excessive vertical drop of the projectile, while other problems included tendencies towards balance- and aerodynamic-related instability, along with various sources of inconsistency in the orientation and motion of the projectile as it was launched into flight. Additionally, the above problems with prior-art blowguns and projectiles tended to encourage methods of use which did not sufficiently customize blowguns and projectiles for each particular user's abilities, skills, and shooting objectives.

The problems discussed above would seem to make the blowgun a natural candidate for application of the solution or strategy of using subcaliber projectiles with associated sabot means. Subcaliber projectiles with associated discarding sabot means, which may also be referred to as sabot projectiles, have long been employed in various types of artillery and firearms, and provide greatly increased ability to adjust projectile properties such as form factor and mass, in order to obtain advantages such as, for example, higher thrust-to-mass ratio during launch acceleration, as well as improved sectional density and ballistic coefficient of the subcaliber projectile as it travels along its external trajectory. Such advantages in turn can provide performance improvements such as increased launch velocity, increased retention of velocity and energy downrange, reduced drag, flatter trajectory, increased maximum range, and more efficient target penetration.

However, despite the advantages described above, sabot projectile solutions have not been effectively employed in prior-art blowguns, due to the fact that prior-art sabot projectiles are not adapted to be launched efficiently within the range of operating pressures that may be typically provided by human breath. Furthermore, discarding of prior-art sabots does not operate efficiently within the range of velocities typically attainable by blowgun projectiles. Rather, successful prior-art sabot projectiles are generally designed to be used in firearms, artillery, and the like, in which the propellants employed to launch projectiles typically generate operating pressures which are measured in hundreds or thousands of pounds per square inch. The very tight fit between a sabot and a barrel bore necessary to form an adequate gas seal against such extremely high pressures of expanding propellant gases imposes very high levels of launching resistance as the sabot projectile assembly is pushed along the bore during launch. Furthermore, in firearms and artillery, projectile muzzle velocities typically approach or exceed the speed of sound, with correspondingly high levels of atmospheric drag encountered by the projectile. Such extremely high levels of operating pressures and in-flight drag are sufficient to overcome the high levels of launching resistance and discarding resistance imposed by the various types of connections or connecting means used in firearms and artillery for the purpose of securing sabot projectile components together and in correct position within the bore or firing chamber during various stages of the loading and launching sequence, while maintaining an adequate gas seal.

Sabots utilized in artillery are often somewhat structurally complex, especially if the subprojectile has a very substantial caliber reduction relative the bore caliber. Such sabots may have a carrier portion structurally separate from a pusher plug base portion. Some such carriers are one-piece, often with slots or other weakening zones to cause fracture into segments or pieces in a predictable manner upon launch. Such one-piece carriers are often formed by casting, using the subprojectile as a core in a casting mold, as in U.S. Pat. No. 4,360,954 to Burns et al. Other carriers may be multi-piece, often formed as several separate segments. Direct connections, or various types of intermediary connecting means, are employed to connect base to carrier, carrier segments to one another (where appropriate), and base and carrier to the subprojectile. Examples of such intermediary connecting means include frangible petals and severable spinner bands, as utilized respectively in U.S. Pat. Nos. 4,841,867 and 4,296,687 to Garrett. In order to disengage direct connections or intermediary connecting means between the sabot components and the subprojectile, artillery applications exploit high levels of inertial, compressive, and centrifugal forces, and of gas or air pressure loads, to cause obturation, upset, and other structural deformation, rupture, or fracture. For example, U.S. Pat. No. 5,297,492 to Buc utilizes propellant gas pressure entrapped in an internal aft cavity of the sabot to blow apart a solid obturator ring upon muzzle exit, while U.S. Pat. No. 4,735,148 to Holtman et al. exploits high air resistance pressure of in-flight drag and centrifugal forces generated by a projectile spin rate of approximately 45,000 rpm to shed and disintegrate a plastic composite sabot. In a related field, U.S. Pat. No. 5,239,930 to Adams et al. launched a hypervelocity subprojectile with a sabot that included a foam matrix projectile-retaining means, with the foam matrix crumbling into a powder under the immense linear acceleration forces of launch and thereby disengaging the sabot from the projectile. Forces generated during launch in artillery and hypervelocity projector applications are sufficient to overcome high levels of launching and discarding resistance of sabot projectiles. Even in the artillery sabot projectile adapted for launch from a smooth bore in U.S. Pat. No. 5,359,938 to Campoli et al, high operating pressures and high velocities are required to overcome high levels of launching, disengaging, and discarding resistance and to actuate the disclosed parallel lift separation method.

Such high levels of launching resistance and discarding resistance are not able to be overcome efficiently, if at all, by the much lower operating pressures provided by human breath, and by the considerably lower velocities and energies attainable by blowgun projectiles launched by human breath. Small arms sabot projectiles typically have a much less pronounced caliber reduction and are generally less complex than examples found in artillery applications. Small arms firearms typically employ sleeve or cup type sabots. Modified cup type sabots for small arms are often monolithic structures of molded plastic with multiple flexible petal segments extending from a pusher plug base. Such sabots often retain the subprojectile in place with a frictional fit, force-fit, interference fit or encapsulation. U.S. Pat. No. 6,073,560 to Stone utilized a small arms petalled sabot suitable for muzzle-loaders and other firearms, in which the weighted protions of the petals assisted in better exploiting centrifugal forces to open the sabot and expose greater area to air drag.

It may also be noted that some sabot projectiles used in firearms and artillery are able to exploit centrifugal force, produced by spin imparted by barrel rifling, in order to enhance the sabot's performance in peeling away from the projectile quickly and cleanly. However, it is problematic to apply barrel rifling to blowguns without excessively increasing launching resistance. Also, blowgun rifling would typically launch projectiles with slower spin rates than those imparted to firearm projectiles, yielding relatively low levels of centrifugal force to be exploited to aid discarding.

An example of a small arms sabot that did not rely on centrifugal force is U.S. Pat. No. 4,434,718 to Kopsch et al., which utilized a sabot projectile that included a sabot and finned subcaliber projectile suitable for launch from a shotgun cartridge through and from a smooth bore barrel. The sabot is a simple, cylindrical shell or can type, with long thin petals designed to be opened by air pressure. The finned subprojectile has fins offset to produce aerodynamically induced stabilizing spin. It is not explicitly stated how the subprojectile is dispositioned when loaded within the cylindrical sabot other than that the backs of the fins are supported on the transverse metal disk. However, taking into consideration the accompanying drawing illustrations, it appears that the intention is for the fins to fit snugly against the petals when the sabot is loaded within the shotgun cartridge case, holding the sabot body in an essentially centered position axisymmetric with the sabot cylinder. Certainly that seems the only method that would not require additional complexity, or extra mass. The crimped forward end of the cartridge shell serves as an additional or alternative projectile retaining means prior to launch. Stone's sabot projectile cited above does not require a cartridge shell when used in a muzzle-loader.

It may be useful to summarize several situations likely to result if prior-art sabot projectiles were used or superficially adapted for use in a blowgun, even relatively simple small arms types such as those in the above cited U.S. Pat. No. 4,434,718 and U.S. Pat. No. 6,073,560. First, inadequate operating pressures to overcome launch resistance would result in the sabot projectile either being stuck in the barrel bore, or else exiting the barrel bore with reduced velocity. Second, in the event the sabot projectile did attain satisfactory exit velocity, since satisfactory velocities for blowgun projectiles are still typically too low to actuate discarding of prior-art sabots, there would likely be a failure of the sabot to achieve separation and thereby discard, in which case the sabot means and the subcaliber projectile would continue to travel along an external trajectory together, performing in effect as a full caliber projectile and causing the subcaliber projectile to fail to achieve its true function. Even if separation occurred, release would likely not be quick and clean, thus transmitting excessive drag from the sabot means to the subcaliber projectile during discarding, thereby lowering projectile velocity, or introducing trajectory inaccuracies for the projectile, or both. Third, even if the degree of discarding resistance were lowered sufficiently to guarantee successful, clean discarding of the sabot means, the consequent looseness or tenuousness of the connection between the sabot means and the projectile proper would almost certainly result in premature separation of the sabot projectile components prior to launch acceleration or prior to exit from the barrel bore. This summary also indicates a list of pitfalls that should preferably be avoided by a successful solution to providing a blowgun that can efficiently and accurately launch subcaliber projectiles.

It will be apparent to one familiar with the art that even the airgun-compatible sabot utilized in U.S. Pat. No. 5,150,909 to Fitzwater would not operate successfully or efficiently at pressures provided by human breath. Nor would the sabots utilized in U.S. Pat. No. 422,347 to Hyde and U.S. Pat. No. 3,536,054 to Stephens et al., even though they are designed for use in vacuum cannons, which operate at modest pressure differentials. Blowgun pressure differentials, however, are generally even more modest, probably never or rarely exceeding 4 pounds per square inch (psi), with 2 psi and lower being much more typical for the average user.

One other blowgun-related patent to be considered is U.S. Pat. No. 4,854,294 to Lala, which disclosed a pressure-assisted blowgun in which there was no direct connection between the mouthpiece and the blowgun tube; rather a breath operated valve was used to connect a source of pressurized gas at 120 psi to the blowgun tube to launch target darts of 10 to 15 grains. Although nominally a blowgun, Lala's apparatus does not utilize the user's breath to propel the projectile, but merely to actuate a pressure valve connected to an external pressure source. Such a solution may not appeal to those blowgun users who prefer to use their own breath to provide the motive force to accelerate and launch the projectile, rather than rely on an external motive source such as a canister of pressurized gas. It may also be appreciated that 10 to 15 grain target darts, which are typical masses for commercial wire rod darts used with popular 40 caliber and 50 caliber blowguns, would have very low sectional densities, even lower than that of a steel BB shot used in mechanical airguns. Lala does not disclose, describe, or contemplate any alternative embodiments capable of launching subcaliber projectiles.

It should be emphasized how important it is, in certain embodiments, that when the sabot projectile assembly has completed exiting the bore through the muzzle opening of the blowgun barrel, and the propulsive thrust has consequently substantially dissipated, there should preferably at that time be, as nearly as possible, substantially no positive connection between the subcaliber projectile and the sabot means, either directly or via intermediary connecting means, as would provide any substantial resistance to axial displacement of the subcaliber projectile forwardly relative the sabot means, nor to axial displacement of the sabot means rearwardly relative the subcaliber projectile. This point is very important, because at the relatively low velocities and energies which blowgun projectiles typically attain, it may be surprisingly difficult to obtain separation, or clean separation, of the sabot from the subcaliber projectile if there is even a seemingly tenuous connection between the two components which would excessively resist the type of relative axial displacement described in the preceding sentence. Thus, there is the potential for even a seemingly weak force-fit engagement, frictional engagement, or the like, to be able to either cause failure of the sabot to separate at all or else cause sabot separation to either be too slow or too violent, thereby transmitting drag or trajectory inaccuracies or both to the projectile proper.

It is therefore adviseable to minimize or eliminate the need for positive connections or connecting means between sabot projectile elements by, for example, utilizing some type of external detent such as a magnetic detent. As was seen, closely related blowgun patents did not utilize a detent to locate elements of a sabot projectile in disposition pending launch. A number of patents in other fields utilize magnetic means to retain a projectile in loaded desposition pending launch. Examples include U.S. Pat. No. 3,463,136 to Vadas et al., U.S. Pat. No. 3,142,294 to Baldwin, and U.S. Pat. No. 2,293,957 to Wells, all of which disclosed mechanical air guns that utilized a magnetic bolt or magnetic breech pin to hold a BB shot or other magnetically attactable full caliber airgun projectile in loaded position pending launch pressurization. U.S. Pat. No. 4,860,719 to Scheiterlein utilized a magnetic hold-down device for holding an arrow securely on the arrowrest of a crossbow without direct contact of the hold-down device with the arrow or arrowhead. However, none of these patents disclose alternate embodiments or methods of use in which such a magnetic bolt, breech pin, or hold-down device is used to locate an element of a sabot projectile assembly preparatory to firing; and in particular to hold a subcaliber projectile in place against, within, or in front of a sabot means in loaded disposition pending launch.

It is also important to note that, despite the seemingly superadequate operating pressures and projectile velocities available to overcome launching resistance and to actuate sabot discarding in firearms and artillery, a survey of certain prior art designs of firearm and artillery sabot projectiles reveals concerns for minimizing adverse effects on projectile trajectory and accuracy that may be caused during sabot discarding. For example, U.S. Pat. No. 5,481,980 to Engel et al utilized special parting plane geometry to avoid impact of edges of the sabot segments upon the projectile during sabot separation. U.S. Pat. No. 4,841,867 to Garrett used a sabot base free of direct positive coupling to the subprojectile so as to provide a more compatible interface of the base with the gun barrel. If such concerns for providing cleaner sabot release and separation are deemed worthy of attention in adapting sabot projectiles for use in firearms or artillery, they may be considered as even more critical in obtaining optimal, or even satisfactory, performance from a sabot projectile adapted for use in a blowgun.

Another limiting factor in the performance of prior art blowguns is that insufficient correctional guidance is applied to certain portions of the projectile during launch acceleration, resulting in internal ballistic instability that translates into accuracy dispersions in the projectile's external trajectory. Certain prior art designs attempted to address this problem, but the means employed resulted in increased launch resistance, increased projectile mass, and undesirable aerodynamic and balance characteristics of the projectile. This may be seen in the cylindrical bodied darts utilized in U.S. Pat. No. 3,735,748 to Gaylord, in which the cylindrical piston bodies are intended to align the dart, including the forwardly extending rod, coincident with the longitudinal axis of the barrel bore. However, many typical commercial blowgun darts do not utilize a cylindrical piston body, but rather a piston body that is essentially conical, and which usually does not maintain the longitudinal axis of the dart in alignment with the longitudinal axis of the barrel bore. In a typical full caliber blowgun projectile, the forward end or tip of the projectile, which is often the forward tip of a slender rod, is usually the only point of direct contact between the bore and the often relatively rigid rod, since the rod typically angles down from a point of substantially rigid attachment with, or insertion into, a full caliber fixed piston, to rest upon the bore. Since the forward tip of the rod is usually the rod's only direct point of contact with the bore, the rod is provided with only a very small area of direct support contact with the bore, and thus very minimal guidance is applied to the forward end of the rod, which is also the forward end of the projectile. This arrangement, in conjunction with the typically slightly loose fit of the piston within the bore, usually necessary in a blowgun projectile to avoid excessive friction and launching resistance, leaves some play in the orientation of the dart. Particularly, the forward tip of the rod may slide transversely upon the bore and swing toward the left or right, or possibly even oscillate between left and right. The forward tip of the rod may also lift off the bore, due to play of the piston under launch pressure, or due to barrel curvature, such as that caused by gravity-induced sag, in which case substantially no guidance is applied to the forward end of the rod unless contact with the bore is reestablished essentially by happenstance.

Prior art blowguns also presented certain disadvantages concerned with target shooting. Prior art practices for shooting blowgun projectiles at targets and retrieving projectiles from the targets suffered from an excessively high potential for damage to projectiles, which are typically intended to be reusable, and from excessive amounts of time and effort spent in retrieving projectiles from the target after a round of shooting. Prior art practices also placed limitations on accuracy of assessment of shot placement on the target face, and made it difficult to practice more than a rather narrow variety of target practice shooting styles and formats.

Prior art blowguns also presented problems in launching spherical projectiles, and certain other essentially non-elongate projectiles, since full caliber spherical projectiles typically had relatively high sectional densities and poor air seal performance, resulting in poor launch acceleration and reduced velocities.

SUMMARY

In accordance with one embodiment a blowgun apparatus comprises a blowgun with an associated subcaliber projectile and an associated sabot means and an optional mouthpiece. In accordance with another embodiment a blowgun apparatus comprises a blowgun with a detent means with an associated subcaliber projectile and an associated sabot means and an optional mouthpiece. In accordance with another embodiment a blowgun apparatus comprises a blowgun with an interiorly disposed projectile guidance means and an optional projectile means.

DRAWINGS

Figures

FIG. 1 depicts a side view of the inventive blowgun in an embodiment which comprises blowgun 110 with associated subcaliber projectile 140 and associated sabot means 170.

Figure 14:
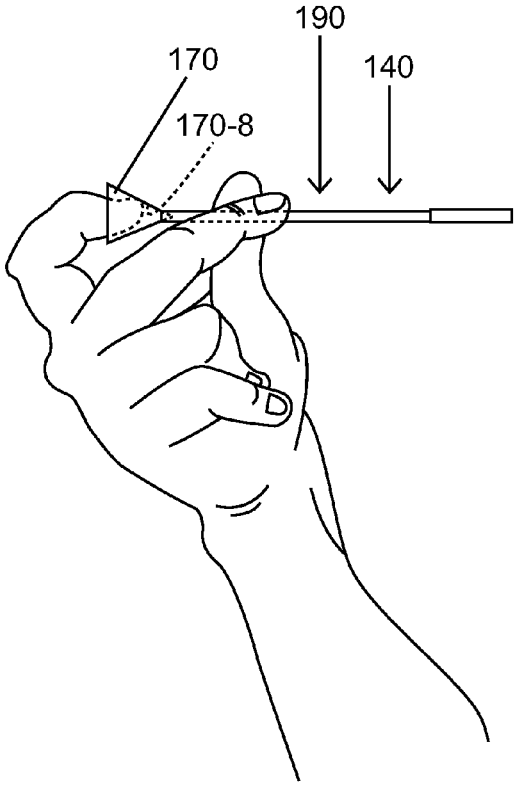

FIG. 14 depicts a perspective view of a possible method by which the user may manually hold subcaliber projectile 140 and sabot 170 engaged together as sabot projectile assembly 190

Figure 15:
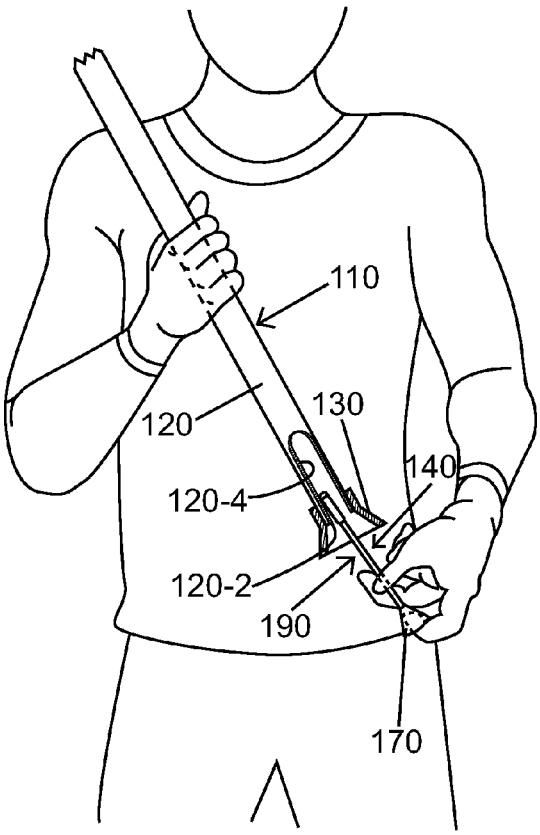
Figure 16:
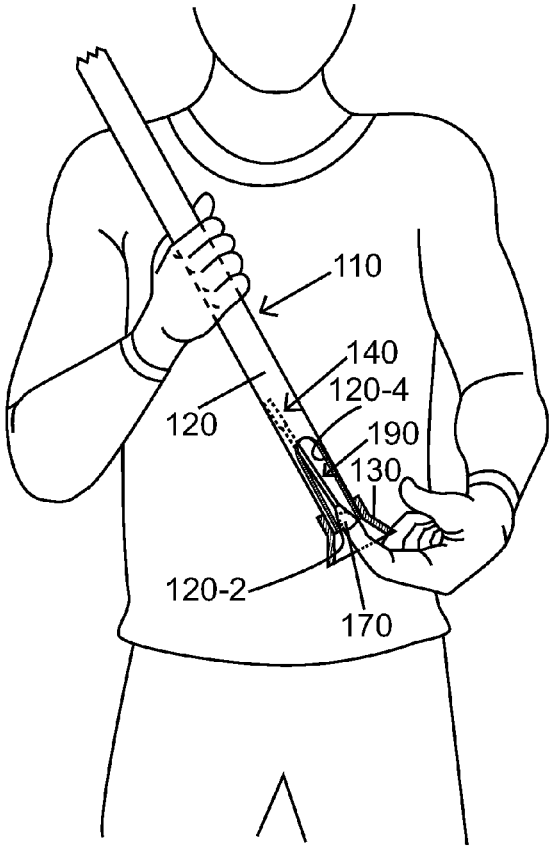

FIGS. 15 and 16 depict stages in a possible method of loading sabot projectile assembly 190 into barrel bore 120-4 of blowgun 110.

Figure 17:
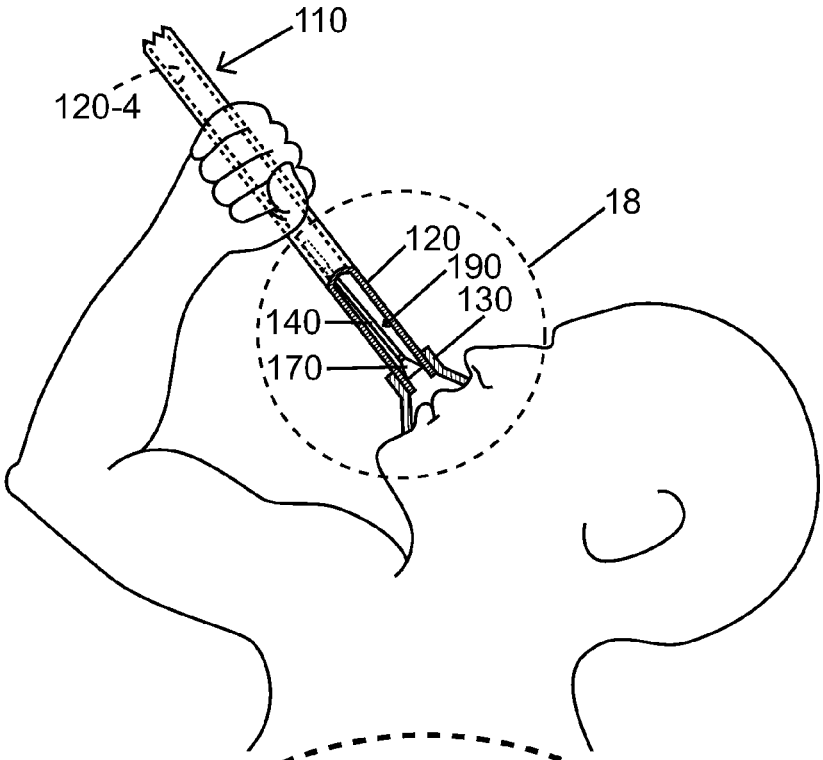
Figure 18:
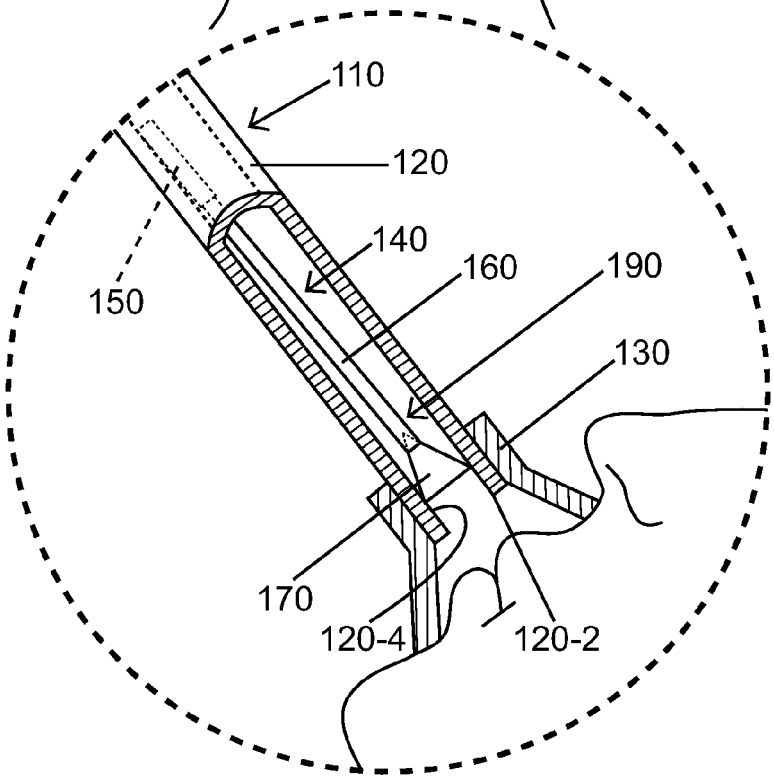

FIGS. 17 and 18 depict sabot projectile assembly 190 in loaded position within bore 120-4 after completion of loading insertion into and through breech 120-2 and before initiation of launch acceleration.

Figure 19:
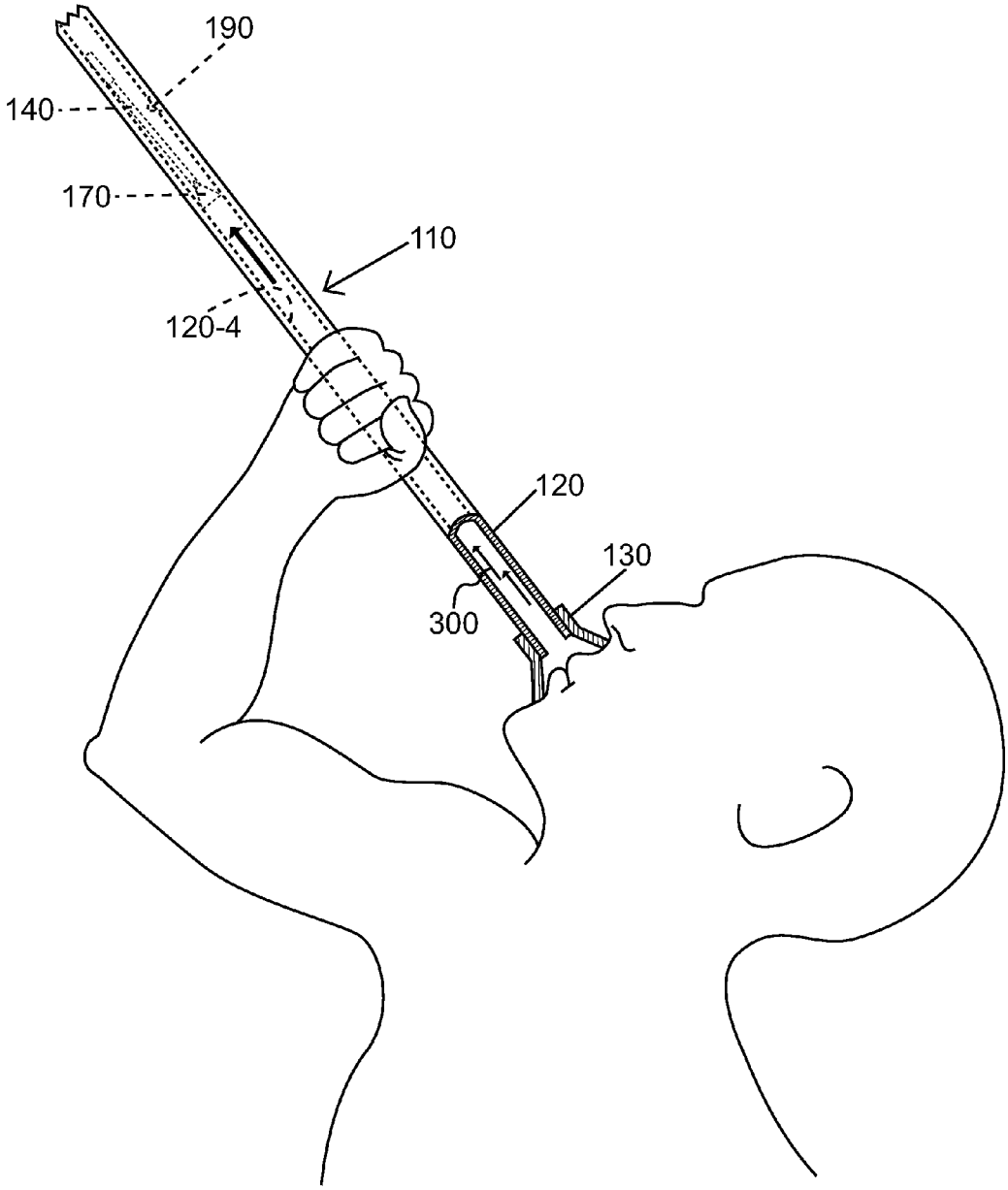

FIG. 19 shows sabot projectile assembly 190 partially displaced along bore 120-4, traveling under launch acceleration through bore 120-4.

Figure 20:
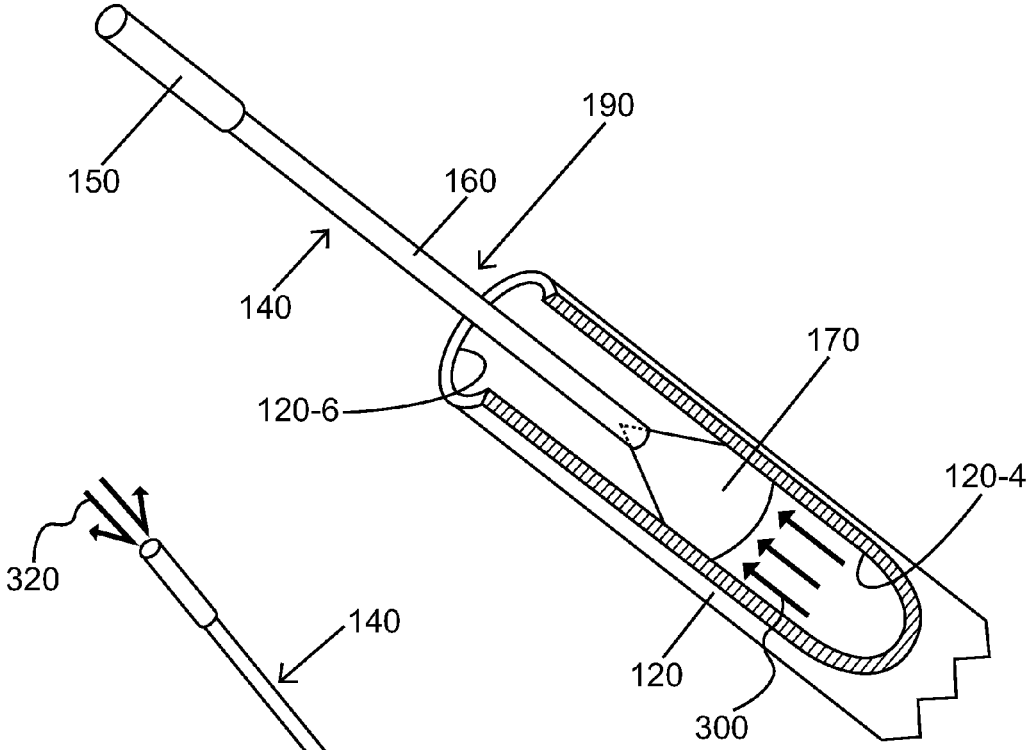

FIG. 20 depicts a perspective view of the distal portion of barrel 120, with the portion at and near muzzle 120-6 partially cut away to show sabot projectile assembly 190 partially exited through and out muzzle 120-6.

Figure 21:
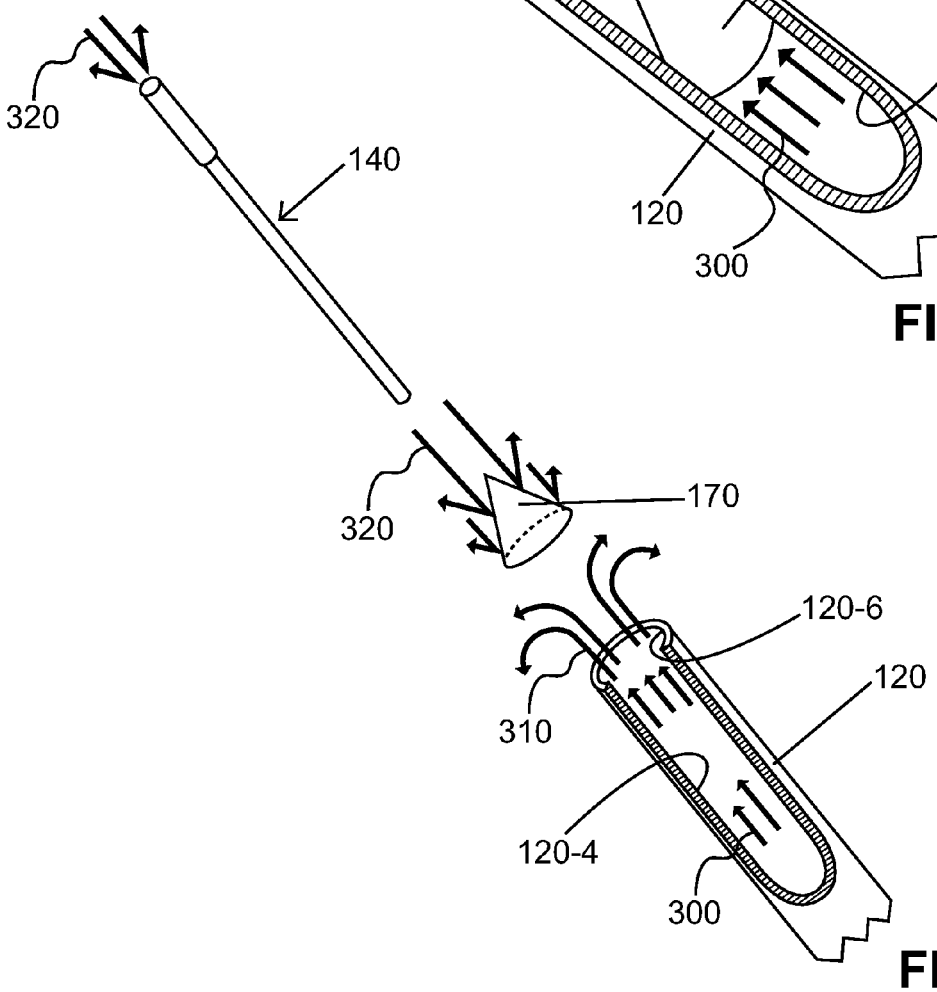

FIG. 21 is a perspective view depicting discarding separation of sabot 170 from subcaliber projectile 140 after sabot 170 has completed exiting through and out muzzle 120-6

Figure 22:
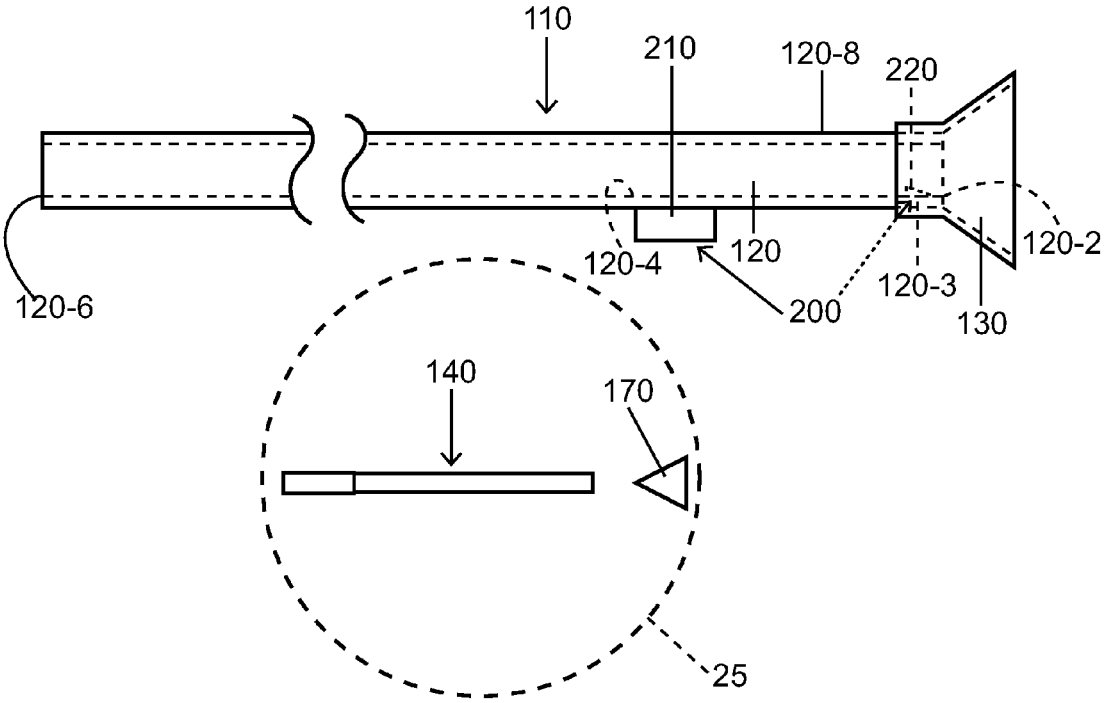

FIG. 22 is a side view of the inventive blowgun in another embodiment which comprises blowgun 110, associated subcaliber projectile 140, and associated sabot means 170.

Figure 23:
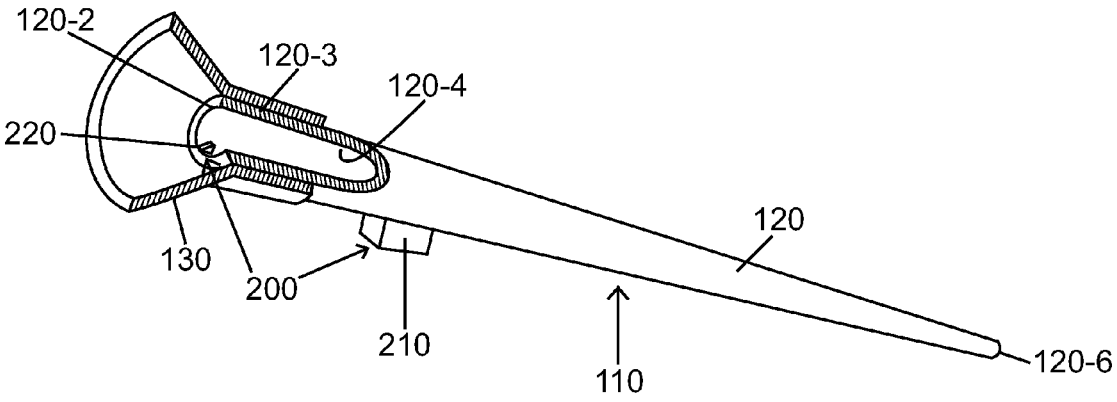

FIG. 23 depicts a perspective view of blowgun 110

Figure 24:
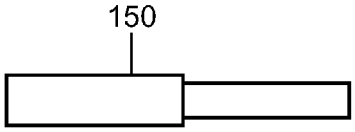

FIG. 24 is a side view of foreshaft 150 shown by itself.

Figure 25:
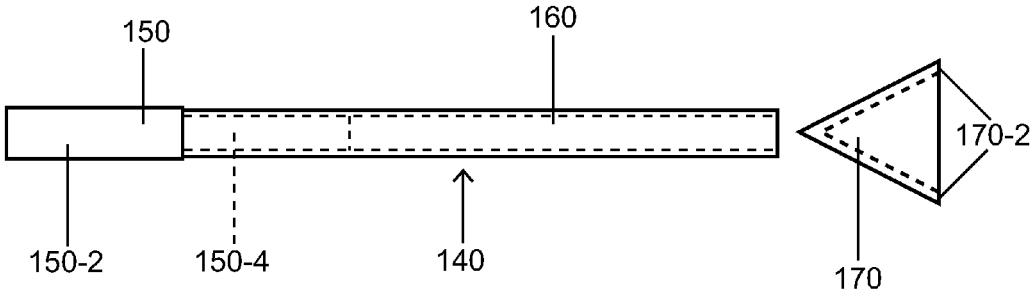

FIG. 25 is a portion of the side view depicted in FIG. 22, enlarged to show with greater clarity and detail a side view of subcaliber projectile 140 and sabot means 170.

Figure 26:
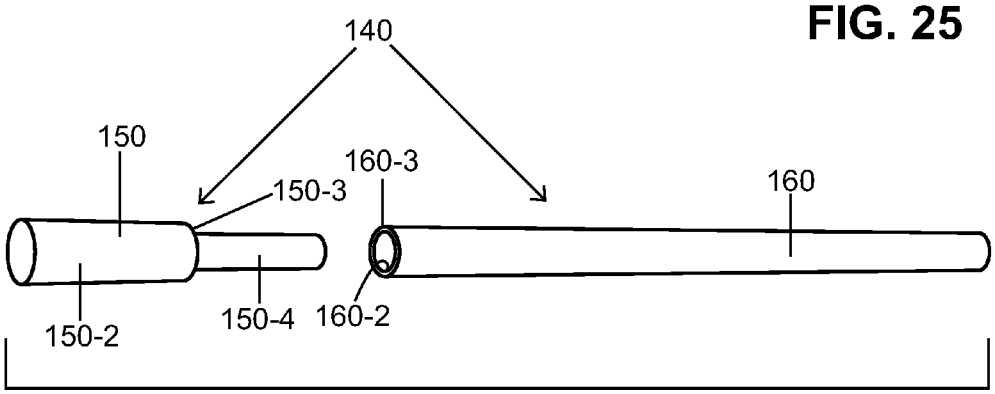
Figure 27:
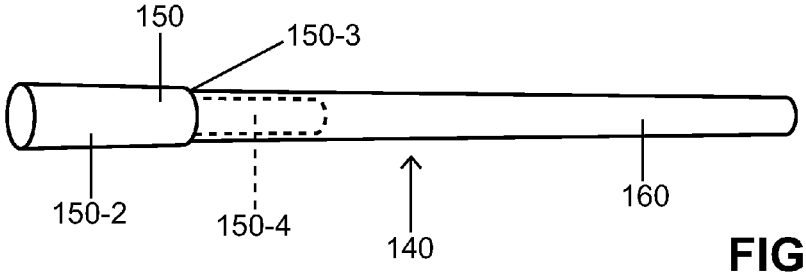

FIGS. 26 and 27 are, respectively, exploded and assembled perspective views of subcaliber projectile 140.

Figure 28:
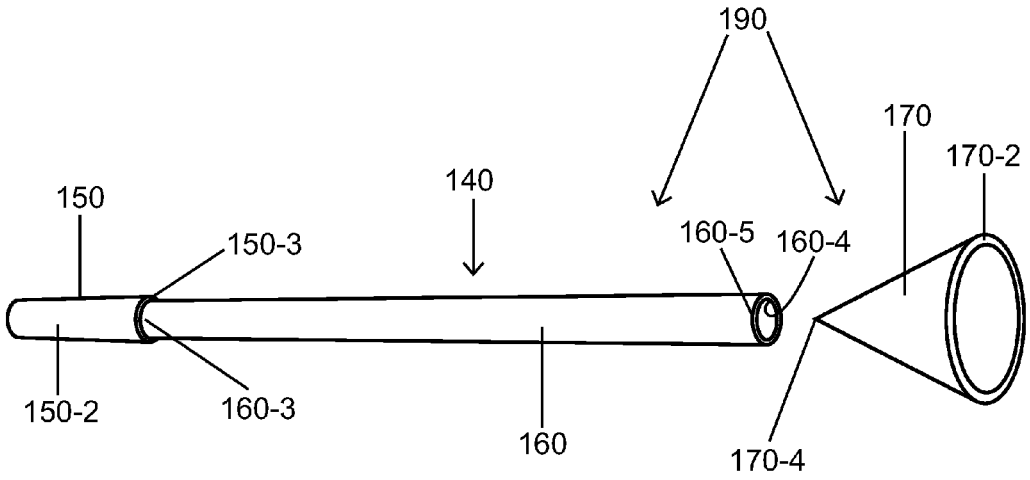
Figure 29:
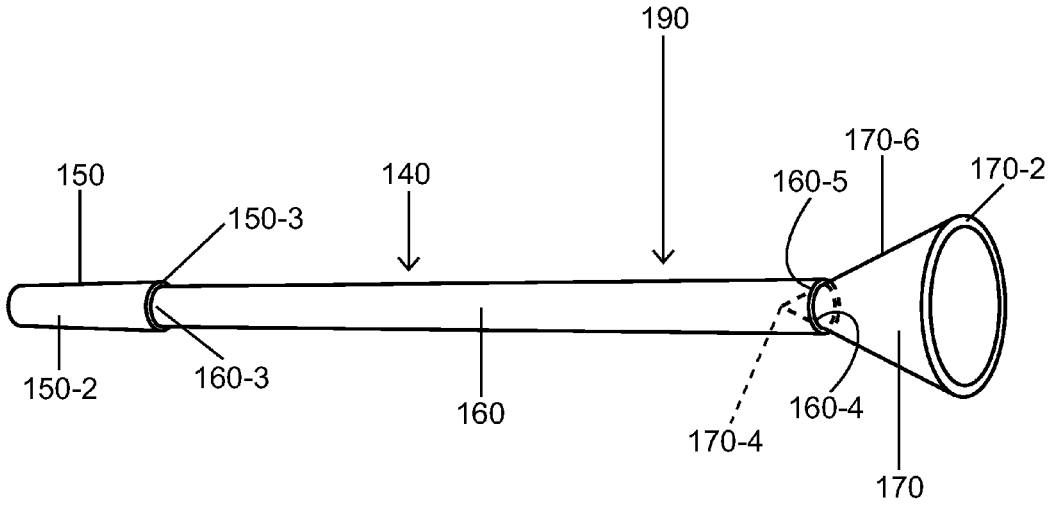

FIG. 28 and FIG. 29 depict, respectively, exploded and assembled perspective views of sabot projectile assembly 190.

Figure 30:
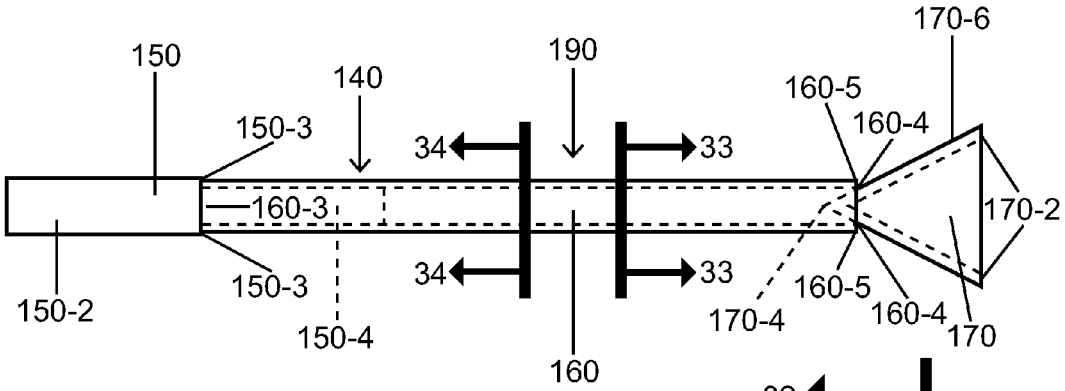
Figure 31:
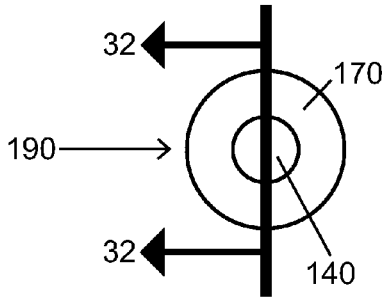

FIG. 30 and FIG. 31 depict, respectively, side elevational and front elevational views of sabot projectile assembly 190.

Figure 32:
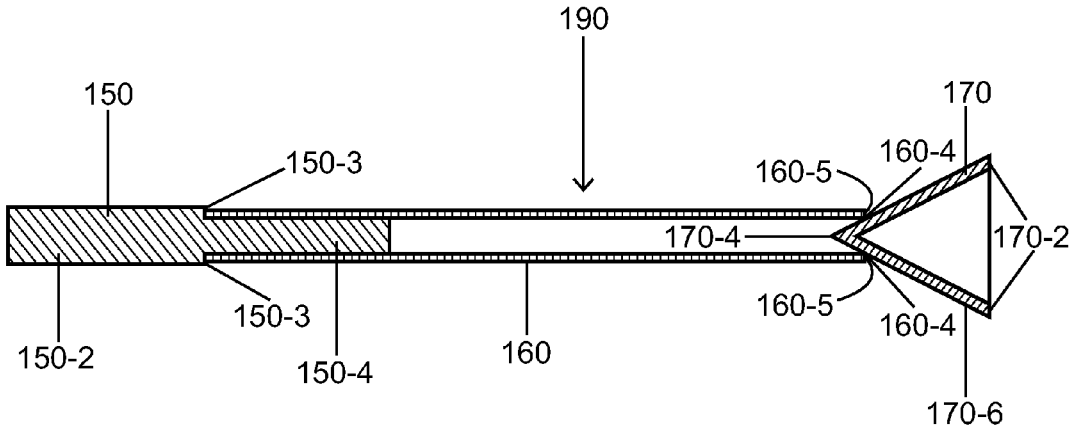

FIG. 32 depicts a sectional side view of sabot projectile assembly 190, along section line 32-32 from FIG. 31

Figure 33:
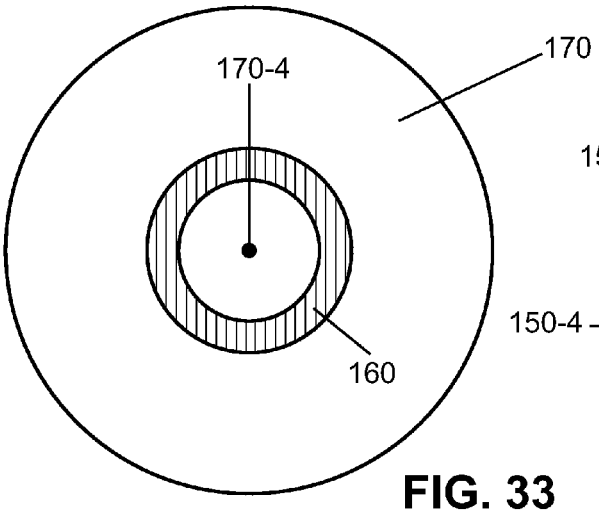

FIG. 33 depicts a sectional view, on a somewhat enlarged scale for increased clarity of detail, of sabot projectile assembly 190, along section line 33-33 from FIG. 30.

Figure 34:
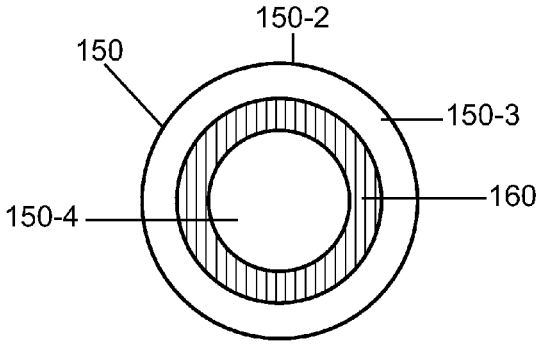

FIG. 34 depicts a sectional view, on a somewhat enlarged scale for increased clarity of detail, of sabot projectile assembly 190 along section line 34-34 from FIG. 30.

Figure 35:
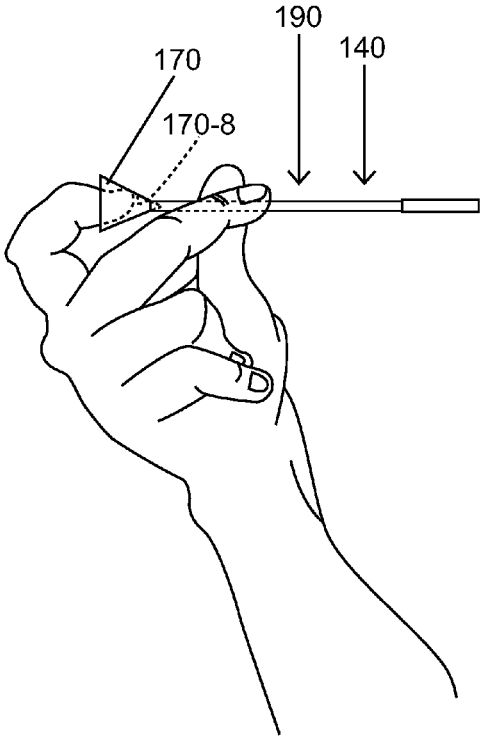

FIG. 35 depicts a perspective view of a possible method by which the user may manually hold subcaliber projectile 140 and sabot 170 engaged together as sabot projectile assembly 190

Figure 36:
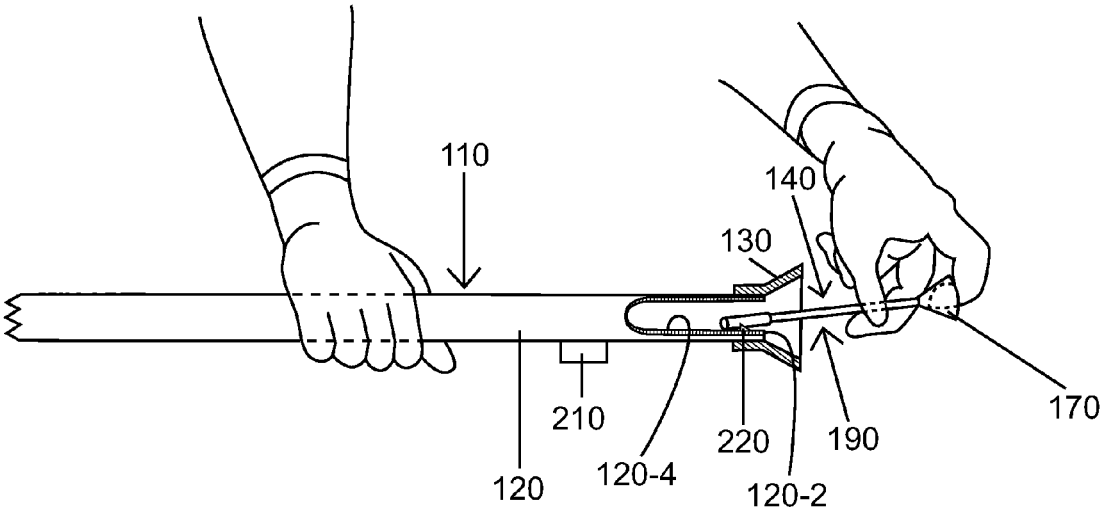
Figure 37:
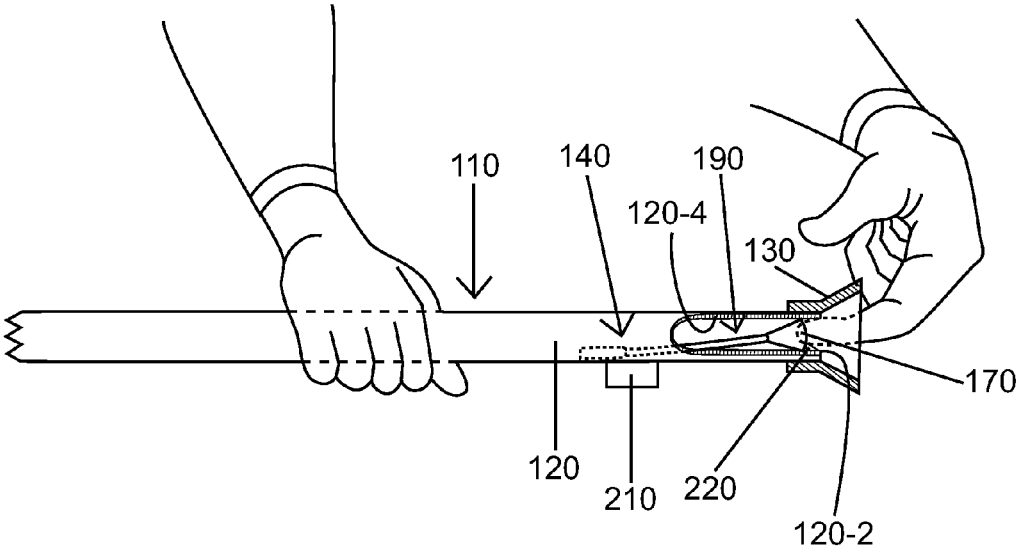

FIG. 36 and FIG. 37 depict stages in a possible method of loading sabot projectile assembly 190 into barrel bore 120-4 of blowgun 110.

Figure 38:
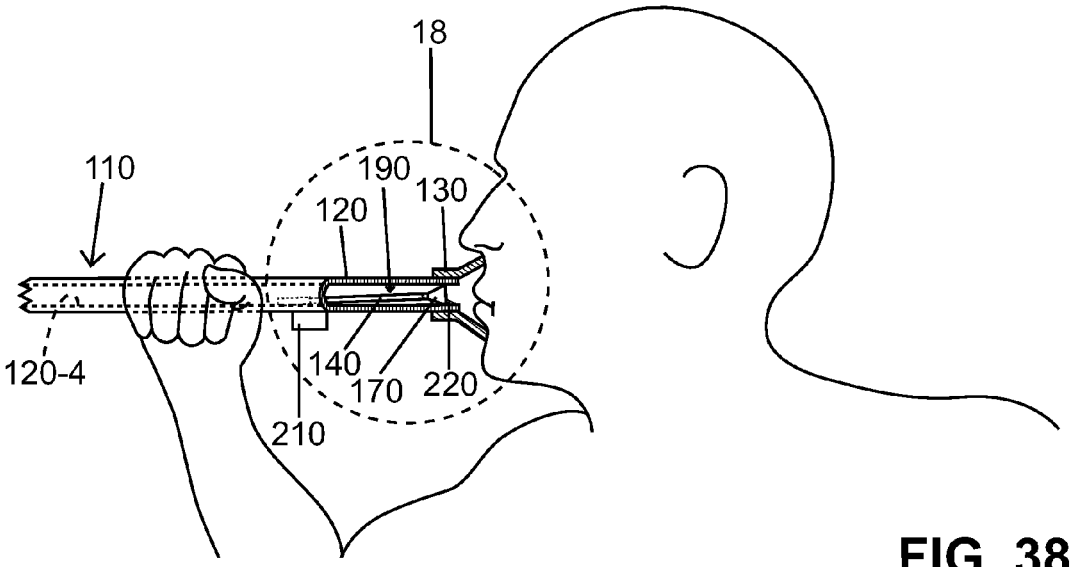
Figure 39:
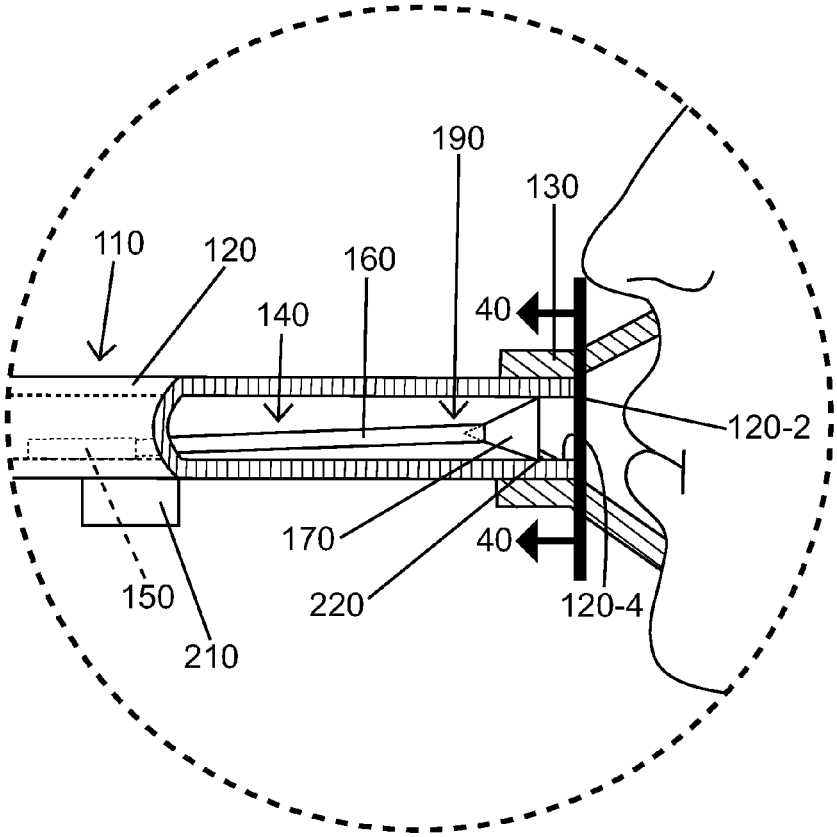

FIGS. 38 and 39 depicted side views of sabot projectile assembly 190 confined in fully loaded position by the mutual opposition or mutual confinement imposed by projectile detent means 210 and sabot detent means 220.

Figure 40:
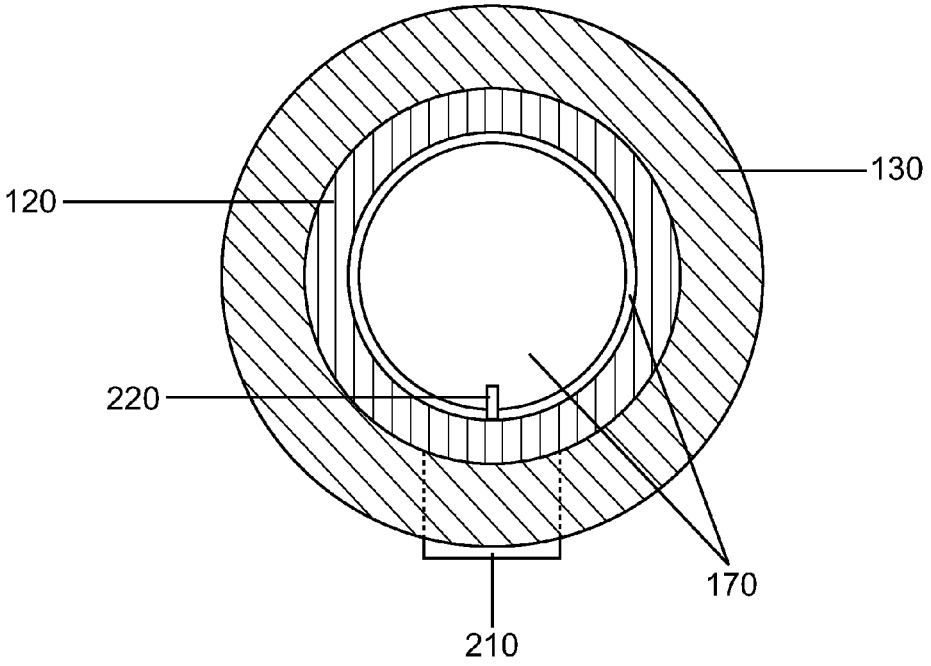

FIG. 40 is a sectional view along section line 40-40 from FIG. 39, showing sabot 170 rearwardly engaged by sabot detent means 220.

Figure 41:
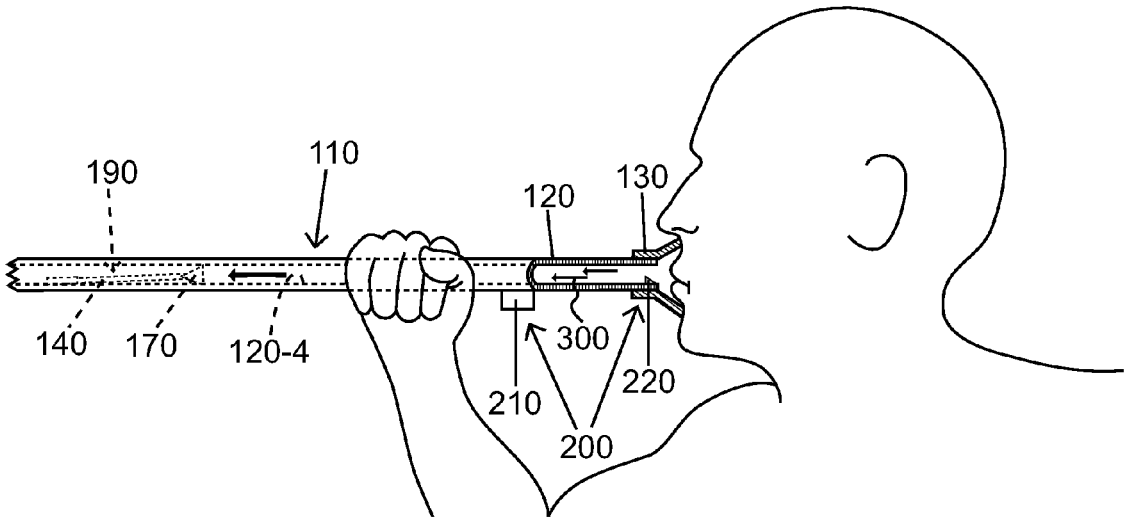

FIG. 41 shows sabot projectile assembly 190 partially displaced along bore 120-4, traveling under launch acceleration through bore 120-4

Figure 42:
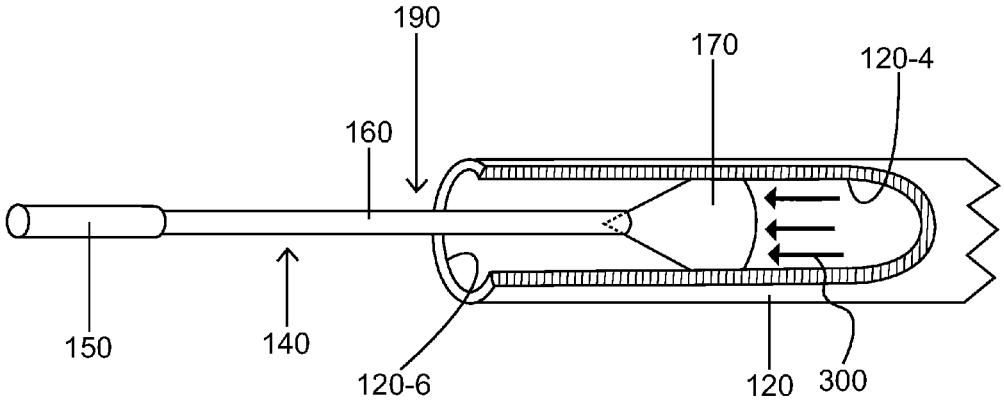

FIG. 42 depicts a perspective view of a distal portion of barrel 120, with the portion at and near muzzle 120-6 partially cut away to show sabot projectile assembly 190 partially exited through and out muzzle 120-6.

Figure 43:
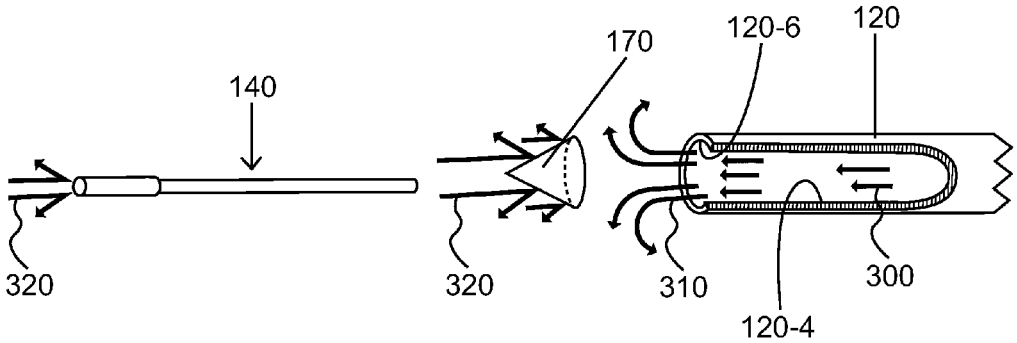

FIG. 43 is a perspective view depicting discarding separation of sabot 170 from subcaliber projectile 140 after sabot 170 has completed exiting through and out muzzle 120-6

Figure 44:
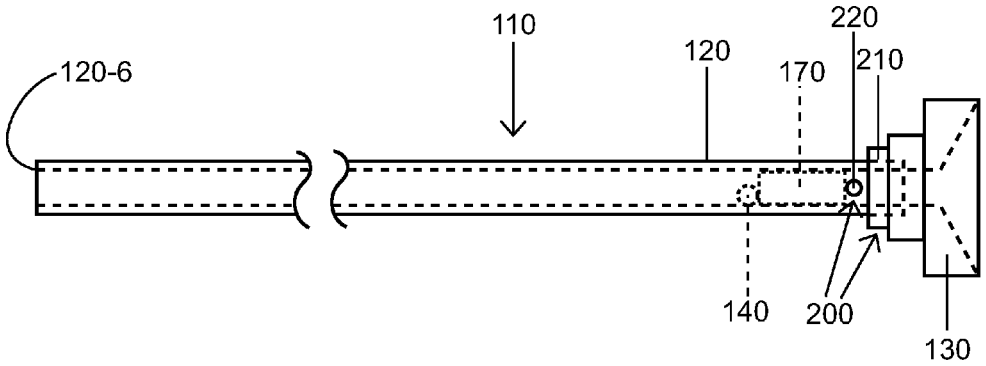
Figure 45:
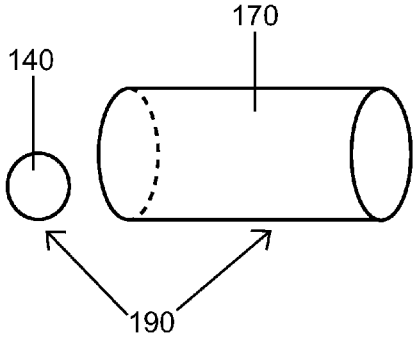
Figure 46:
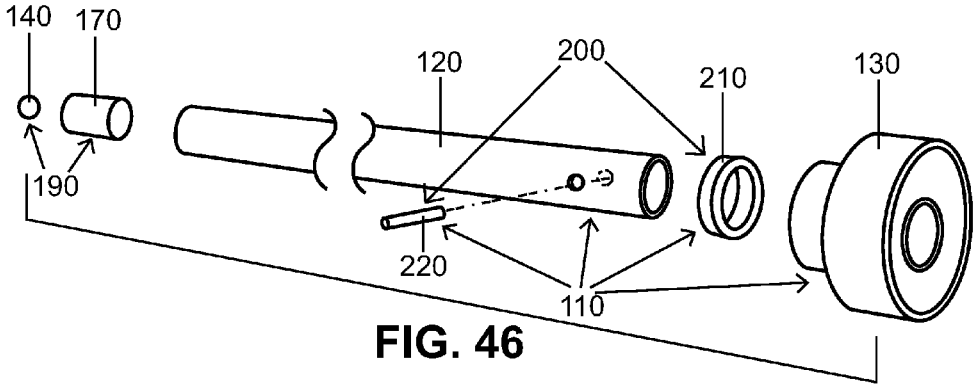

FIGS. 44-46 depict another embodiment of the inventive blowgun chosen for detailed description.

FIG. 44 is a side elevation view of blowgun 110 with subcaliber projectile 140 and sabot means 170 in loaded position within blowgun 110.

FIG. 45 is a perspective view of subcaliber projectile 140 and sabot means 170.

FIG. 46 shows an exploded perspective view of blowgun 110, with projectile 140 and sabot 170.

FIGS. 47-51 depict an embodiment of the inventive blowgun which comprises blowgun 110 and optional full caliber projectile 600.

Figure 47:
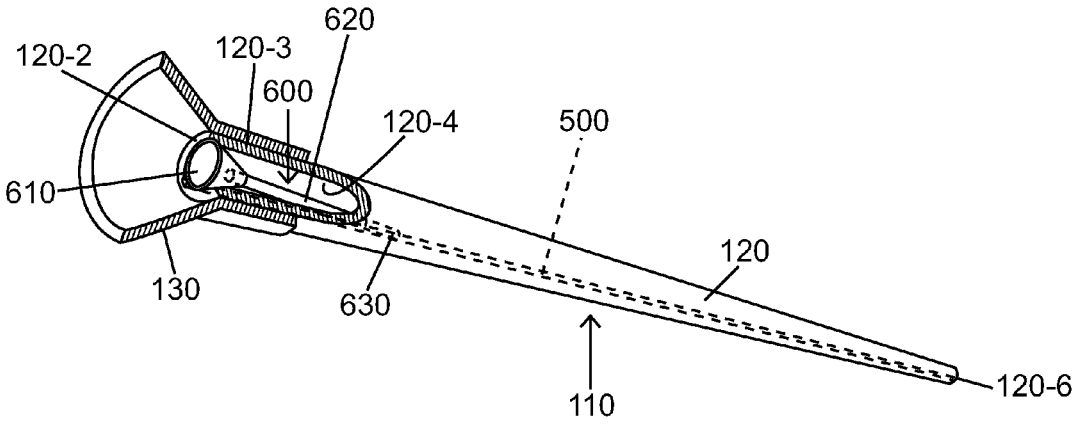

FIG. 47 is a perspective view of blowgun 110, partially cut away at and near breech 120-2 and mouthpiece 130 to show optional projectile 600 in loaded position within bore 120-4 near breech 120-2 and inner surface of bore 120-4 provided with guidance means 500.

Figure 48:
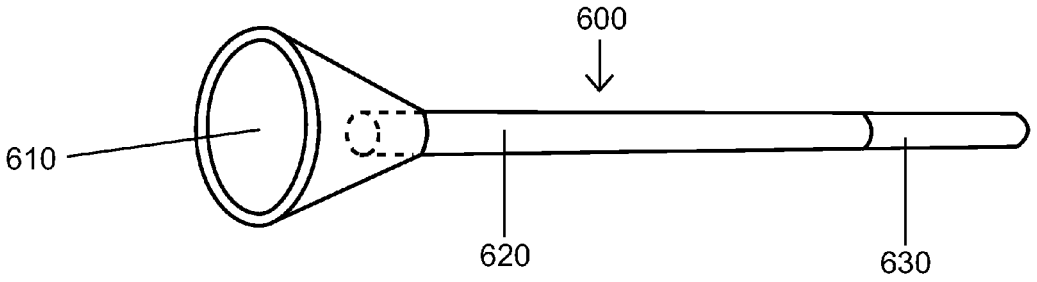
Figure 49:
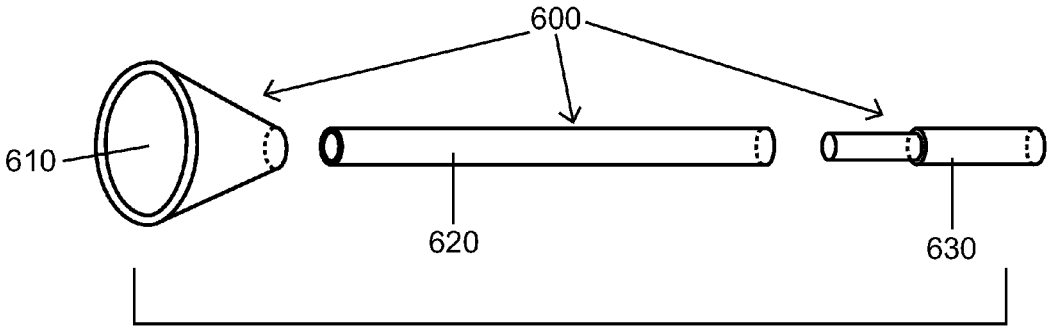

FIGS. 48 and 49 are, respectively, assembled and exploded perspective views of optional full caliber projectile 600.

Figure 50:
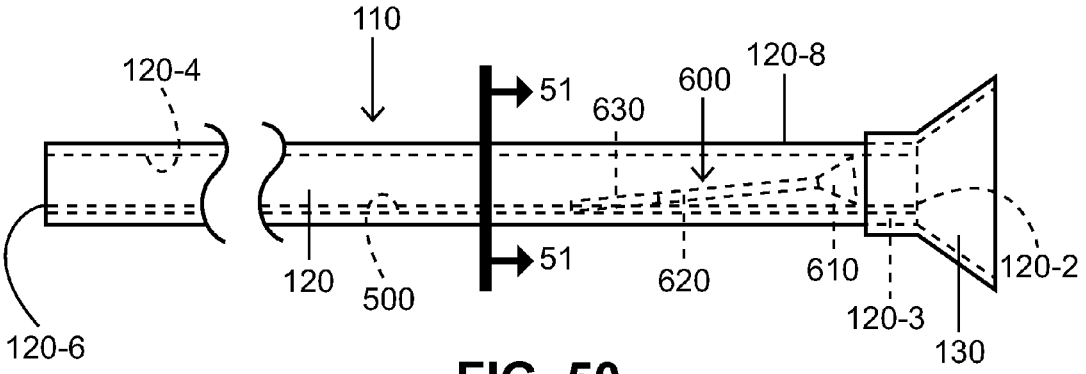

FIG. 50 is a side elevational view of blowgun 110 with optional projectile 600 loaded inside bore 120-4 near breech 120-2, with the cooperating portion of projectile 600 resting in and engaged with groove 500.

Figure 51:
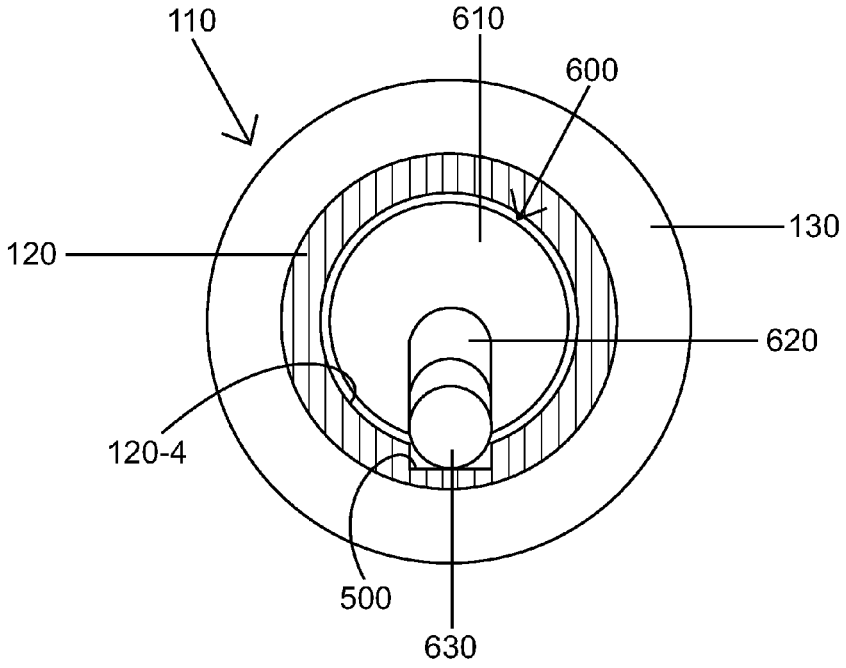

FIG. 51 is a sectional view along section line 51-51 from FIG. 50, somewhat enlarged to show in greater detail and clarity the cooperating portion of projectile 600 resting in and engaged with groove 500, and the cross-sectional shape of groove 500.

DRAWINGS

Reference Numerals

110 blowgun
120 elongate barrel of blowgun
120-2 breech opening of bore of blowgun barrel
120-3 breech end of blowgun
120-4 bore of blowgun barrel
120-6 muzzle opening of bore of blowgun barrel
120-8 outer surface of blowgun barrel
130 optional mouthpiece of blowgun
140 subcaliber projectile means
150 foreshaft of subcaliber projectile
150-2 forward (in use) portion of subcaliber projectile
150-3 shoulder defined by transition between forward portion and rearward portion of subcaliber projectile
150-4 rearward (in use) portion of subcaliber projectile
160 shaft of subcaliber projectile
160-2 forward (in use) opening of shaft of projectile
160-3 forward (in use) end of shaft of projectile
160-4 rearward (in use) opening of shaft of projectile
160-5 rearward (in use) end of shaft of projectile
170 sabot means
170-2 base of sabot
170-4 tip or end opposite base of sabot
170-6 forward facing (in use) surface of sabot
170-8 rearward facing (in use) surface of sabot
190 sabot projectile assembly including sabot and subcaliber projectile
200 detent means
210 projectile detent
220 sabot detent
300 (arrows) breath of user
310 (curved arrows) dispersing thrust
320 (sharply bent arrows) atmospheric drag
500 guidance means in or on surface of bore
600 optional full caliber projectile
610 full caliber piston means of full caliber projectile
620 shaft of full caliber projectile
630 foreshaft of full caliber projectile

DETAILED DESCRIPTIONS

FIGS. 1-51—Certain Embodiments and Methods of Operation

Proportions and relative proportions, in the following figures depicting various embodiments of my blowgun, are exemplary and are not restrictive of the invention; however, in embodiments depicted and in certain other embodiments as well, sabot means 170 is preferably, at its transversely widest portion, substantially full caliber in relation to barrel bore 120-4. Also, certain embodiments of projectile 140 may be either wider or more slender relative the diameter of barrel bore 120-4 than the illustrated examples appear to be.

Figure 1:
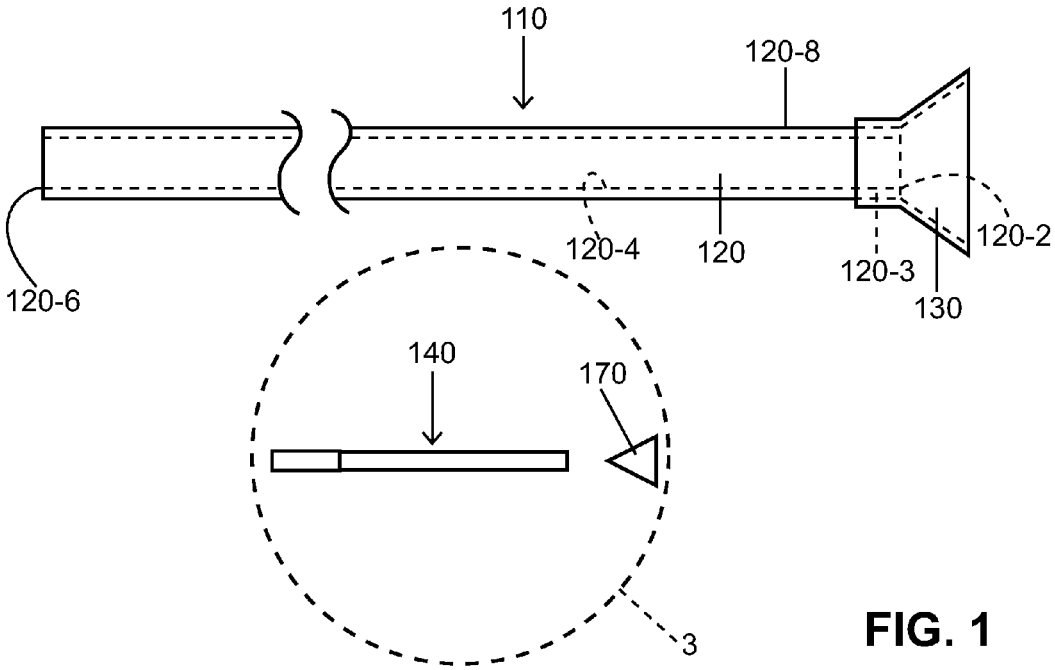
Figure 2:
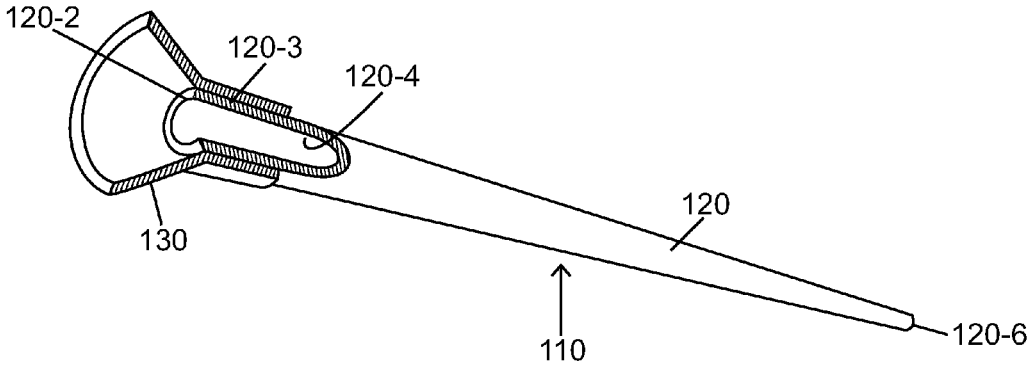
FIG. 2 depicts a perspective view of blowgun 110.

FIG. 1 depicts a side view of my invention in an embodiment which comprises blowgun 110 with associated subcaliber projectile 140 and associated sabot means 170. FIG. 2 depicts a perspective view of blowgun 110. Blowgun 110 includes elongate barrel 120 and, optionally, mouthpiece 130. Optional mouthpiece 130 is shown affixed to breech end 120-3 of barrel 120. Barrel 120 is provided with breech opening 120-2, muzzle opening 120-6, and substantially straight, elongate bore 120-4 which communicates between breech opening 120-2 and muzzle opening 120-6. For convenience of illustration, FIG. 1 shows unobstructed side views of subcaliber projectile 140 and sabot means 170 prior to loading insertion and engagement within bore 120-4 of barrel 120; it should be noted, therefore, that in FIG. 1 the positioning and orientation of subcaliber projectile 140 and sabot means 170 relative each other and relative blowgun 110 is simply for convenience of illustration and illustrates only one of many possible dispositions of subcaliber projectile 140 and sabot means 170 prior to loading insertion and engagement within barrel bore 120-4. FIG. 2 depicts optional mouthpiece 130 as frictionally engaged with breech end 120-3 of barrel 120. FIG. 2 also shows an embodiment of optional mouthpiece 130 which is so adapted as to engage the face of the user against the lips, or against the area immediately around the lips, or against both, advantageously sized and shaped with clearance to avoid any such contact with nose or chin as would disrupt the positioning of optional mouthpiece 130 against face of user to achieve a good airseal, according to the manner of use depicted in FIGS. 17, 18, and 19.

Not illustrated: Alternatively, blowgun 110 may be operated without optional mouthpiece 130, with no substantial loss in function, by the user placing breech end 120-3 of barrel 120 directly against the face in a manner similar to that described above of engaging mouthpiece 130 against face, or alternatively, may insert breech end 120-3 directly between lips and perhaps slightly inside mouth, and press lips firmly around and against outer surface 120-8 of barrel 120 to achieve a good airseal. In a like manner, optional mouthpiece 130 may alternatively be so shaped and otherwise adapted as to engage the face of the user by being inserted between the user's lips and perhaps slightly inside the user's mouth, with the user's lips pressed firmly around and against outer surface of mouthpiece to achieve a good airseal. In such embodiments that allow insertion of mouthpiece 130 or breech end 120-3 between the lips and perhaps into the mouth, it is advantageous as a safety precaution to provide barrel 120 or mouthpiece 130 with an enlarged portion of sufficient width and suitable positioning to prevent over-insertion of mouthpiece 130 or barrel 120 into the mouth or throat of the user.

Additional notes about optional mouthpiece 130: Optional mouthpiece 130, when used, may be so adapted or may be so provided with means as to enable mouthpiece 130 to be affixed or connected, either permanently or removeably, to breech end 120-3 of barrel 120. Suitable means of securing mouthpiece 130 to barrel 120 will be apparent to one skilled in the art, and may include, for example, frictional engagement, or cooperating threaded sections that allow mouthpiece 130 and barrel 120 to be screwed together. Such connecting means may involve direct contact between mouthpiece 130 and barrel 120, or alternatively may involve contact through one or more intermediary members, such as, for example, a gasket or bushing, or a barrel extension member, or possibly a hardened matrix or filler layer such as molded plastic, cast metal, or glue or epoxy. Optional mouthpiece 130, or any intervening intermediary member, may be essentially affixed to inner surface of bore 120-4, or to outer surface 120-8 of barrel 120, or to both. Means such as glue, epoxy, set screws, clamps, magnets with cooperating magnetically attractive members, or detents, such as spring ball detents with cooperating indentations, may be used to appropriately strengthen or make permanent various methods or configurations for affixing barrel 120 and mouthpiece 130 together, such configurations even including end-to-end abutting of barrel 120 and mouthpiece 130. Alternatively, methods of material working such as, for example, molding, casting, machining, and spinning may be used to form barrel 120 and mouthpiece 130 as one unitary monolithic body rather than as two structurally or materially distinct elements.

Figure 3:
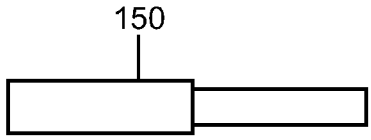
FIG. 3 is a side view of foreshaft 150 by itself.
Figure 4:
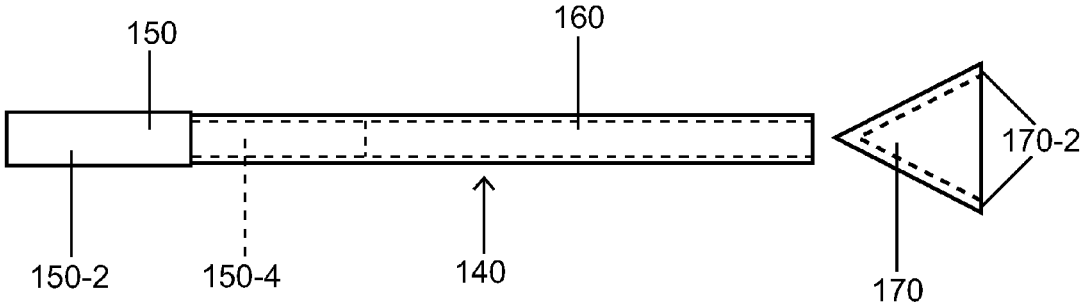
FIG. 4 is a portion of the side view depicted in FIG. 1, enlarged to show with greater clarity and detail a side view of subcaliber projectile 140 and sabot means 170.

FIG. 4 is a portion of the side view depicted in FIG. 1, enlarged to show with greater clarity and detail a side view of subcaliber projectile 140 and sabot means 170. Subcaliber projectile 140 in this embodiment includes substantially straight, elongate, lightweight tubular shaft 160, affixed rearwardly to and advantageously coaxially aligned with relatively short, substantially straight, cylindrical foreshaft 150. FIG. 3 is a side view of foreshaft 150 by itself. Foreshaft 150 in this embodiment is advantageously provided with wider forward portion 150-2 and narrower rear portion 150-4. Sabot means 170 in this embodiment includes advantageously thin-walled, advantageously lightweight conical shell 170, sized and shaped at base 170-2 to be substantially slidingly sealable with bore 120-4.

Note: It may be understood that in the embodiment depicted in FIGS. 1-21, as well as in the embodiment depicted in FIGS. 22-43, foreshaft forward portion 150-2 is in fact somewhat wider than the outer diameter of shaft 160, but that certain illustrations within FIGS. 1-43 may show the two components as apparently the same diameter, or with somewhat different proportions or relative proportions, merely for convenience of illustration. It will be apparent to one skilled in the art that various embodiments of projectile 140 are possible in which the widest portion of foreshaft 150 is of diameter greater than, equal to, or less than the outer diameter of shaft 160.

Note: Subcaliber projectile 140 as depicted in FIG. 4 may be considered as an exemplary embodiment of what may be considered a family of streamlined elongate subcaliber projectiles provided by my invention and which are particularly well suited for use with the blowgun provided by my invention.

Figure 5:
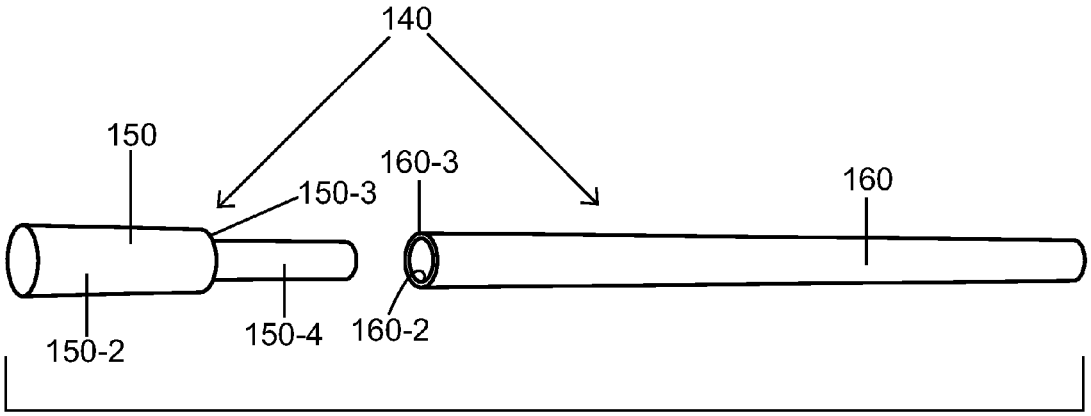
FIGS. 5 and 6 are, respectively, exploded and assembled perspective views of subcaliber projectile 140.
Figure 6:
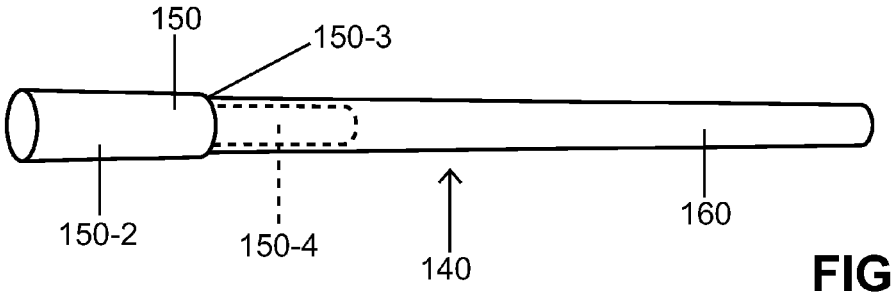

FIG. 4 continued: Sabot Cone 170 has base 170-2 sized and shaped to substantially match the caliber and cross-sectional shape (in this embodiment, a circular disk shape) of barrel bore 120-4, firstly in order that sabot 170 may form an adequate gas seal with bore 120-4 to prevent any significant leakage of pressurized air or breath past base 170-2 during launch acceleration, and secondly in order that sabot base 170-2 may frictionally engage the inner surface of bore 120-4 with sufficient snugness to resist or prevent axial displacement of sabot 170 towards or out breech 120-2 when sabot 170 is loaded within bore 120-4 of barrel 120 prior to launch acceleration, as set forth in the particular manner of operation described below and depicted in FIGS. 14-21. Thus cone 170 at its base 170-2 is substantially slidingly sealable with barrel bore 120-4, yet preferably without excessive friction or snugness of fit, in order that breath (arrows 300, see FIGS. 19-21) of the user may provide sufficient thrust to easily overcome the frictional engagement between sabot means 170 and bore 120-4 to produce efficient launch acceleration FIGS. 5 and 6 are, respectively, exploded and assembled perspective views of subcaliber projectile 140. In this embodiment, subcaliber projectile 140 includes foreshaft 150 and elongate shaft 160. Foreshaft 150 is advantageously materially composed or structured or both in such a manner as to have a high density or high linear density relative to the density or linear density of shaft 160. Foreshaft 150 and shaft 160 are further advantageously relatively proportioned and adapted in such a manner that subcaliber projectile 140 has a forward-of-center balance. In particular, the length of foreshaft 150 may preferably be somewhat short relative the length of shaft 160 in order to help produce an overall forward-of-center balance of subcaliber projectile 140, while taking into account any longitudinal overlap of portions of foreshaft 150 and shaft 160. Shaft 160 is advantageously lightweight in order to promote the aforementioned forward-of-center balance and also in order that shaft 160 may thereby serve as an aerodynamic stabilizer for subcaliber projectile 140. It will be apparent to one skilled in the art that in embodiments in which there is little substantial overlap of shaft 160 and foreshaft 150, and in certain other embodiments as well, foreshaft 150 need not be somewhat shorter than shaft 160, and could even be somewhat longer than shaft 160, while still achieving a forward-of-center balance or other balance determined appropriate, as is within the ability of those skilled in the art, in order that subcaliber projectile 140 may have a stable balance and in order that, if so intended, shaft 160 may serve as an aerodynamic stabilizer for subcaliber projectile 140.

Shaft 160, or foreshaft 150, or both, may alternatively be provided with additional aerodynamic stabilizing means, as will be described in more detail in the later section on alternate embodiments.

Continuing, FIG. 5 depicts an unobstructed perspective view of foreshaft 150. Foreshaft 150 in this embodiment is provided with wider forward portion 150-2 and narrower rear portion 150-4. Rear portion 150-4 is advantageously proportioned and sized in such a manner as to frictionally engage the inner surface of tubular shaft 160 when inserted into forward opening 160-2 of shaft 160 in the manner depicted in FIG. 6. The diameter of forward section 150-2 is advantageously somewhat greater than the inner diameter of tubular shaft 160, and furthermore, the transition between forward section 150-2 and rear section 150-4 is advantageously relatively abrupt, in order to provide a preferably essentially perpendicular shoulder 150-3 against which forward end 160-3 of shaft 160 may be securely abuttingly seated. An additional depiction of the manner of engagement between foreshaft 150 and shaft 160 is depicted in sectional view in FIG. 11. Furthermore, in order to promote aerodynamic stability of subcaliber projectile 140, the diameter of some portion of forward portion 150-2 is also advantageously wider than the outer diameter of forward end 160-3 of tubular shaft 160, in order to avoid any such reduction in the sectional density of the forward portion of subcaliber projectile 140 as might tend to destabilize projectile 140.

Not illustrated: In some embodiments, in the event that outer diameter of rearward portion 150-4 of foreshaft 150 were to happen to be substantially narrower than the inner diameter of shaft 160, foreshaft 150 may be provided with intermediary means to maintain a secure connection between foreshaft 150 and shaft 160. Such intermediary means might, for example, include one or more essentially sleeve-like insertion bushings or gaskets which slide onto and frictionally engage rearward section 150-4, and then which are inserted into and frictionally engaged with the interior surface of forward end 160-3 of shaft 160, thereby serving as one or more connecting intermediary members providing intermediary surface contact to maintain secure connection between foreshaft 150 and shaft 160. A cushioning gasket or bushing may also be provided by either providing a widened forward portion of the foremost insertion gasket or bushing, or alternatively by positioning an additional, separate, wider gasket or bushing between the foreshaft shoulder 150-3 and the forward end of the insertion gasket or bushing. Such a cushioning intermediary body may help to reduce the potential for any damage to forward end 160-3 of shaft 160 when subcaliber projectile 140 impacts a target. Alternatively, if rearward foreshaft section 150-4 is substantially narrower than the inner diameter of shaft 160, a filler matrix such as epoxy may be used in place of or in conjunction with insertion bushings or shoulder bushings to fill any gaps in order to securely affix foreshaft 150 and shaft 160 together and possibly to provide cushioning against impact shock. It is preferable that the widest portion of any gasket or matrix left exposed, or in other words not covered or enclosed by some portion of shaft 160 or foreshaft 150, which would likely be the cushioning portion, should be of outer diameter not greater than the outer diameter of the widest portion of the forward portion 150-2 of foreshaft 150, in order to promote in-flight aerodynamic stability.

FIGS. 7-13: Point, or tip, 170-4 of sabot means 170 may be inserted into rearward opening 160-4 of shaft 160 of subcaliber projectile 140, so that some portion of forward surface 170-6 of sabot 170 may thereby essentially rearwardly abuttingly engage subcaliber projectile 140. In this manner, subcaliber projectile 140 and sabot means 170 may cooperatively engage each other to form a functional unit which shall be known as sabot projectile assembly 190 or sabot projectile 190, during any or all of certain stages of the handling, loading, and launching sequence; such stages possibly including, for example, while being inserted into barrel bore 120-4 to assume loaded position, while being maintained in loaded position within bore 120-4 prior to launch acceleration, and while traveling along bore 120-4 during launch acceleration.

Figure 7:
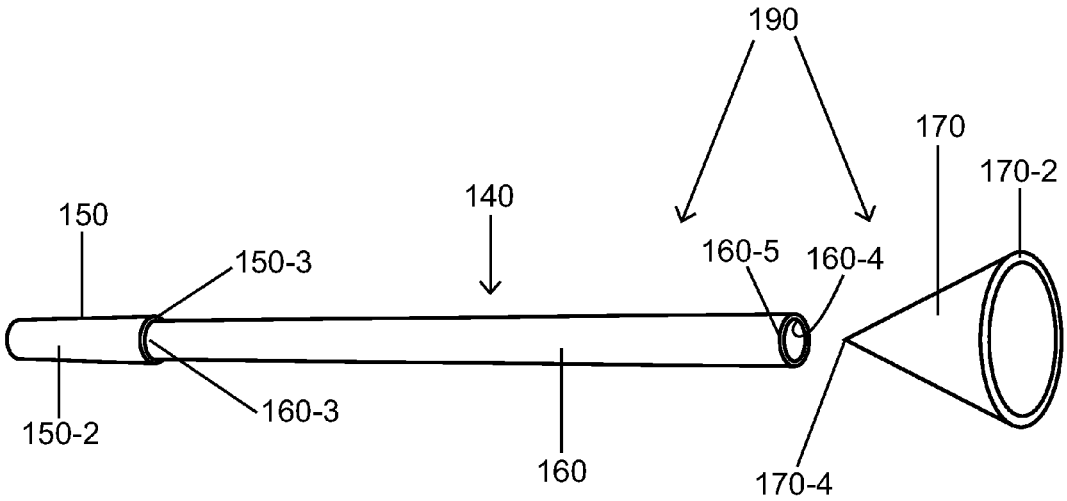
FIG. 7 and FIG. 8 depict, respectively, exploded and assembled perspective views of sabot projectile assembly 190.
Figure 8:
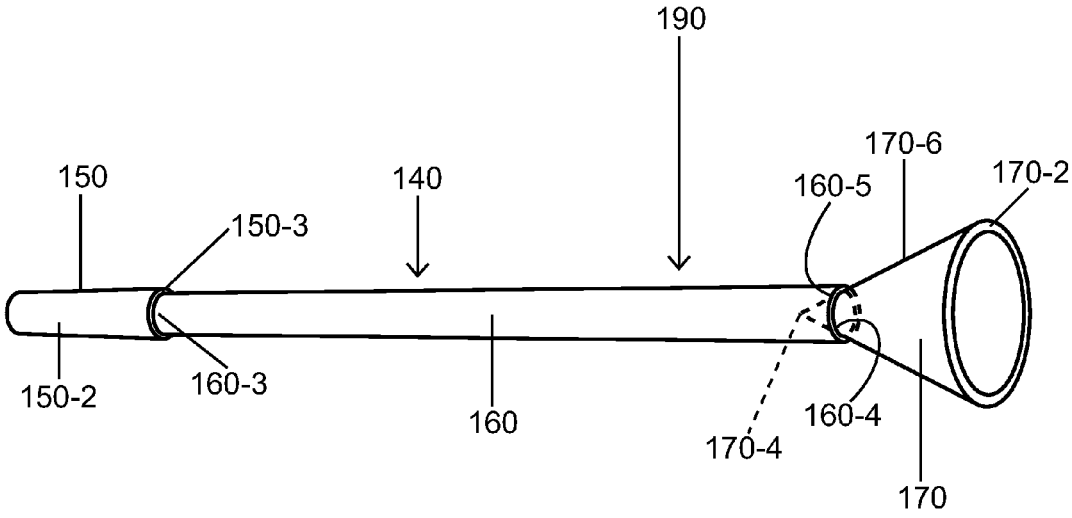
Figure 9:
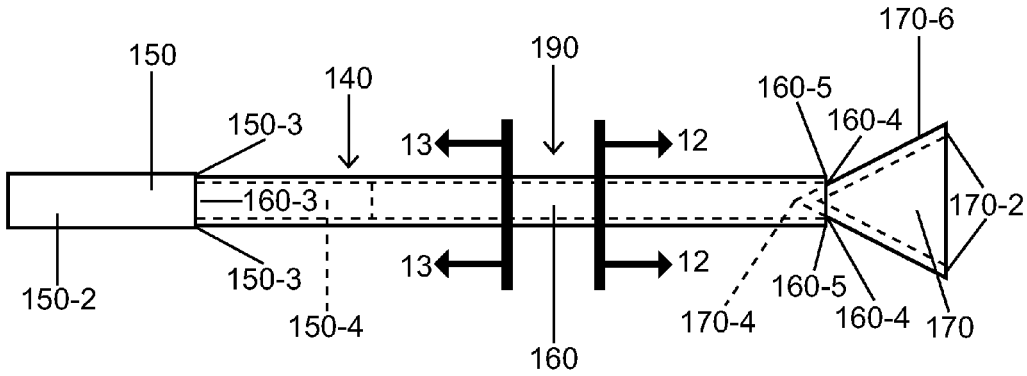
FIG. 9 and FIG. 10 depict, respectively, side elevational and front elevational views of sabot projectile assembly 190.
Figure 10:
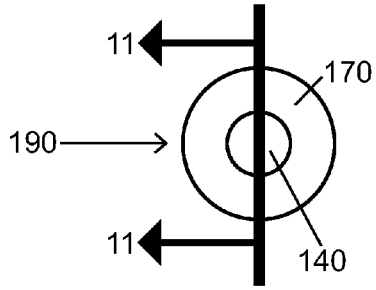

FIG. 7 and FIG. 8 depict, respectively, exploded and assembled perspective views of sabot projectile assembly 190. FIG. 9 and FIG. 10 depict, respectively, side elevational and front elevational views of sabot projectile assembly 190. The abutting engagement of subcaliber projectile 140 rearwardly by sabot cone 170 provides a secure connection whereby sabot 170 may transmit positive thrust to subcaliber projectile 140 during launch acceleration; at the same time, however, the essentially abutting engagement of subcaliber projectile 140 rearwardly by sabot cone 170 preferably does not provide any substantial positive connection to prevent axial displacement of subcaliber projectile 140 forwardly relative sabot means 170, nor to prevent axial displacement of sabot cone 170 rearwardly relative subcaliber projectile 140. The additional loosely penetrative or nesting relationship in the engagement of sabot tip 170-4 inserted into subcaliber projectile shaft rear opening 160-4, prevents or resists premature lateral displacement of sabot tip 170-4 relative shaft rear opening 160-4, and thereby further ensures that subcaliber projectile 140 remains securely engaged rearwardly by sabot cone 170, while in loaded position within bore 120-4 up until the commencement of launch acceleration, as well as during launch acceleration and travel through and out bore 120-4. It should be noted that although FIGS. 7-13 appear to depict sabot 170 and subcaliber projectile 140 as being substantially coaxially aligned when engaged together to form sabot projectile assembly 190, in actual operation entirely satisfactory results may be achieved even when sabot 170 is axially aligned at somewhat of an angle to subcaliber projectile 140, and when either sabot 170 or subcaliber projectile 140 or both are axially aligned at somewhat of an angle to barrel bore 120-4.

Figure 11:
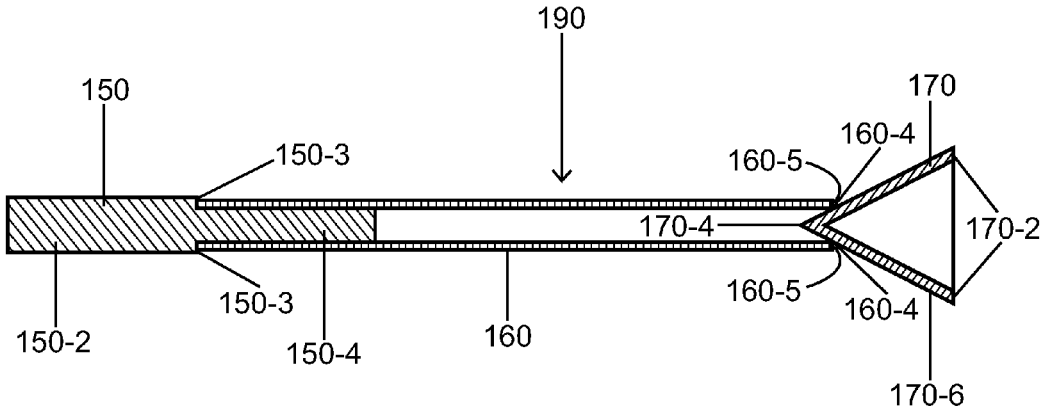
FIG. 11 depicts a sectional side view, along section line 11-11 from FIG. 10, of sabot projectile assembly 190

FIG. 11 depicts a sectional side view, along section line 11-11 from FIG. 10, of sabot projectile assembly 190 in which shaft 160 is an elongate, essentially straight, hollow tubular member, preferably very lightweight. Foreshaft 150 advantageously includes wider forward section 150-2 and narrower rear section 150-4. Rear section 150-4 is preferably proportioned in such a manner as to frictionally engage the inner surface of shaft 160 when inserted into forward opening 160-2. Transition between forward section 150-2 and rear section 150-4 advantageously is relatively abrupt, in order to provide essentially perpendicular shoulder 150-3 against which forward end 160-2 of shaft 160 may be securely abuttingly seated.

Thus, some portion of forward portion 150-2 may advantageously be somewhat wider in diameter than rear section 150-4, so as to provide shoulder 150-3 against which forward end 160-3 of shaft 160 may be securely abuttingly seated. Having some portion of forward portion 150-2 be wider than shaft 160 not only may provide additional benefits in terms of aerodynamic stability, as mentioned earlier, but may also provide benefits in terms of target penetration performance with certain types of targets, since when penetrating such a target forward end 150-2 clears or opens a penetration channel through which advantageously narrower shaft 160 may pass with little or no surface contact.

Figure 12:
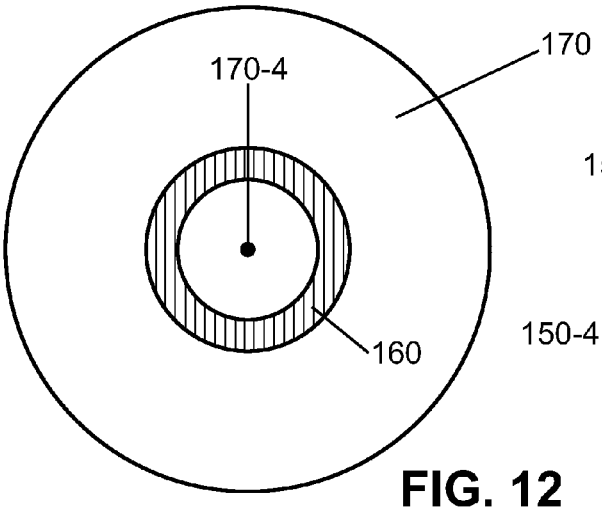
FIG. 12 depicts a sectional view, on a somewhat enlarged scale for clarity, of sabot projectile assembly 90 along section line 12-12 from FIG. 9.

FIG. 12 depicts a sectional view, on a somewhat enlarged scale for clarity, of sabot projectile assembly 90 along section line 12-12 from FIG. 9.

FIG. 12 shows foreshaft rear portion 150-4 inserted within, and thereby frictionally engaged with, shaft 160, and outer diameter of shaft 160 narrower than diameter of foreshaft shoulder 150-3.

Figure 13:
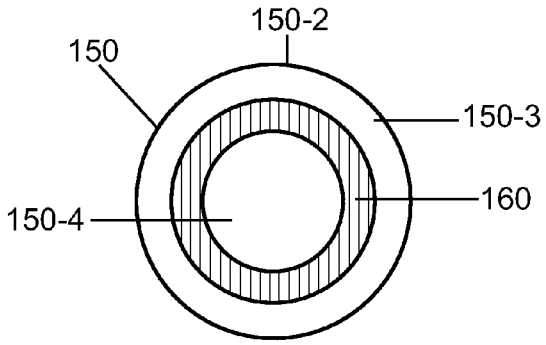
FIG. 13 depicts a sectional view, on a somewhat enlarged scale for clarity, of sabot projectile assembly 190 along section line 13-13 from FIG. 9.

FIG. 13 depicts a sectional view, on a somewhat enlarged scale for clarity, of sabot projectile assembly 190 along section line 13-13 from FIG. 9.

FIG. 13 shows tip 170-2 of sabot cone 170 rearwardly inserted within shaft 160 in order that sabot 170 may thereby abbutingly and loosely penetratively engage shaft 160.

FIG. 14 depicts a perspective view of a possible method by which the user may manually hold subcaliber projectile 140 and sabot 170 engaged together as sabot projectile assembly 190, for manual handling of sabot projectile assembly 190 preparatory to, and during, loading insertion of sabot projectile assembly 190 into barrel breech 120-2 and therethrough into barrel bore 120-4. It will be apparent to one skilled in the art that there are other possible methods of manually holding sabot projectile assembly 190 during loading and other handling. In the method depicted in FIG. 14, the user configures the fingers and thumb of one hand in approximately the position of preparing to snap the fingers. Subcaliber projectile 140 may, in this position of the hand, be gripped between thumb and middle finger, and sabot 170, with tip 170-2 inserted within rearward shaft opening 160-4, may be engaged rearwardly by the index finger inserted rearwardly within the conical shell of sabot 170 to push against rear surface 170-8 of sabot 170. In this manner, the mutual opposition or constraint, of index finger against thumb and middle finger, is transmitted by sabot 170 and subcaliber projectile 140 to each other, so that subcaliber projectile 140 and sabot 170 remain thereby securely engaged as sabot projectile assembly 190.

FIGS. 15 and 16 depict stages in a possible method of loading sabot projectile assembly 190 into barrel bore 120-4 of blowgun 110. FIG. 15 depicts the user holding blowgun 110 with barrel 120 uptilted so that muzzle 120-6 is higher than breech 120-2, and using the essential technique, depicted above in FIG. 14, to hold subcaliber projectile 140 and sabot 170 together, engaged as the functional unit known as sabot projectile assembly 190. FIG. 15 further depicts sabot projectile assembly 190 as being partially inserted into breech 120-2 and therethrough into and within bore 120-4, with the front end of subcaliber projectile 140 resting upon the inner surface of bore 120-4 and the rearward portion of sabot projectile assembly 190 held and supported by user's hand.

FIG. 16 depicts the user holding blowgun 110 in essentially the same manner illustrated in FIG. 15, with sabot projectile assembly 190 fully inserted into and within bore 120-4. In moving sabot projectile assembly 190 from the first (partially loaded) position shown in FIG. 15, to the second (fully loaded) position shown in FIG. 16, as sabot projectile assembly 190 is pushed progressively further into and through breech 120-2 by the pressure of the user's index finger upon sabot 170, the user may gradually release the grip of thumb and middle finger upon subcaliber projectile 140, allowing subcaliber projectile 140 to be supported in place with front end of foreshaft 150 slidingly supported upon the inner surface of bore 120-4, and with rear end 160-5 of shaft 160 supported upon sabot 170, with sabot 170 in turn supported on the index finger. Accordingly, after releasing the grip of thumb and middle finger upon sabot projectile assembly 190, the user may withdraw thumb and middle finger out of the way to allow easier completion of loading insertion of sabot projectile assembly 190.

FIG. 17 depicts a partial perspective view of blowgun 110, with the distal portion of barrel 120 cropped from view and with the portion at and near breech 120-2 and mouthpiece 130 partially cut away to show sabot projectile assembly 190 loaded within bore 120-4, with mouthpiece 130 lifted to engage the mouth and lips of the user. FIG. 18 depicts a portion of FIG. 17 enlarged for greater clarity of detail.

FIGS. 17 and 18 depict sabot projectile assembly 190 in loaded position within bore 120-4 after completion of loading insertion into and through breech 120-2 and before initiation of launch acceleration. Note that barrel 120, and particularly barrel bore 120-4, is uptilted with muzzle 120-6 higher than breech 120-2 so that the urging of gravity maintains subcaliber projectile 140 in seated position against or upon sabot 170. Sabot 170 is frictionally engaged by the inner surface of bore 120-4 and is thereby supported against urging of gravity, preferably firmly enough to thereby secure sabot projectile assembly 190 against any excessive axial displacement towards or out breech 120-2 due to urging of gravity. In other words, sabot 170 is frictionally engaged by bore 120-4 with sufficient firmness that sabot 170 may support the weight of sabot projectile assembly 190 when sabot projectile assembly 190 is loaded within bore 120-4 of barrel 120, uptilted with muzzle 120-6 higher than breech 120-2.

Note: with the foregoing in mind regarding the embodiment of my invention depicted in FIGS. 1-21, it will be clear that during loading, and until launch is complete, barrel bore 120-4 should be maintained at or above the minimum angle of elevation sufficient to prevent premature separation of sabot means 170 and subcaliber projectile 140 due to the weight of subcaliber projectile 140 pulling subcaliber projectile 140 away from secure engagement with sabot means 170. Thus, taking care to preserve a sufficient angle of elevation, the user may place breech end 120-3 or mouthpiece 130, as appropriate, to engage his lips and mouth and blow therein to thereby initiate and produce launch acceleration of sabot projectile assembly 190.

FIG. 19 shows sabot projectile assembly 190 partially displaced along bore 120-4, traveling under launch acceleration through bore 120-4 towards muzzle 120-6 (muzzle 120-6 is not shown in FIG. 19 due to image cropping of the distal portion of barrel 120), propelled by thrust of breath (arrows 300) of user.

FIG. 20 depicts a perspective view of the distal portion of barrel 120, with the portion at and near muzzle 120-6 partially cut away to show sabot projectile assembly 190 partially exited through and out muzzle 120-6. At this stage of launch, sabot projectile assembly 190 is still maintained as a functional unit by sabot 170 being positively accelerated by thrust of breath (arrows 300) against the inertial mass of subcaliber projectile 140. In this manner sabot projectile assembly 190, in this embodiment of my invention, is maintained as a functional unit until sabot 170 completely exits through and out muzzle 120-6, with accompanying dispersal of thrust.

Not illustrated: In certain alternate embodiments or methods of use of my invention, subcaliber projectile 140 and sabot 170 may begin separation before sabot 170 reaches or exits muzzle 120-6. An example of such an alternate embodiment is one in which barrel 120 is ported, or in other words provided with air passage holes through wall of barrel 120 and communicating between bore 120-4 and the exterior of barrel 120, to allow substantial dissipation of breath pressure and thrust prior to sabot 170 reaching or exiting muzzle 120-6. Such port holes would preferably be placed in the distal portion of barrel 120 fairly near muzzle 120-6. An example of such an alternate method of use is when the user uses a less forceful exhalation to launch sabot projectile assembly 190, in such a manner that positive acceleration ceases before sabot 170 exits muzzle 120-6.

FIG. 21 is a perspective view depicting discarding separation of sabot 170 from subcaliber projectile 140 after sabot 170 has completed exiting through and out muzzle 120-6. After sabot 170 completes exiting through and out barrel muzzle 120-6, and thereby breaks the substantial sliding airseal between sabot base 170-2 and the inner surface of barrel bore 120-4, propulsive thrust (straight arrows 300) rapidly dissipates (curved arrows 310) and sabot 170 is no longer positively urged against the inertial mass of subcaliber projectile 140. Atmospheric drag (sharply bent arrows 320) acting upon sabot 170, which preferably has a very low sectional density compared to the sectional density of subcaliber projectile 140, causes sabot 170 to decelerate much more rapidly than subcaliber projectile 140, thus effecting separation and discarding of sabot 170 as subcaliber projectile 140 continues alone and unhindered along its external trajectory or path.

FIGS. 1-21 depict a preferred embodiment of my invention which comprises a subcaliber projectile, sabot means, and blowgun, and in which the subcaliber projectile includes a foreshaft and a shaft, and in which the blowgun includes an elongate barrel, and optionally, a mouthpiece. FIGS. 22-43 depict a yet more preferred embodiment of my invention, which, in addition to comprising essentially the same components as the embodiment described in FIGS. 1-21, also further comprises a detent means to hold the subcaliber projectile and sabot means together as a sabot projectile assembly and to hold said sabot projectile assembly in loaded position within the bore, preferably until the commencement of launch acceleration. Briefly, in the embodiment depicted in FIGS. 22-43, the detent means includes a projectile detent and a sabot detent which cooperate in an essentially antagonistic manner to hold the sabot projectile assembly in loaded position. In the embodiment depicted in FIGS. 22-43, the projectile detent includes a magnet, and the sabot detent includes a means of partially obstructing the bore at or near the breech, in order to thereby abbuttingly or frictionally engage the sabot rearwardly or laterally, after loading insertion, in order to prevent the sabot from moving therepast in the direction toward or out the breech. Another change from the embodiment depicted in FIG. 1-21 is that in the embodiment depicted in FIGS. 22-43, there is an additional requirement that some portion, or the entirety, of the foreshaft of the subcaliber projectile (or some other suitable portion of the projectile) is composed of a material strongly susceptible to magnetic attraction, in order that the magnetic projectile detent may attract and hold the subcaliber projectile when loaded within the bore, with the subcaliber projectile engaged rearwardly by the sabot means, and the sabot means in turn engaged rearwardly by some portion of the sabot detent, until the commencement of launch acceleration, when the thrust of the user's breath will cause the sabot and engaged subcaliber projectile to move forward, the projectile foreshaft in a short distance breaking free of the magnetic projectile detent's influence, after which the sabot and subcaliber projectile continue to accelerate together through and out the bore of the barrel. Although certain embodiments, such as the one depicted in FIGS. 22-43, which have a magnetic detent affixed externally to the barrel, may function satisfactorily with a barrel composed in part or in whole of steel or some other strongly magnetically attractable material, in general such a barrel would tend to absorb some of the magnetic attraction and weaken the magnetic detent's influence on the projectile. Therefore in certain embodiments with a magnetic projectile detent affixed externally to the barrel, such as the one depicted in FIGS. 22-43, it will be advantageous if the barrel in its entirety, or else in its portion against or close to the magnetic detent, is composed of some material such as aluminum, plastic, wood, or other suitable material which is essentially nonmagnetic and non-susceptible to magnetic attraction.

Since the embodiment depicted in FIGS. 1-21 and the embodiment depicted in FIGS. 22-43 share many of the same components, many of the comments in the above description, on methods of use and alternative versions of embodiment, may be applied to the following description too, so I have not repeated all of them, since it will be apparent to one skilled in the art that they may apply to this embodiment as well. Since the main difference between the two illustrated embodiments is the detent means, the applicant has focused on providing description and suggestions about possible methods of use, and some of the possible alternatives, for this type of detent. In terms of general all-around usage, the below embodiment depicted in FIGS. 22-43 is more flexible than the above embodiment depicted in FIGS. 1-21, since the antagonistic detent means may be adapted, with the use of a sufficiently magnetically powerful magnetic detent, so as to constrain or confine the sabot projectile assembly in loaded position whether the barrel is up-tilted, horizontal, or downtilted, or in other words, in any desired orientation of the barrel, and so that loaded positioning is secure even during fairly vigorous handling of the blowgun. The secure positioning made possible by the detent also means that the fit of the sabot within the bore may be made slightly looser without causing premature sliding or displacement of the projectile assembly. The below embodiment depicted in FIGS. 22-43 may also develop higher launch velocities due to the possibility of higher operating pressures, or earlier peaks in pressure, developing as a result of a slight travel delay imposed by the detent means, and also because the sabot may, if desired, be sized to fit slightly more loosely in the bore. Because of the many similarities, reading the below description of the blowgun depicted in FIGS. 22-43 will probably also shed additional light on the function and means of the blowgun depicted in FIGS. 1-21.

FIG. 22 is a side view of my invention, in a preferred embodiment which comprises blowgun 110, associated subcaliber projectile 140, and associated sabot means 170. Blowgun 110 in this embodiment includes substantially straight elongate tubular barrel 120, detent means 200 and, optionally, mouthpiece 130.

FIG. 23 depicts a perspective view of blowgun 110. Blowgun 110 includes advantageously substantially straight elongate tubular barrel 120, detent means 200 and, optionally, mouthpiece 130. Barrel 120 is provided with breech opening 120-2, muzzle opening 120-6, and substantially straight, elongate bore 120-4 which communicates between breech opening 120-2 and muzzle opening 120-6. FIG. 23 depicts optional mouthpiece 130 as frictionally engaged with breech end 120-3 of barrel 120. FIG. 23 also shows optional mouthpiece 130 as being so adapted as to engage the face of the user against the lips, or against the area immediately around the lips, or against both, with clearance to avoid any such contact with nose or chin as would disrupt the positioning of mouthpiece 130 against face of user to achieve a good airseal, according to the manner of use depicted in FIGS. 38, 39, and 41.

FIG. 23 continued: In this embodiment, detent means 200 includes projectile detent means 210 and sabot detent means 220. The significance of the positioning of projectile detent 210 and sabot detent 220 relative each other and relative barrel bore 120-4, will be explained in more detail below. Sabot detent means 220 is preferably affixed to or integral withd, or otherwise essentially contiguous with, the inner surface of barrel bore 120-4, at or near breech opening 120-2. Generally speaking, sabot detent means 220 may essentially comprise or include a short section of bore of essentially reduced caliber, possibly provided by one or more bore indentations, or by one or more protrusions affixed to and protruding from the inner surface of bore 120-4, thereby partially obstructing bore 120-4. In this embodiment, sabot detent 220 includes narrow ramp-like protrusion 220, affixed to and radially extending from the inner surface of bore 120-4 at or near breech 120-2, in such a manner that detent protrusion 220 is aligned lengthwise substantially parallel to the longitudinal axis of bore 120-4. Detent protrusion 220 advantageously has a slanted surface facing rearwards toward breech 120-2, and a shoulder surface facing forwards towards muzzle 120-6. During loading insertion of sabot 170, the rearward-facing sloped surface of detent 220 cooperates with the slanted forward surface of conical sabot 170 to more easily allow sabot 170 to be manually pushed past sabot detent 220 in the direction towards muzzle 120-6 during loading insertion. The forward-facing shoulder surface of detent 220, upon contact with sabot means 170, abuttingly engages some portion of base 170-2 or other rearward-facing surface of sabot 170 in such a manner as to prevent or resist sabot cone 170, after completion of loading insertion, from moving back past sabot detent 220 in the direction towards or out of breech opening 120-2.

FIG. 23 continued: In this embodiment, projectile detent means 210 includes magnet 210 externally affixed to or positioned against barrel 120 at a predetermined distance, along barrel 120, from the position of sabot detent means 220. The suitable positioning of magnetic detent 210 relative sabot detent 220 may vary according to the particular embodiment, the particular method of use, and the particular user preferences. In embodiments similar to the embodiment depicted in FIGS. 22-43, the suitable distance, along barrel 120, between detent 210 and detent 220 will typically correspond roughly to the length of assembled sabot projectile assembly 190, minus some portion of the length of projectile foreshaft 150, with the distance advantageously somewhat less than the total length of subcaliber projectile proper 140. When projectile 140 is in loaded position, there may or may not be some longitudinal or axial overlapping of the position of some magnetically attractable portion of projectile 140 with the position of some portion of detent 210. The significance and suitability of the positioning of the projectile detent means 210 relative sabot detent means 220, and certain advantageous characteristics desirable regarding the strength and orientation of the magnetic field of detent 210, will become clearer as the description progresses, and will make it apparent to one skilled in the art that the suitability of positioning of projectile detent 210, relative bore 120-4 and relative sabot detent 220, may depend, among other things, on the particular size, shape, polar orientation, and magnetic field strength of magnetic detent 210, as well as on the size, shape and disposition, within projectile 140, of the portion of projectile 140 which is susceptible to magnetic attraction, as well as on the precise position, relative bore 120-4, at which some portion of sabot detent 220 directly abbutingly engages sabot 170, as well as upon other factors such as the wall thickness of barrel 120, and the length from tip to base of sabot cone 170, as well as any longitudinal or axial overlap (or alternatively gap between) of the position of some magnetically attractable portion of projectile 140 with the position of some portion of detent 210 when projectile 140 is in loaded position. Furthermore, in certain embodiments, the predetermined relative positioning (particularly the distance of separation along barrel 120), of detent 210 relative detent 220 may be selected from a certain range of functional relative positions, in order to allow tuning of variables such as initial launching resistance, in order to match user preference, comfort level, and ability.

FIG. 25 is a portion of the side view depicted in FIG. 22, enlarged to show with greater clarity and detail a side view of subcaliber projectile 140 and sabot means 170. Subcaliber projectile 140 in this embodiment includes lightweight, substantially straight, elongate tubular shaft 160, which is preferably composed of resiliently flexible plastic, affixed rearwardly to and coaxially aligned with substantially straight, relatively short, cylindrical foreshaft 150. FIG. 24 is a side view of foreshaft 150 shown by itself. Foreshaft 150 in this embodiment is composed of, or includes a portion composed of, steel, iron, or other material strongly susceptible to magnetic attraction. Shaft 160 and foreshaft 150 are advantageously relatively proportioned in such a manner that subcaliber projectile 140 has a forward-of-center balance such that hollow, lightweight shaft 160 may serve as an aerodynamic stabilizer, or in other words a means of applying aerodynamic correctional guidance to subcaliber projectile 140 during flight. In this embodiment, sabot means 170 includes lightweight conical shell 170 sized and shaped at its base 170-2 to substantially, yet slightly loosely, slidingly seal with barrel bore 120-4.

Sabot cone 170 is preferably composed or formed of a material such as molded plastic, molded foam, plastic film, or paper, in order to thereby advantageously be so adapted as to be very lightweight and water resistant, and somewhat resiliently deformable or compressible at its base 170-2. Sabot cone 170 is further preferably so proportioned so that the angle formed in side profile by its point or vertex 170-4 is relatively obtuse or blunt.

FIGS. 26 and 27 are, respectively, exploded and assembled perspective views of subcaliber projectile 140. FIG. 26 includes an unobstructed perspective view of foreshaft 150. Foreshaft 150 in this embodiment is advantageously provided with wider forward section 150-2 and narrower rear portion 150-4. Rear portion 150-4 is advantageously proportioned and sized in such a manner as to frictionally engage the inner surface of tubular shaft 160 when inserted into the forward opening 160-2 of shaft 160 in the manner depicted in FIG. 27. The diameter of forward section 150-2 is advantageously somewhat greater than the inner diameter of tubular shaft 160, and furthermore, the transition between forward section 150-2 and rear section 150-4 is advantageously relatively abrupt, in order to provide preferably essentially perpendicular shoulder 153 against which forward end 160-3 of shaft 160 may be securely abuttingly seated. An additional depiction of the manner of engagement between foreshaft 150 and shaft 160 is depicted in sectional view in FIG. 32. Furthermore, in order to promote aerodynamic stability of subcaliber projectile 140, the diameter of some portion of forward portion 150-2 is also advantageously as wide as or wider than the outer diameter of the forward end of tubular shaft 160, in order to avoid reducing the sectional density of the forward portion of subcaliber projectile 140, and thereby helping to promote aerodynamic stability of projectile 140.

Point, or tip, 170-4 of sabot means 170 may be inserted into rearward opening 160-4 of shaft 160 of subcaliber projectile 140, so that sabot 170 may thereby essentially rearwardly abuttingly engage subcaliber projectile 140 (FIGS. 28-34). In this manner, subcaliber projectile 140 and sabot means 170 may cooperatively engage each other to form a functional unit which shall be known as sabot projectile assembly 190 or sabot projectile 190, during any or all of certain stages of the handling, loading, and launching sequence; such stages possibly including, for example, while being inserted into barrel bore 120-4 to assume loaded position, while being maintained in loaded position within bore 120-4 prior to launch acceleration, and while traveling along bore 120-4 during launch acceleration.

FIG. 28 and FIG. 29 depict, respectively, exploded and assembled perspective views of sabot projectile assembly 190. FIG. 30 and FIG. 31 depict, respectively, side elevational and front elevational views of sabot projectile assembly 190. Sabot projectile assembly 190 includes subcaliber projectile 140 and sabot cone 170. Subcaliber projectile 140 and sabot cone 170 are engaged as a functional unit in an essentially abutting manner by inserting forward tip 170-4 of sabot cone 170 into the rear opening 160-4 of tubular shaft 160 of subcaliber projectile 140. The tip angle of sabot cone 170 is preferably relatively blunt, as indicated above, in order to avoid any tendency to wedge into shaft 160 and thereby either become jammed in shaft opening 160-4, or possibly split shaft 160. The rear portion of shaft 160 may, if necessary, be reinforced by methods such as a slight thickening of the shaft wall or a wrapping of strong tape in order to provide enhanced protection against any tendency of the tip of cone 170 to wedge into or split shaft 160. Before loading into barrel bore 120-4, subcaliber projectile 140 and sabot cone 170 have substantially no direct positive connection, and if cone 170, after insertion into the rear of shaft 160, is not held there manually or by some other external connecting means or external means of support, then preferably cone 170 may freely drop out of and away from shaft 160.

FIG. 32 depicts a sectional side view of sabot projectile assembly 190, along section line 32-32 from FIG. 31, in which shaft 160 is an elongate, essentially straight, hollow tubular member, preferably very lightweight. Foreshaft 150 advantageously includes wider forward section 150-2 and narrower rear section 150-4. Rear section 150-4 is preferably proportioned and sized in such a manner as to frictionally engage the inner surface of shaft 160 when inserted into forward opening 160-2. The transition between wider forward section 150-2 and narrower rear section 150-4 advantageously provides essentially perpendicular shoulder 150-3 against which forward end 160-2 of shaft 160 may be securely abuttingly seated. Having some portion of forward portion 150-2 be wider than shaft 160 not only may provide additional benefits in terms of aerodynamic stability, as mentioned earlier, but may also provide benefits in terms of target penetration performance, since when penetrating a target, forward portion 150-2 may clear or open a penetration channel through which advantageously narrower shaft 160 may pass with little or no surface contact.

FIG. 33 depicts a sectional view, on a somewhat enlarged scale for increased clarity of detail, of sabot projectile assembly 190, along section line 33-33 from FIG. 30.

FIG. 33 shows tip 170-4 of sabot cone 170 rearwardly inserted within shaft 160 in order that sabot 170 may thereby abbutingly and loosely penetratively engage shaft 160.

FIG. 34 depicts a sectional view, on a somewhat enlarged scale for increased clarity of detail, of sabot projectile assembly 190 along section line 34-34 from FIG. 30.

FIG. 34 shows foreshaft rear portion 150-4 inserted within, and thereby frictionally engaged with, shaft 160, with outer diameter of shaft 160 narrower than outer diameter of foreshaft shoulder 150-3.

FIG. 35 depicts a perspective view of a possible method by which the user may manually hold subcaliber projectile 140 and sabot 170 engaged together as sabot projectile assembly 190, for manual handling of sabot projectile assembly 190 preparatory to, and during, loading insertion of sabot projectile assembly 190 into barrel breech 120-2 and therethrough into barrel bore 120-4. It will be apparent to one skilled in the art that there are other possible methods of manually holding sabot projectile assembly 190 during loading and other handling. In the method depicted in FIG. 35, the user configures the fingers and thumb of one hand in approximately the position of preparing to snap the fingers. Subcaliber projectile 140 may, in this position of the hand, be gripped between thumb and middle finger, and sabot 170, with tip 170-2 inserted within rearward shaft opening 160-4, may be engaged rearwardly by the index finger inserted rearwardly within sabot conical shell 170 to push against rear surface 170-8 of sabot 170. In this manner, the mutual opposition or constraint, of index finger against thumb and middle finger, is transmitted by sabot 170 and subcaliber projectile 140 to each other, so that subcaliber projectile 140 and sabot 170 remain thereby securely engaged as sabot projectile assembly 190.

FIG. 36 and FIG. 37 depict stages in a possible method of loading sabot projectile assembly 190 into barrel bore 120-4 of blowgun 110. FIG. 36 depicts the user holding blowgun 110 with one hand and with the other hand using the essential technique, depicted above in FIG. 35, to hold subcaliber projectile 140 and sabot 170 together, engaged as the functional unit known as sabot projectile assembly 190. FIG. 36 further depicts sabot projectile assembly 190 as being partially inserted into breech 120-2 and therethrough into and within bore 120-4, with the front end or cooperating portion of subcaliber projectile 140 resting upon the inner surface of bore 120-4 and the rearward portion of sabot projectile assembly 190 held together and supported by the user's hand. FIG. 36 depicts the user holding blowgun 110 oriented so that barrel bore 120-4 is substantially horizontal; however it should be noted that in this particular embodiment, provided magnetic detent 210 is sufficiently strong magnetically, the user could also load sabot projectile assembly 190 while holding blowgun 110 with barrel bore 120-4 down-tilted so that muzzle 120-6 is lower than breech 120-2. Furthermore, sabot detent 220 permits the user to load sabot projectile assembly 190 while holding blowgun 110 with barrel bore 120-4 up-tilted so that muzzle 120-6 is higher than breech 120-2, although barrel bore 120-4 will probably not necessarily need to be uptilted during loading or when loaded, unless projectile detent 210 has somewhat low magnetic strength, or is positioned or oriented in such a way as to exert a relatively weak influence on projectile 140.

FIG. 37 depicts the user holding blowgun 110 in essentially the same manner illustrated in FIG. 36, with sabot projectile assembly 190 fully inserted into and within bore 120-4. In moving sabot projectile assembly 190 from the first (partially loaded) position shown in FIG. 36, to the second (fully loaded) position shown in FIG. 37, as sabot projectile assembly 190 is pushed progressively further into and through breech 120-2 by the pressure of the user's index finger upon sabot 170, the user may gradually release the grip of the thumb and middle finger upon subcaliber projectile 140, allowing subcaliber projectile 140 to be supported in place with the front end of foreshaft 150 slidingly supported upon the inner surface of bore 120-4, and with the rear end of shaft 160 supported upon sabot 170, with sabot 170 in turn supported on the user's index finger. Accordingly, after releasing the grip of thumb and middle finger upon sabot projectile assembly 190, the user may withdraw thumb and middle finger out of the way to allow easier completion of loading insertion of sabot projectile assembly 190. Upon completion of loading insertion, subsequent withdrawal of finger or optional loading tool (loading tool not shown), sabot projectile assembly 190 will be held with sabot means 170 securely seated against sabot detent 170, with the forward end of subcaliber projectile 140 securely held against the inner surface of barrel bore 120-4, and with the rearward end of subcaliber projectile 140 securely seated against the forward end or the forward surface of sabot cone 170, with a firm mutual opposition or close mutual confinement of subcaliber projectile 140 against sabot means 170. It should be noted here that the insertion of sabot tip 170-4 within rear opening 160-4 of projectile shaft 160 permits not only an essentially abutting engagement of subcaliber projectile 140 rearwardly by some portion of sabot 170, but also permits what might be characterized as a loosely nesting or loosely penetrative engagement of subcaliber projectile 140 by sabot cone 170, which serves to help prevent premature lateral displacement of projectile 140 relative sabot cone 170. Additional notes about the relationship of sabot projectile assembly components and detent components will follow shortly below.

Note: Because of the substantial magnetic attraction possible between detent 210 and projectile 140 when they are sufficiently close together, when using the method of loading depicted in FIGS. 36 and 37, the user may need to exercise some caution so that subcaliber projectile 140 is not pulled forward by detent 210 away from secure engagement with sabot 170 during loading insertion.

FIG. 37 continued: In this embodiment, detent means 200 includes projectile detent means 210 and sabot detent means 220. Sabot detent means 220 is preferably affixed to or integral with the inner surface of barrel bore 120-4, at or near breech opening 120-2. Sabot detent means 220 essentially comprises or includes a short section of bore of essentially reduced caliber, possibly comprising one or more bore indentations, or one or more protrusions affixed to or integral with and protruding from the inner surface of bore 120-4, thereby partially obstructing bore 120-4. In this embodiment, sabot detent 220 includes narrow ramp-like protrusion 220, affixed to or integral with and radially extending from the inner surface of bore 120-4 at or near breech 120-2, in such a manner that detent protrusion 220 is longitudinally aligned substantially parallel to the longitudinal axis of bore 120-4. Detent protrusion 220 advantageously has a slanted surface facing rearwards toward breech 120-2, and a shoulder surface facing forwards toward muzzle 120-6. The rearward-facing slanted surface of detent protrusion 220 cooperates with the slanted forward surface of conical shell sabot 170 to more easily allow sabot 170 to be manually pushed past sabot detent 220 in the direction towards muzzle 120-6 during loading insertion. The forward-facing shoulder surface of detent protrusion 220, upon contact with sabot means 170, abuttingly engages some portion of base 170-2, or other rearward surface of sabot 170, in such a manner as to prevent or resist sabot cone 170, after completion of loading insertion, from moving back past sabot detent 220 in the direction towards or out of breech opening 120-2.

Note: FIGS. 22-43 appear to depict detent 210 and detent 220 without apparent connecting means to barrel/bore. However, each detent could be affixed with glue/cemented in place with epoxy. One or both detents, particularly detent 220, could also be formed integrally with the wall structure of barrel 120, or even affixed to or formed integrally with the structure of optional mouthpiece 130, or even with an optional barrel extension member affixed intermediarily between barrel 120 and mouthpiece 130. It is also possible, if some proximal portion, or entirety, of barrel 120 is composed of steel or other strongly magnetically attractable material, for detent 210 to be held in position against barrel 120 by magnetic attraction, without need for any glue, epoxy, or other type of intermediary connecting means. However, such a magnetically attractable portion of barrel 120 would absorb some of the magnetic attraction of detent 210, thereby possibly weakening the influence of detent 210 upon projectile 140. Alternative connecting means will be apparent to one skilled in the arts and some possibilities are discussed further below.

Not illustrated: Although, with the embodiment depicted in FIGS. 22-43, users may employ the essentially simultaneous method depicted in FIGS. 35-37 to load sabot projectile assembly 190 within bore 120-4, most users will probably find it as easy or easier to insert or load the components of sabot projectile assembly 190 into bore 120-4 in a sequential manner thusly: To begin, sabot projectile 140 is inserted into breech opening 120-2 of bore 120-4 with foreshaft 150 forward towards muzzle 120-6 of barrel bore 120-4. The user inserts subcaliber projectile 140 sufficiently far into bore 120-4 so that projectile foreshaft 150 (or other magnetically susceptible portion of projectile 140) is held against the inner surface of bore 120-4 by the attraction of foreshaft 150 to magnetic projectile detent 210, in an initial, partially loaded position (Note: this method's initial, partially loaded position is not illustrated and is likely different from the partially loaded position of the other method depicted in FIG. 36). Magnetic projectile detent 210 is advantageously positioned at a distance from sabot detent 220 or breech 120-2 such that when subcaliber projectile 140 is held against the inner surface of bore 120-4 in this initial, partially loaded position, a portion of the rearward end of shaft 160, preferably a short portion only, is still protruding out from breech 120-2 of bore 120-4; or alternatively it is otherwise advantageous if, in this initial, partially loaded position, the rearward end of shaft 60 is either flush with the rim of breech 120-2, or else withdrawn into bore 120-4 a distance away from breech 120-2 which is somewhat less than the axial length of sabot cone 170 measured from base 170-2 to tip 170-4. The user may now release any manual hold on subcaliber projectile 140 and leave projectile 140 held by magnetic detent 210 against the inside of bore 120-4, and preferably with rear end of shaft 160 near, at, or slightly protruding from breech 120-2 as described above. The user may now manually hold and handle sabot cone 170 with the freed hand, and thereby insert tip 170-4 of sabot cone 170 into rearward opening 160-4 of subcaliber projectile shaft 160, and with subcaliber projectile 140 thus engaged rearwardly in an essentially abutting manner by sabot cone 170, push forward with index (or other) finger, or with an optional insertion tool or mechanism (not shown), against the rear surface of sabot cone 170, in the direction of muzzle 120-6, in order to continue inserting and loading sabot projectile assembly 190 into barrel bore 120-4. The user may continue pushing sabot cone 170 forward, with finger or an optional insertion tool or mechanism (not shown), until rearward base 170-4 of sabot cone 170 has been inserted into breech 120-2 and has been pushed past the restriction of sabot detent 220 so that sabot 170 may be rearwardly abuttingly engaged by sabot detent 220, at which time sabot projectile assembly 190 will be in a substantially fully-loaded position (Note: this fully-loaded position IS essentially the same as the fully loaded position shown in FIGS. 37, 38, 39 and 40).

FIGS. 37, 38 and 39 and 40: Whichever loading insertion method has been used, when sabot projectile assembly 190 is at its fully-loaded position, magnetic detent 210 and subcaliber projectile foreshaft 150 (or other appropriate magnetically attractable portion of projectile 140) should be relatively positioned such that the strength of attraction between detent 210 and foreshaft 150 is still sufficient to hold the tip, or forward portion, or other cooperating portion of subcaliber projectile 140 against bore 120-4 securely enough that when the user completes loading insertion and stops pushing forward on sabot 170 with finger or insertion tool, magnetic detent 210 may prevent or resist any further axial dislocation of sabot projectile assembly 190 toward muzzle 120-6 prior to commencement of launch acceleration. Thus, in this embodiment it may be appreciated that projectile detent 210 advantageously has a magnetic field of sufficient strength and size or range to attract and hold subcaliber projectile 140 against the inner surface of bore 120-4, as projectile 140 moves along a range of motion or positionings corresponding in length of travel to somewhat more or less than the axial length from tip 170-4 to base 170-2 of sabot cone 170, depending on the positioning of rearward end 160-4 of projectile shaft 160 relative breech 120-2 when subcaliber projectile 140 is in initial partially loaded position, as described above.

Additional notes on advantageous positioning and orientation, and other preferable characteristics of the detent means, and on loading insertion of the sabot projectile assembly: When the user completes loading insertion and thereupon stops pushing sabot 170 forward in the direction towards muzzle 120-6 with finger or optional insertion tool, and subsequently withdraws the finger or insertion tool back out of breech 120-2, sabot 170 may in some embodiments or situations be able to move backwards toward breech 120-2 a short distance before contacting and securely abbuttingly engaging some portion of sabot detent 220. Accordingly, in such embodiments magnetic detent 210 is advantageously positioned, oriented and of sufficient magnetic strength that when loading insertion is completed, some component of the attractive force between projectile foreshaft 150 and magnetic detent 210 will resiliently urge subcaliber projectile 140 towards breech 120-2. Typically, such a magnetically imposed breechward urging may be accomplished in part by positioning some portion of detent 210 somewhat longitudinally behind (that is, closer to detent 220 than) the longitudinal center of the magnetically attractable portion of projectile 140, or in other words positioning detent 210 so that the distance between detent 210 and detent 220 is less than the distance between detent 220 and the longitudinal center (or otherwise located center-of-mass or center of magnetic response) of the magnetically attractable portion of projectile 140. Or in other words, such a magnetically imposed breechward urging may be accomplished in part by positioning some portion of detent 210 between the center-of-mass or center of magnetic response of the magnetically attractable portion of projectile 140, and detent 220. Advantageously, such a magnetically imposed breechward urging should tend to cause subcaliber projectile 140 to slide backward upon and within bore 120-4 in immediate following response to any backward or breechward motion of sabot cone 170, so that the withdrawing of the user's finger or optional insertion tool is in effect executed under a magnetically produced backpressure transmitted by subcaliber projectile 140 to sabot cone 170 that keeps sabot cone 170 followingly pressed against the withdrawing finger tip or insertion tool until some rearward portion of sabot cone 170 is securely abuttingly engaged by sabot detent 220. Such a backpressure may make possible a very smooth and sensitive following motion by sabot projectile assembly 190 of the withdrawing finger or insertion tool so that at no time during the withdrawal is there any significant break in continuous contact between sabot cone 170 and the rear end of projectile 140, nor is there any significant break in contact between the rear surface of sabot cone 170 and the withdrawing finger or insertion tool, until such time as sabot detent 220 abuttingly engages the rear of sabot cone 170 and thereby constrains cone 170 from further axial displacement in the direction towards or out breech 120-2. Such substantially continuous, unbroken contact helps to prevent or resist any excessive axial or lateral dislocation of sabot cone 170 relative subcaliber projectile 140 during loading insertion and positioning. It should be noted that if magnetic detent 210 has a magnetic field sufficiently strong, detent 210 may advantageously be oriented with its axis or direction of strongest magnetic pull obliquely tilted relative the longitudinal axis of barrel bore 120-4, rather than aligned parallel to or perpendicular to the longitudinal axis of barrel bore 120-4 (such an obliquely tilted orientation of detent 210 is not shown in the illustration figures). Such an obliquely tilted alignment of detent 210 may have an effect of strengthening the breechward component of the magnetic urging upon projectile foreshaft 150, while at the same time may somewhat diminish the component of magnetic attraction that attempts to pull foreshaft 150 down against the inner surface of bore 120-4 (such as the component of magnetic attractive force that is essentially normal to the inner surface of bore 120-4). If the magnetic field pulls subcaliber projectile 140 too firmly against the inner surface of bore 120-4, the resulting frictional engagement may become too strong to allow subcaliber projectile 140 to backslide smoothly towards breech 120-2 under the urging of the breechward component of the magnetic influence of detent 210, in following response to any breechward motion of sabot means 170. It is within the ability of those skilled in the art to determine suitable positioning, orientation, and magnetic field characteristics of one or more magnets relative bore 120-4 and relative sabot detent 220 in order that the magnet or magnets may tend to cause the aforementioned advantageous breechward urging of the appropriate, cooperatingly positioned and oriented magnetically attractable portion of projectile 140, while advantageously not tending to cause the aforementioned excessively firm or strong pulling of projectile 140 against the inner surface of bore 120-4, in order to thereby promote the aforementioned substantially smooth following motion by sabot projectile 190 of the withdrawn finger or optional insertion tool after loading insertion, in order to tend to cause the aforementioned substantially continuous, unbroken contact between components of sabot projectile 190 that would tend to prevent or resist any excessive axial or lateral dislocation of sabot cone 170 relative subcaliber projectile 140, and any optional intermediary members, during loading insertion and positioning of sabot projectile 190.

FIG. 39 is a portion of the side view depicted in FIG. 38, enlarged to show with greater clarity and detail a side view of sabot projectile assembly 190 confined in fully loaded position by the mutual opposition or mutual confinement imposed by projectile detent means 210 and sabot detent means 220. The somewhat enlarged side view depicted in FIG. 39 also clearly shows a slight flexing of resiliently flexible shaft 160 which may possibly occur when sabot projectile assembly 190 is confined in loaded position within bore 120-4 by detent means 200, and with the substantial length of foreshaft 150, along with any overlapping portion of shaft 160, pulled substantially against or parallel to the inner surface of bore 120-4 by the attractive pull between projectile detent 210 and foreshaft 150. It will be apparent to one skilled in the art that alternate embodiments are possible in which shaft 160 or projectile 140 is relatively rigid and in which, for example, only the forward tip of foreshaft 150 or projectile 140 would be pulled against the inner surface of bore 120-4 by detent 210. It will also be apparent to one skilled in the art that in certain embodiments, due to, for example, sufficient flexibility of the structure of sabot 170, or sufficient looseness of fit of sabot 170 within bore 120-4, there may be sufficient play in the orientation of sabot 170 within bore 120-4 that sabot 170 may tilt at a sufficient angle relative the longitudinal axis of bore 120-4 so that sabot 170 may thereby engage with its tip, or other appropriate cooperating portion, some portion of projectile 140 that is substantially against the inner surface of bore 120-4. Sabot detent means 220 is preferably affixed to or integral with the inner surface of barrel bore 120-4, at or near breech opening 120-2. In this embodiment, sabot detent 220 includes narrow ramp-like protrusion 220, affixed to and radially extending from the inner surface of bore 120-4 at or near breech 120-2, in such a manner that detent protrusion 220 is aligned lengthwise substantially parallel to the longitudinal axis of bore 120-4. Sabot detent protrusion 220 advantageously has a slanted surface facing rearward toward breech 120-2, and a shoulder surface facing forward toward muzzle 120-6. The rearward-facing slanted surface of detent protrusion 220 may cooperate with the slanted forward surface of sabot 170 to more easily allow sabot 170 to be be manually pushed past sabot detent 220 in the direction towards muzzle 120-6 during loading insertion. The forward-facing shoulder surface of detent protrusion 220, upon contact with sabot means 170, abuttingly engages some portion of base 170-2 or other rearward surface of sabot 170 in such a manner as to prevent or resist sabot cone 170, after completion of loading insertion, from moving back past sabot detent 220 in the direction towards or out of breech opening 120-2.

FIG. 40 is a sectional view along section line 40-40 from FIG. 39, showing sabot 170 rearwardly engaged by sabot detent means 220, and with projectile detent 210 and optional mouthpiece 130 each externally affixed to barrel 120. It may be noted that in general, sabot detent means 220 partially obstructs bore 120-4 in such a manner as to prevent or resist sabot cone 170, after completion of loading insertion, from moving past, or back past, sabot detent 220 in the direction towards or out of breech opening 120-2, and particularly to prevent sabot 170 from being sucked out through breech 120-2 by the user, and as well to prevent sabot 170 from either falling out through breech 120-2 due to gravity or reorientation of bore 120-4, or being pushed out through breech 120-2 due to any backpressure, such as any backpressure possibly imposed by magnetic detent 210 and transmitted by subcaliber projectile 140 to sabot 170, as was described above, or such as any backpressure possibly imposed by any spring bias due to any flexing of any resiliently flexible portion of projectile 140 or sabot 170 or other possible projectile assembly component.

FIG. 40 helps to make it evident that, furthermore, in this embodiment, sabot detent means 220 may partially obstruct bore 120-4 in such a manner as to preferably cause little or no substantial reduction in airflow through bore 120-4, and also so as to preferably allow relatively easy manual insertion, with finger or possibly with the aid of an optional insertion tool, of preferably somewhat pliable, deformable, or compressible sabot cone 170 past sabot detent 220 in the direction towards muzzle 120-6. Sabot detent means 220 is preferably affixed to or integral with the inner surface of barrel bore 120-4, at or near breech opening 120-2. Sabot detent means 220, in broader terms that may apply to this embodiment or to certain alternative embodiments, essentially comprises or includes a short section of bore of essentially reduced caliber, which may be provided, for example, by one or more bore indentations, or by one or more protrusions essentially affixed to or integral with and protruding from the inner surface of bore 120-4, thereby partially obstructing bore 120-4. It will be apparent to one skilled in the art that sabot detent extension 220 might be wider, yet shorter, or less radially protrusive, than shown in FIG. 40, in order to still avoid excessively obstructing airflow, and that additionally, or alternatively, some portion of sabot detent extension 220 might be shaped to essentially define one or more portions of an essentially annular shoulder or rim essentially contiguous with the inner surface of bore 120-4.

FIGS. 37, 38, 39, and 40, continued: Upon completion of loading insertion, withdrawal of finger or optional loading tool or mechanism, and any corresponding breechward following motion by sabot projectile assembly 190, sabot projectile assembly 190 will be held in fully loaded position, with sabot means 170 securely seated against sabot detent 170, with the forward end of subcaliber projectile 140 securely held against the inner surface of barrel bore 120-4, and with the rearward end of subcaliber projectile 140 securely seated against forward end or surface of sabot cone 170, preferably with a firm mutual opposition or close mutual confinement of subcaliber projectile 140 against sabot means 170. It should be noted here that the insertion of sabot tip 170-4 within rear opening 160-4 of projectile shaft 160 permits not only an essentially abutting engagement of subcaliber projectile 140 rearwardly by some portion of sabot 170, but also permits what might be characterized as a loosely nesting or loosely penetrative engagement of subcaliber projectile 140 by sabot cone 170, which serves to help prevent premature lateral displacement of subcaliber projectile 140 relative sabot cone 170. Any such premature lateral displacement, if excessive, could result in dislocation of sabot cone tip 170-4 from within the effectual socket of rear opening 160-4 of projectile shaft 160, which loss of secure engagement would likely cause sabot cone 170 to fail to efficiently transmit thrust to subcaliber projectile 140 during launch acceleration, likely causing a jam within bore 120-4, of projectile 140 squeezed side by side against sabot 170, or else possibly causing preferably somewhat deformable or compressible sabot cone 170 to slide over and past preferably slender subcaliber projectile 140, thereby causing sabot 170 to accelerate alone and without projectile 140 through bore 120-4 and out from muzzle 120-6.

Note: Optional loading tool or mechanism for inserting sabot projectile assembly 190 into bore 120-4 is not shown in the illustration figures. In some embodiments, it might not be necessary to withdraw or remove such a loading tool or mechanism before initiating launch, particularly if such a tool or mechanism is part of a mechanical action used to load or "chamber" sabot projectile assembly 190.

Note: Although most users will probably find it easier and more convenient for projectile detent 210 to be affixed to barrel 120 either directly or via one or more intermediary connecting members, it should also be noted that in some embodiments magnetic detent 210 need not be affixed at all to barrel 120, but could instead, for example, even be held manually in place against or sufficiently near barrel 120 by one of the user's hands, or by some other external means of supporting detent 210 in place against or sufficiently near barrel 120. It should also be noted that any flexing of preferably resiliently flexible shaft 160, or of any other resiliently flexible portion of sabot projectile assembly 190, when sabot projectile assembly 190 is confined in fully loaded position, may contribute a spring bias tension that helps to keep the rear end of subcaliber projectile 140 pressed securely against the forward end or forward surface of sabot 170, and possibly also helping to keep rearward surface of sabot 170 pressed securely against sabot detent 220.

FIGS. 37, 38, 39, and 40, continued: Sabot projectile assembly 190 is now held securely in fully loaded position, not only by the pulling of the forward portion or tip of subcaliber projectile 140 against the inner surface of bore 120-4 by the magnetic attraction of projectile detent 210, along with the attendant frictional engagement of subcaliber projectile 140 by the inner surface of bore 120-4, but also by the mutual opposition of the breechward urging of magnetic detent 210 upon subcaliber projectile 140, countered by the abutting engagement of sabot cone 170 against sabot detent 220. As long as magnetic detent 210 is sufficiently strong magnetically, and positioned and oriented appropriately relative foreshaft 150, then sabot projectile assembly 190 will be held very substantially securely and somewhat resiliently in loaded position, so that blowgun 110 may be handled and reoriented with little fear of displacing sabot projectile assembly 190 from its loaded position within bore 120-4, unless blowgun 110 is subjected to a rather severe jolt or shock or perhaps dropped or swung violently. In addition, the positioning effect imposed upon sabot projectile assembly 190 within bore 120-4, caused by the mutual opposition of magnetic detent 210 and sabot detent 220, as well as by the pulling of foreshaft 150 against the inner surface of bore 120-4 by the attraction of magnetic detent 210, may result in a very consistent, repeatable shot-to-shot positioning and orientation of sabot projectile assembly 190, and in particular of sabot projectile proper 140, which consistency effect may substantially enhance accuracy performance. Based on the preceding explanation, it will be apparent to one skilled in the art how to position and orient detent 210 and detent 220, and how to select other characteristics of detent 210, detent 220, and projectile 140 to achieve secure loaded positioning and other loading insertion and positioning actions and characteristics described or suggested above.

FIG. 41 shows sabot projectile assembly 190 partially displaced along bore 120-4, traveling under launch acceleration through bore 120-4 towards muzzle 120-6 (muzzle 120-6 is not shown in FIG. 41 due to image cropping of the distal portion of barrel 120), propelled by thrust of breath (arrows 300) of user.

FIG. 42 depicts a perspective view of a distal portion of barrel 120, with the portion at and near muzzle 120-6 partially cut away to show sabot projectile assembly 190 partially exited through and out muzzle 120-6. At this stage of launch, sabot projectile assembly 190 is preferably still maintained as a functional unit by sabot 170 being positively accelerated by thrust of breath (arrows 300) against the inertial mass of subcaliber projectile 140. In this manner sabot projectile assembly 190, in this embodiment of my invention, is preferably maintained as a functional unit until sabot 170 completely exits through and out muzzle 120-6, with accompanying dispersal of thrust.

Not illustrated: In certain other alternative embodiments or methods of use of my invention, subcaliber projectile 140 and sabot 170 may begin separation before sabot 170 reaches or exits muzzle 120-6. An example of such an alternate embodiment is one in which barrel 120 is ported, or in other words provided with air passage holes through the wall of barrel 120 and communicating between bore 120-4 and the exterior of barrel 120, to allow substantial dissipation of breath pressure and thrust prior to sabot 170 reaching or exiting muzzle 120-6. Any such port holes would preferably be placed in the distal portion of barrel 120 fairly near muzzle 120-6. Another example of such an alternate embodiment is one in which barrel bore 120-4 is substantially flared near muzzle 120-6, or in which bore 120-4 is of sufficient length that air pressure of thrust declines to the point that sabot projectile assembly 190 is not positively urged through bore 120-4 all the way to muzzle 120-6. Similarly, in an example of such an alternate method of use, the user may blow relatively softly so that sabot 170 is not positively urged through bore 120-4 all the way to muzzle 120-6.

FIG. 43 is a perspective view depicting discarding separation of sabot 170 from subcaliber projectile 140 after sabot 170 has completed exiting through and out muzzle 120-6. After sabot 170 completes exiting through and out barrel muzzle 120-6, and thereby breaks the substantial sliding airseal between sabot base 170-2 and the inner surface of barrel bore 120-4, propulsive thrust (straight arrows 300) rapidly dissipates (curved arrows 310) and sabot 170 is no longer positively urged against the inertial mass of subcaliber projectile 140. Atmospheric drag (sharply bent arrows 320) acting upon sabot 170, which preferably has a very low sectional density compared to the sectional density of subcaliber projectile 140, causes sabot 170 to decelerate much more rapidly than subcaliber projectile 140, thus effecting separation and discarding of sabot 170 as subcaliber projectile 140 continues alone and unhindered along its external trajectory or path.

FIGS. 41, 42, and 43, continued: After loading is completed, the user may launch projectile 140 when desired by placing either breech 120-2 or optional mouthpiece 130 to his mouth and lips and blowing therein. The pressure of the user's breath received into breech 120-2 of bore 120-4, either directly or via optional mouthpiece 130, establishes a pressure differential across the effectual piston of sabot means 170. As pressure builds and the pressure differential becomes sufficient to overcome the initial launching resistance, sabot projectile assembly 190 begins to move forward, breaking free in a short distance of the influence of magnetic detent 210 and traveling forward under positive acceleration, secured by inertia as a functional unit, through and from bore 120-4 of barrel 120. After exiting barrel muzzle 120-6, air pressure and thrust rapidly disperse and sabot cone 170 is consequently no longer positively urged against the inertial mass of subcaliber projectile 140; furthermore, since subcaliber projectile assembly 190 was removed from the mutual opposition of antagonistic detent means 200 in the early stages of launch acceleration, sabot projectile assembly 190 may commence travel along its external trajectory with negligible or virtually no positive connection of sabot cone 170 to subcaliber projectile 140, since the essentially abutting engagement of sabot cone 170 to subcaliber projectile 140 preferably does not provide any substantial positive connection to prevent axial displacement of subcaliber projectile 140 forwardly relative sabot means 170, nor of sabot cone 170 rearwardly relative subcaliber projectile 140. Indeed, as was mentioned above, prior to loading, subcaliber projectile 140 and sabot cone 170 may naturally tend to disengage and fall apart if not externally supported or constrained against each other, even when they have essentially no forward velocity at all. Upon exiting muzzle 120-6 at the completion of launch acceleration, on the other hand, subcaliber projectile 140 and sabot 170 may each have a very substantial forward velocity. Furthermore, since subcaliber projectile 140 is advantageously of an elongate, slender shape with a relatively small frontal profile, sabot means 170 (which is following behind with a preferably relatively much larger frontal profile) will advantageously have a substantial portion of its lateral area immediately exposed to and directly acted upon by atmospheric drag. Relative to subcaliber projectile 140, sabot cone 170 advantageously has a comparatively very light mass and very low sectional density, with the result that atmospheric drag will cause sabot means 170 to decelerate much more rapidly than subcaliber projectile proper 140, thereby actuating separation of sabot cone 170 from subcaliber projectile 140 so that discarding of sabot cone 170 occurs and subcaliber projectile 140 continues alone and unhindered to travel along its external trajectory. Thus it may be appreciated that the substantial lack of positive connection, as described above, of sabot cone 170 to subcaliber projectile 140, once they are removed from the influence of any external connecting means and sabot cone 170 is no longer positively urged by launching thrust against the inertial mass of subcaliber projectile 140, results in a very quick, clean separation and discarding of sabot 170, with substantially little or no transmission of drag, impulse, torque, or other perturbations from sabot means 170 to subcaliber projectile 140 during the discarding process.

Not illustrated: Some notes on a do-it-yourself version/embodiment similar to the embodiment depicted in FIGS. 22-43 will be included further below in the section on alternate embodiments.

FIGS. 44-46 depict another embodiment of my blowgun chosen for detailed description to help illustrate the wide range of applications to which my invention is suited, and also because this embodiment is also well suited for adaptation as a do-it-yourself kit, as will be described in more detail in the section on alternative embodiments. The embodiment depicted in FIGS. 44-46 comprises blowgun 110 with associated subcaliber projectile 140 and associated sabot means 170.

FIG. 44 is a side elevation view of blowgun 110 with subcaliber projectile 140 and sabot means 170 in loaded position within blowgun 110.

FIG. 45 is a perspective view of subcaliber projectile 140 and sabot means 170, both of which are advantageously adapted to cooperatingly abbutingly engage each other to form sabot projectile assembly 190 during any or all of certain stages in the handling, loading, and launching sequence. FIG. 45 shows projectile 140 and sabot 170 as they may appear during the early stages of sabot discarding shortly after exit from muzzle 120-6 at the completion of launch acceleration.

FIG. 46 shows an exploded perspective view of blowgun 110, with projectile 140 and sabot 170 depicted as they may essentially appear in the initial orientation of travel along their respective external trajectories or paths, shortly after exit from muzzle 120-6 at the completion of launch acceleration.

FIGS. 44-46, continued. Blowgun 110 includes substantially elongate barrel 120, detent means 200, and, optionally, mouthpiece 130. Optional mouthpiece 130 is shown affixed to breech end 120-3 of barrel 120. Barrel 120 is provided with breech opening 120-2, muzzle opening 120-6, and substantially straight, elongate bore 120-4 which communicates between breech opening 120-2 and muzzle opening 120-6. Sabot means 170 in this embodiment comprises essentially solid cylindrical sabot 170. Cylindrical sabot 170 is preferably composed of resiliently compressible open cell foam, advantageously composed of plastic or rubber. Cylindrical sabot 170 preferably is transversely sized and shaped to be loosely slidably sealable with bore 120-4. Cylindrical sabot 170 preferably has some longitudinal dimension, or longitudinal axial length, somewhat greater than the caliber of bore 120-4, in order to tend to prevent sabot 170 from tumbling sideways or end-over-end during travel down the bore during launch. Subcaliber projectile 140 in this embodiment comprises a steel BB shot of the general type commonly used in 177 caliber or other caliber mechanical airguns. Accordingly, the caliber of barrel bore 120-4 in this embodiment may be considered to preferably fall into a smallbore range of calibers, preferably generally in the range from 25 caliber to 35 caliber. Somewhat smaller or larger calibers may be used. Barrel 120 may advantageously be supplied in this embodiment by a portion of a stock tubular arrow shaft of the kind used in archery and commonly made of aluminum or carbon fiber. Detent means 200 comprises a magnetic projectile detent 210 and sabot detent 220. Projectile detent 210 in this embodiment comprises doughnut-shaped or ring-shaped magnet 210 affixed externally to barrel 120 or to optional mouthpiece 130, preferably near breech 120-2. Sabot detent 220, in this particular muzzle-loading embodiment of blowgun 110, comprises narrow crossbar 220 affixed essentially within and extending transversely within and across bore 120-4, preferably near breech 120-2. Barrel 120 is provided with two small holes near breech 120-2, with holes cooperatingly sized and shaped for snug insertion therethrough and affixing therein of detent crossbar 220; additional or alternative means of affixing or securing crossbar 220 in place will be apparent to one skilled in the art. Magnetic detent 210 advantageously generates a sufficiently strong magnetic attraction upon projectile 140 to thereby hold projectile 140 in place in loaded position either against the inner surface of barrel bore 120-4, or against the forward end of sabot means 170, or both.

It will be apparent to one skilled in the art that in certain embodiments magnetic detent 210 need not necessarily comprise a ring-shaped or donut-shaped magnet, and that projectile detent 210 in certain embodiments need not be positioned along barrel 120 between sabot detent 220 and breech 120-2. It will be apparent to one skilled in the art that projectile detent 210, or sabot detent 220, or both, may alternatively be affixed to or affixed within cooperating portions of mouthpiece 130, and in certain such embodiments, when mouthpiece 130 is affixed to barrel 120, magnetic detent 210, or sabot detent 220, or both, would be positioned beyond, or behind, breech 120-2, or in other words, magnetic detent 210, or sabot detent 220, or both, would be positioned so as to not longitudinally overlap barrel 120 in respect to the longitudinal axis of barrel 120. Accordingly, depending on the specific embodiment, sabot detent 220 or projectile detent 210 or both may be affixed to, or integral with, either barrel 120, or additionally or alternatively mouthpiece 130, if optional mouthpiece 130 is used in the particular embodiment. If both sabot detent 220 and projectile detent 210 are affixed to or integral with mouthpiece 130, then projectile detent 210 may in some such embodiments be positioned closer to the air inlet end of mouthpiece 130 than is sabot detent 220. Thus certain suggested embodiments, of the BB-launching sabot projectile blowgun under consideration, exemplify some of the possible alternate relative positioning of elements of detent 200 such as projectile detent 210 and sabot detent 220.

FIGS. 44-46, continued. To load sabot 170 and projectile 140 into blowgun 110, the user may according to one possible method of use hold barrel 120 with bore 120-4 tilted muzzle upward, preferably with barrel bore 120-4 substantially vertical. The user may then sequentially load the components of sabot projectile assembly 190 by inserting foam cylinder sabot 170 into and through muzzle 120-6, and then inserting BB shot 140 into and through muzzle 120-6. The fit of sabot 170 within bore 120-4 is preferably loose enough that the weight of BB projectile 140 pressing downwards on top of sabot 170 is sufficient to make the sabot 170, along with the other components of sabot projectile assembly 190, slide down bore 120-4 until the rear end of sabot 170 engages crossbar detent 220. If necessary, optional means, such as a ramrod, or a weight on a string, or other suitable means, can be used to push against or add weight on top of sabot 170 or sabot projectile assembly 190 and thereby force sabot 170 or sabot projectile assembly 190 to slide down bore 120-4 to engage crossbar 220. When sabot 170 engages crossbar 220, and projectile 140 forwardly engages sabot 170, so that sabot projectile assembly 190 assumes a loaded position, projectile 140 should be close enough to magnetic projectile detent 210 that steel BB shot 140 is within the influence of the magnetic attraction exerted by projectile detent 210. The attraction between magnetic detent 210 and BB shot 140 may thereby keep BB shot 140 pressed firmly against sabot 170, with sabot 170 in turn kept firmly pressed against sabot detent crossbar 220, even when barrel bore 120-4 is reoriented away from the vertical, or otherwise uptilted, position advantageously assumed during loading. BB shot 140 may or may not be in contact with the inner surface of bore 120-4 when held in this manner against the sabot 170.

FIGS. 47-51 depict an embodiment of my blowgun which comprises blowgun 110 and optional full caliber projectile 600. Blowgun 110 comprises substantially elongate barrel 120 and optional mouthpiece 130. Barrel 120 is provided with breech opening 120-2, muzzle opening 120-6, and substantially straight, elongate bore 120-4 which communicates between breech opening 120-2 and muzzle opening 120-6.

Bore 120-4 is provided with guidance means 500 disposed in or on the inner surface of bore 120-4.

FIG. 47 is a perspective view of blowgun 110, partially cut away at and near breech 120-2 and mouthpiece 130 to show optional projectile 600 in loaded position within bore 120-4 near breech 120-2. The inner surface of bore 120-4 is provided with guidance means 500. In this embodiment, guidance means 500 comprises elongate, essentially straight groove 500. Groove 500 is advantageously cross-sectionally sized and shaped to engage with some cooperating portion of projectile 600 in such a manner that the cooperating portion of projectile 600 may be guided by groove 500 during launch.

FIGS. 48 and 49 are, respectively, assembled and exploded perspective views of optional full caliber projectile 600. Projectile 600 comprises forwardly disposed foreshaft means 630, rearwardly disposed piston mean 610, and intermedially disposed shaft means 620. Projectile 600 advantageously has a forward-of-center balance. Foreshaft 630 advantageously has a relatively high linear density, and shaft 620 advantageously has a relatively low linear density. Shaft 620 is advantageously somewhat flexible, especially resiliently flexible. It is within the ability of those skilled in the art to determine the dimensions, relative proportions, and material composition and structuring of shaft 620, foreshaft 630, and piston 610, in order that the resulting mass distribution of projectile 600 may result in an overall balance of projectile 600 that will enhance in-flight stability of projectile 600, and in order that shaft 620 may advantageously be sufficiently long, light weight, and otherwise so adapted as to serve as an effective primary or supplementary means of applying aerodynamic stabilization to projectile 600 during flight along an external trajectory or flight path after launch. Piston 610 comprises a conical frustum shell provided with a forward opening preferably cooperatingly sized and shaped to frictionally engage the rearward portion of shaft 620 when the rearward portion of shaft 620 is inserted into the forward opening of piston 610. Foreshaft 630 advantageously has a rearwardly disposed portion cooperatingly sized and shaped to insert within and frictionally engage with the forward portion of shaft 620. It will be apparent to those skilled in the art that optional connecting means may be used to enhance or make permanent the engagement or connection between piston 610 and shaft 620, and additionally or alternatively, to enhance or make permanent the engagement or connection between foreshaft 630 and shaft 620. Piston 610, shaft 620, and foreshaft 630 are advantageously so adapted as to be substantially coaxially aligned when mutually engaged or mutually connected as a unit to form projectile 600.

FIG. 50 is a side elevational view of blowgun 110 with optional projectile 600 loaded inside bore 120-4 near breech 120-2, with the cooperating portion of projectile 600 resting in and engaged with groove 500. FIG. 51 is a sectional view along section line 51-51 from FIG. 50, somewhat enlarged to show in greater detail and clarity the cooperating portion of projectile 600 resting in and engaged with groove 500, and the cross-sectional shape of groove 500. It will be apparent to those skilled in the art that other cross-sectional shapes are possible for groove 500. It is within the ability of those skilled in the art to determine various cross-sectional shape and dimensions that will enable one or more portions of groove 500 to engage one or more cooperating portions of projectile 600 in order that groove 500 may thereby apply effective correctional guidance to one or more portions of projectile 600 during launch.

FIGS. 47-51, continued. Bore 120-4 is provided with elongate, preferably substantially straight groove 500 disposed in the inner surface of bore 120-4, with groove 500 preferably aligned substantially parallel to the longitudinal axis of bore 120-4, and with one end of groove 500 terminating open-endedly at muzzle opening 120-6 of bore 120-4, and with the other end of groove 500 terminating within a predetermined proximity of breech opening 120-2 of bore 120-4, with the distance of the aforementioned proximity to breech opening 120-2 preferably being somewhat less than the length of optional full caliber projectile 600, and groove 500 being advantageously further adapted to receive and slidingly engage a cooperating portion of projectile 600 in such a manner that the cooperating portion of projectile 600 may be guided along groove 500 in a predetermined path defined by one or more portions of the surfaces of groove 500, in such a manner that the cooperating portion or portions of projectile 600 may be guided by the cooperating portion or portions of groove 500 along a substantially straight line path which preferably is substantially parallel to the longitudinal axis of bore 120-4, whereby the cooperating portion or portions of projectile 600 may move through bore 120-4 with decreased tendency towards tipping, inbore balloting, and other internal ballistic path and orientation dispersions, and whereby projectile 600 may be launched with improved internal ballistic stability and improved consistency.

Additional Comments Regarding the Embodiment Depicted in FIGS. 44-46 and Suggestions about Related Alternative Embodiments It will be apparent to one skilled in the art that by decreasing the diameter of the inner opening of ring-shaped or doughnut-shaped magnet 210, it would be possible in certain embodiments to position magnet 210 directly against or sufficiently near breech opening 120-2 of barrel 120 so that the one or more portions of magnet 210 itself would essentially define one or more portions of an annular shoulder adapted to abbutingly engage sabot 170, in order that magnet 210 itself might serve double-duty as both projectile detent 210 and sabot detent 220, or in other words as detent 200. It will also be apparent that in certain embodiments magnet 210 may be shaped and otherwise so adapted as to also, or alternatively, serve as a mouthpiece. Alternatively, if embodied as a sufficiently small yet powerful tubular or sleeve-shaped magnet, magnet 210 could be inserted inside bore 120-4 and thereto affixed, preferably near breech 120-2, in order that one or more portions of magnet 210 would thereby essentially provide or define one or more portions of an internally mounted annular shoulder to serve double-duty as both sabot detent 220 and projectile detent 210, or in other words as a single-element detent 200. In certain embodiments, a crossbar detent may itself be a magnet or be magnetized by contact with a separate magnet. In certain embodiments, a crossbar or forwardly-extending protrusion affixed to or integral with the crossbar may be adapted to insert through an opening pierced longitudinally through the sabot, so that the crossbar or crossbar extension may thereby directly engage mechanically or magnetically or in other suitable manner with some portion of the subcaliber projectile. In certain such embodiments in which the subcaliber projectile is elongate and held in a loaded position at an angle to the longitudinal axis of the barrel bore, the crossbar or extension or both may advantageously be hinged or flexible or rotatably mounted in such a manner as to be able to pivot or yield to allow the subcaliber projectile and sabot to disengage smoothly with minimal resistance at the commencement of launch. In certain such embodiments, such a crossbar extension may even, for example, extend through a suitably adapted sabot, and within and through a hollow shaft, to engage some portion of a suitably adapted foreshaft, or other appropriate cooperating portion of the projectile. Alternatively, in certain embodiments the sabot may be provided with a hollow inward portion communicating between openings in the front and rear ends of the sabot, with a portion of the hollow portion advantageously forming a forwardly facing socket in the forward end of the sabot, so that when the projectile is engaged with the sabot, a rearward portion of the projectile protrudes into and through the hollowed sabot portion and extends therethrough rearwardly past the rear end of the sabot so that some portion or portions of the rearwardly protruding projectile rear portion may engage with one or more cooperating portions of an appropriately adapted projectile detent.

In a possible alternative embodiment of the BB shot-launching sabot blowgun illustrated in FIGS. 44-46, the magnetic detent may be positioned along the barrel between the sabot detent and the muzzle end of the barrel, and so positioned and oriented as to attract and hold the BB shot in place against the inner surface of the barrel bore, or alternatively in certain embodiments to possibly hold the BB shot in place against the inner surface of some forwardly extending rim of the sabot. When considering certain embodiments it is apparent that it may not be necessary that the BB shot and sabot should be in direct abutting contact prior to the commencement of launching acceleration. Rather, as long as the BB shot and an appropriately adapted sabot (such as the foam cylinder sabot illustrated in FIGS. 44-46) are confined within reasonable proximity to each other, at the commencement of launching acceleration the sabot may move forward to engage the BB shot and thereupon assume the abutting relationship with the BB shot which allows the sabot to efficiently transmit thrust to the BB shot. It also may not be necessary in certain embodiments for the sabot to be in direct contact with the sabot detent prior to the commencement of launch acceleration. In such embodiments the sabot detent may possibly merely serve to prevent or resist further breechward movement of the sabot in the event that the sabot happens to move rearward far enough to come in contact with the sabot detent, and the sabot detent may also possibly serve double-duty as an anti-inhalation safety means to prevent the preferably lightweight sabot from being sucked out the breech by the user. Again, the type of foam cylinder sabot illustrated in FIGS. 44-46 is one type of sabot appropriate for such embodiments, since such a foam cylinder sabot may simply rest in place on top of the inner surface of the bore, especially if the bore is oriented substantially horizontally. In fact, such an embodiment may be entirely functional without a sabot detent, however inclusion of the sabot detent may still be advantageous in that the detent may also may serve double duty as either a primary or redundant anti-inhalation safety means to prevent the lightweight sabot from being sucked out the breech by the user. Also, in certain embodiments it may be advantageous to keep the BB shot and the sabot in direct abutting contact while in loaded position up until launch, in order, for example, to reduce any tendency of a compressible foam sabot to ride up over or past the BB shot during launch.

BB-launching sabot projectile blowguns may also be adapted to be breech-loading rather than muzzle-loading, as will be apparent to one skilled in the art after having reviewed FIGS. 22-43 with their accompanying descriptions.

It will be apparent to one skilled in the art that the embodiment depicted in FIGS. 44-46 may be used as a basis for alternative embodiments suitable for launching various types and sizes of spherical projectiles, or other substantially non-elongate projectiles, other than BB-shot.

It will be apparent to one skilled in the art that in addition to the type of foam cylinder sabot described above, there are numerous alternative sabot embodiments suitable for use as sabots with BB shot and with other types of spherical or non-elongate projectiles, as well as with other types of projectiles. However, the type of foam cylinder sabot described above is particularly well-suited for application to a do-it-yourself kit because such foam sabots can be easily formed or made by the user according to the method described below.

Following is a description of a method of creating or forming the foam cylinder sabots for use in certain embodiments of the BB launching sabot blowgun, which is particularly well-suited for application to a do-it-yourself kit embodiment. In this method, the user uses a handheld, approximately quarter-inch hole punch, of the type commonly used in offices and schools, and which often operates in a manner similar to pliers. It may be necessary to modify the hole punch to allow it to open wider than is typical for use in punching paper. Some commercially manufactured hole punches are already available that allow wider opening of the jaws. The user may insert between the jaws of the hole punch a strip or sheet of preferably open cell rubber or plastic foam, with the foam strip or sheet preferably about 0.5 inch (one-half inch) thick (more or less), and then use the hole punch to punch a hole in the foam sheet. The foam will compress as the punch squeezes down, and after the punch action is completed, the cylinder-shaped piece of foam that was punched out should quickly spring back to shape from its temporary compression. A relatively easy-to-find source of such foam is self-adhesive foam weatherstripping seal; since such strips of weatherstripping foam typically have a removeable paper or film backing over a sticky self-adhesive side, the user can either leave the backing in place, or else replace the backing with a replacement layer of a different kind of paper, plastic, foam, or the like. The thin sheets of flexible craft foam, sold in hobby and craft stores, are one example of a type of suitable replacement layer material. The user may peel the backing off of a strip of the weatherstripping foam, apply the sticky side of the strip to a piece of the thin craft foam, and then use the hole punch to punch out one or more cylinders from the resulting composite foam sheet. It would also be possible to make larger hole punch tools, similar to the ones used for scrapbooking crafts, etc, that would punch out several foam cylinders with every punch action. It will be appreciated that a suitable barrel tube for the blowgun should be chosen so that the tube's inner diameter or bore caliber will be a good match, although preferably not too snug, for the foam cylinders produced by the hole punch. Or alternatively a hole punch of a suitably matching size for a particular bore caliber could be found or manufactured.

As was mentioned above, other types of sabots besides the foam cylinder sabots may be used with a BB shot projectile. One example of such an alternate type of sabot, that is still reasonably easy for a user to make by hand, is a conical shell sabot, sized at the base to substantially slidingly seal with the barrel bore, and truncated sufficiently near the tip to leave a forward opening somewhat smaller in diameter than the diameter of the BB. The BB may be partially inserted into the forward opening of such a truncated sabot cone to engage the annular shoulder defined by the rim of the opening. The fit of such a truncated conical sabot may possibly or more easily be made somewhat more precise or snug in the bore than with the foam cylinder sabot, since there would be a smaller area of surface contact (and accordingly reduced friction) with the cone than with the cylinder. This possibly more precise fit and smaller area of surface contact may in turn yield higher velocities, although such a conical shell sabot may be more time consuming to make by hand than the foam cylinder sabots described above. Incidentally, such a truncated conical shell may alternatively be glued to or otherwise affixed to a BB shot as a convenient way to make a full caliber projectile.

It will be apparent to one skilled in the art that foam cylinder sabots or truncated conical shell sabots may easily be sized and shaped to use with subcaliber spherical projectiles of sizes other than BB shot sizes, and that both types of sabots, or suitable equivalents, as well as many other alternative types of sabots, may be commercially or mechanically manufactured rather than being made by hand by the user.

Additional descriptions of and notes on some alternative embodiments: The detailed descriptions above, accompanying FIGS. 1-43, contain comments that suggest or briefly describe some possible alternative embodiments of my invention. The principles of my invention will also suggest or make apparent to one skilled in the art numerous other alternate embodiments of my invention. Following are additional descriptions and suggestions of illustrative examples of some possible alternative embodiments of the invention.

The embodiment of sabot detent means 220, as described in the embodiment depicted in FIGS. 22-43, is well adapted to enable the embodiment of my invention depicted in FIGS. 22-43 to function effectively as a breech-loader. It will be apparent to one skilled in the art that the embodiment described and depicted in FIGS. 22-43 could also or alternatively be used as a muzzle loader, if necessary using a ramrod or weight on a string or other suitable means to push sabot projectile assembly 190 backwards down bore 120-4 from muzzle 120-6 until sabot 170 engages sabot detent 220. Some alternative embodiments of my invention could be intended for use strictly as muzzle-loaders, in which case any protrusions comprised by sabot detent 220 might possibly extend further transversely across, or even completely transversely across, bore 120-4 or breech 120-2, such as, for example, one or more narrow transverse crossbars, or a mesh screen, affixed across breech 120-2. Furthermore, the embodiment depicted in FIGS. 1-21 may also, if desired, be operated as a muzzle loader.

In the embodiment described and depicted in FIGS. 22-43, the illustrations depicted sabot detent 220 as comprising a single narrow ramp-like protrusion 220, affixed to or integral with and radially extending from the inner surface of bore 120-4 at or near breech 120-2, in such a manner that detent extension 220 is aligned lengthwise substantially parallel to the longitudinal axis of bore 120-4, with a sloped surface facing rearwards toward breech 120-2, and a shoulder surface facing forward towards muzzle 120-6. It will be apparent to one skilled in the art that sabot detent 220 might alternatively comprise a plurality of such ramp-like protrusions, or that each such of one or more protrusions or extensions might be shaped somewhat differently than the ramp-like form depicted in FIGS. 22-43, or that the shape, alignment, positioning, and orientation of any such protrusions or extensions might also be different than that specifically shown in FIGS. 22-43. It will further be apparent to one skilled in the art that there are numerous suitable alternative embodiments for sabot detent 220.

It will also be apparent to one skilled in the art that alternative embodiments are possible in which sabot detent 220 engages sabot 170 frictionally, or compressively, or both, rather than abuttingly. For instance, an example of such a type of alternative embodiment might comprise elements identical to those of the embodiment depicted in FIGS. 22-43, with the exception that sabot detent 220 would instead comprise a portion of bore 120-4, preferably near or at breech 120-2, that has been textured, or essentially slightly reduced in caliber, or both, in order to engage sabot 170 with an enhanced frictional grip, or a mild force fit, or both. Some such embodiments, that might possibly utilize one or more protrusions or extensions protruding inwardly from the inner surface of bore 120-4 in order to provide a section of essentially reduced caliber, could be used as either an abutting sabot detent 220, or as a frictional/compressive sabot detent 220, depending merely on method of use, or in other words depending on whether the user inserted the sabot into and partially through, but not past, the reduced caliber section (frictional/compressive), or else inserted the sabot completely through and past the reduced caliber section (abutting). Any such sabot detent 220, comprising bore sections that are textured or essentially narrowed or both, preferably near or at the breech, could be used to provide alternative embodiments that may be used either without projectile detent 210, in essentially the manner depicted in FIGS. 1-21, or alternatively with projectile detent 210, in essentially the manner described and depicted in FIGS. 22-43.

It will be further apparent to one skilled in the art that alternative embodiments are possible in which detent means 200 comprises projectile detent 210 but does not comprise sabot detent 220. One example of such an alternative embodiment is one in which sabot cone 170 is sized and shaped at its base to frictionally engage the unaltered, or in other words untextured and unreduced in caliber, surface of bore 120-4 with sufficient snugness to resist or prevent axial displacement of sabot 170 towards or out breech 120-2 when sabot 170 is loaded within bore 120-4 of barrel 120 prior to launch acceleration. It will be recognized that this is similar to the method of securing sabot 170 used in the embodiment illustrated in FIGS. 1-21, but that the degree of frictional engagement between sabot 170 and bore 120-4 would, in such an alternative embodiment, preferably be sufficiently strong not only to prevent or resist breechward displacement of loaded sabot projectile assembly 190 due to gravity, but also to prevent or resist breechward displacement of sabot projectile assembly 190 due to any magnetic backpressure possibly imposed by magnetic projectile detent 210, as was described above, or other possible backpressure due to other causes such as a possible spring tension bias due to the possible flexing of shaft 160 in embodiments in which shaft 160 is resiliently flexible.

It will also be apparent to one skilled in the art that alternative embodiments are possible in which blowgun 110 does not comprise detent means 200, or in other words comprises neither projectile detent 210 nor sabot detent 220. One such example was described and depicted in FIGS. 1-21. However, it will be apparent to one skilled in the art that alternative embodiments are possible which do not comprise detent means 200 and also, unlike the embodiment depicted in FIGS. 1-21, do not require the user to keep barrel 120 uptilted with muzzle 120-6 higher than breech 120-2. An example of such an embodiment could be obtained by taking the elements of the embodiment depicted in FIGS. 1-21 and replacing conical shell sabot 170 with a sabot comprising a lightweight foam cylinder sized to substantially match the caliber of bore 120-4. In such an embodiment, premature or excessive lateral or transverse dislocation of cylindrical sabot 170 relative subcaliber projectile 140 may be substantially prevented by the transverse travel limits imposed by the transverse dimensions of bore 120-4. Furthermore, in such an embodiment, sabot 170 and projectile 140, even if not continuously abuttingly engaged after loading insertion and prior to launch acceleration, could assume such an abutting engagement as launch acceleration commenced, provided they remained within reasonable proximity of one another prior to launch acceleration. Such a cylindrical sabot could be composed of either a relatively flexible, compressible foam such as foam rubber, or alternatively of a relatively rigid molded plastic foam. (Other suitable materials will be apparent to one skilled in the art.

Also apparent to one skilled in the art will be alternate sabot embodiments such as, for example, a hollow or partially hollow cylindrical shell open at either the forward end or the rear end; or if open at both ends, with a transverse inner partition located somewhere between the two ends.)

If compressible, such a cylindrical sabot 170 could be transversely sized so as to fit bore 120-4 slightly snugly. Whether slightly snug, slightly loose, or neither snug nor loose within bore 120-4, foam cylinder sabot 170 may have considerable resistance to premature displacement after loading, due to its relatively light weight, possibly somewhat rough texture, and fairly large amount of surface area in contact with the inner surface of bore 120-4. An elongate embodiment of projectile 140 would generally have less resistance than cylinder sabot 170 to premature displacement due to projectile 140 typically being embodied in a slender, smooth, slick-surfaced form. Yet, when bore 120-4 is leveled horizontally, projectile 140, of essentially the elongate type illustrated in FIGS. 1-43 above, would rest upon the inner surface of bore 120-4 without sliding, and would perhaps resist sliding even if bore 120-4 were to be slightly down-tilted, with muzzle 120-6 slightly below the level of breech 120-2, at angles still fairly close to horizontal (in such embodiments it may be advantageous for any foreshaft portion of the projectile not to be wider than the shaft portion, in order that as much of the length of the projectile as possible might be in direct contact and direct frictional engagement with the bore's inner surface). Furthermore, in embodiments in which cylinder sabot 170 fits sufficiently snugly within bore 120-4, sabot 170 could support itself and projectile 140 when barrel bore 120-4 is uptilted with muzzle 120-6 higher than breech 120-2, according to the essential method of use depicted in FIGS. 1-21. Accordingly, in such an embodiment, the user might possibly be able to orient blowgun 110 with barrel bore 120-4 up-tilted, horizontal, or perhaps even slightly down-tilted with muzzle 120-6 slightly below breech 120-2, without causing excessive premature displacement of sabot 170 and projectile 140, provided any manual handling and reorientation of blowgun 110 was sufficiently gradual and smooth. However, it will readily be appreciated that such an embodiment would very likely require relatively delicate and limited handling and maneuvering, and would probably be limited in situations in which it would be suitable for use, and to users with sufficient skill for such careful and controlled handling, when compared to the more flexible embodiment depicted in FIGS. 22-43. A similar embodiment, operating without detent means 200 and without up-tilted barrel, yet using a non-elongate projectile, could, for instance, use a foam cylinder sabot in cooperation with an essentially spherical projectile that has been provided with one or flattened facets upon which the projectile may rest upon the bore without rolling. Extensions or protrusions affixed to or integral with an elongate or non-elongate projectile, such as various types of fletching, may help to increase the projectile's resistance to prematurely sliding along and through the barrel bore when the barrel bore is tilted away from the horizontal.

It should be noted that some types of extensions or protrusions affixed to or integral with the subcaliber projectile, such as, for example, fletching or vanes similar to those used on archery arrows or throwing darts, could at the vanes' or extensions' lateral extremities or extreme lateral surfaces be substantially full-caliber; however, the frontal profile of a subcaliber projectile that included vanes with lateral edges substantially full caliber would still have a smaller area than the frontal profile of a full caliber projectile with an affixed or integral full caliber piston, and therefore could still be considered as a type of essentially subcaliber projectile. One or more flexible (preferably limply flexible) extensions, such as string or hinged fingers, could be affixed to or integral with a subcaliber projectile in such a manner as to allow the user to engage the sabot rearwardly against the projectile, draw the flexible extension/s tautly back and past the outer edge or edges of the full caliber portion of the sabot, and then insert the sabot projectile assembly thus formed into the bore so that the projectile's flexible extensions are pinched between the outer edge of the sabot and the inner surface of the bore, thereby creating a mild force fit or compression, with the pinched portions of the flexible extensions temporarily creating a sort of full caliber portion of the otherwise essentially subcaliber projectile. After launch acceleration and exit from the bore, any such flexible extensions would be released from being pinched between bore and sabot, with the sabot then being free to discard, and the flexible extensions free to swing to a position of reduced air resistance, trailing behind the main portion of the projectile.

Yet another example of an alternative embodiment which does not comprise detent means 200 and does not require the user to keep barrel 120 uptilted with muzzle 120-6 higher than breech 120-2, is one in which sabot 170 comprises a loosely formed fibrous mass, such as, for example, a wad of kapok fibers, or of polyester fibers, cupped around the rear end of shaft 160 and squeezed or force-fitted inside bore 120-4, so that radial compression imposed by bore 120-4 upon such a fibrous mass sabot 170 keeps sabot 170 gripped firmly in place by the inner surface of bore 120-4, and radial compression transmitted by such a fibrous mass sabot 170 to shaft 160 or other portion of projectile 140 in turn keeps projectile 140 gripped firmly in place by fibrous mass sabot 170. A slightly different version of such an embodiment could employ more than one fibrous mass, allowing some portion of subcaliber projectile 140 to be sandwiched between two or more fibrous masses, with additional fibrous masses used behind, if necessary, to form a pusher plug sabot component. It will readily be appreciated that such embodiments that rely on radial compression must be carefully calibrated to avoid an excessively snug force-fit of sabot 170 within bore 120-4 such as would impose too much launching resistance to be readily overcome by the breath of the user.

Furthermore, any such embodiments that use fibrous masses in the sabot means should preferably be used in cooperation with smooth contact surfaces on subcaliber projectile 140, since any rough projectile surfaces that could snag sabot fibers could accordingly cause failure of sabot 170 to discard cleanly, if at all. To ameliorate the risk of fiber snags, a smooth layer of paper, plastic, cloth, or foam could be glued to some portion of the fibrous mass to act as a snag-preventing interface with projectile 140. Alternatively, the fibrous mass or masses could be entirely replaced with one or more sections of a material such as compressible foam. Alternatively, cooperating sections of molded foam or plastic or other suitable material could be more precisely formed to cooperate with bore 120-4 and with some portions of projectile 140 in order to provide a slightly compressible or resiliently compressible sandwich carrier means for projectile 140. In order to provide adequate force-fit or radial compression, without unduly increasing the snugness of any sabot force-fit within bore 120-4, and any correspondingly increasing launching resistance, any such sandwich carrier sabot portions might be shaped so that compression would be applied by bore 120-4 only to limited portions of the carrier structure, and possibly also so that any such compressible or resiliently compressible portions would be able to move somewhat independently of non-compressed portions of the carrier structure, and possibly also so that the compressible or resiliently compressible portions would be provided with members or protrusions that would cooperate with indentations or notches in projectile 140 in order to help to lock projectile 140 in position relative the carrier sections as long as compression was applied. Any such sandwich carrier sabot components may optionally be provided with intermediary connecting members connecting the carrier sections to each other, or to an optional pusher plug component, or both. A somewhat different, yet related type of embodiment which utilizes mild compression, could include one or more sabot sections, which rather than functioning as carriers to support a portion of the projectile off of the bore's inner surface, would instead function as compression or restraining members to hold a portion of the projectile directly against the bore's inner surface, so that the sabot portion or portions are in effect fitted or squeezed side-by-side with a portion of the projectile within the bore, preferably snugly enough to resist or prevent premature displacement along the bore. Such an embodiment might benefit from an optional pusher plug structure rearwardly affixed to or integral with the compression portion of the sabot, with the pusher plug structure adapted to abuttingly engage some rearward-facing portion of the subcaliber projectile.

It should be noted that non-elongate projectiles, particularly spherical projectiles, may be used as subcaliber projectiles. One basic way to provide a sabot for a spherical projectile or other non-elongate projectile is to use a conical shell sabot sized at the base to substantially sliding seal with the barrel bore, with the conical shell truncated sufficiently near the tip to leave a forward opening somewhat smaller in diameter than the diameter of the spherical projectile, thereby making what we may term as a frustum shell sabot. The spherical projectile may be partially inserted into the forward opening of such a frustum shell sabot to abuttingly engage the annular shoulder defined by the rim of the forward opening.

Launching spherical or other non-elongate projectiles from a blowgun that was initially designed or adjusted to launch elongate projectiles suggests other general possibilities for alternative embodiments of my invention. When using, modifying, or designing a blowgun that was initially adapted to launch sabot projectile assemblies of a given length, should the user or designer wish to launch sabot projectile assemblies in which the projectile proper has a shorter length than that of one of the original projectiles for which the blowgun was initially adapted or adjusted, the user or designer has at least two options available: A first option is to use a sabot substantially the same length as the original sabot, with a resulting shorter total length of the sabot projectile assembly, and to accordingly adjust (shorten) the distance between the projectile detent and the sabot detent until the distance is sufficiently short to provide secure confinement of the shortened sabot projectile assembly. A second option is to use a longer sabot so that the total length of the sabot projectile assembly is still the same as, or close enough to, the length of the original sabot projectile assembly, to thereby allow the use of the original distance between the detent elements. Such a lengthened sabot could, for example, be simply a frustum or conical shell of lengthened proportions, or could, for example, be a relatively short main conical or frustum body with a forwardly extending, fairly rigid member. An illustrative, non-limiting example is a section of approximately quarter-inch soda straw forwardly affixed to a conical shell, so that the rim of the forward opening of the straw could abbutingly engage a three-eights inch diameter spherical projectile in order to launch it as a subcaliber projectile from a 62 caliber barrel bore. It should be noted that it would not be strictly necessary for the soda straw section to be affixed to the forward end of the conical shell; the mutual opposition of the projectile and sabot cone imposed by the antagonistic detent means could keep the soda straw section sandwiched between the projectile and the sabot while in loaded position, in which case the sabot cone and straw section would be free to separate from each other as well as from the projectile after exiting from the muzzle at the conclusion of launch acceleration. It will be apparent to one skilled in the art that many alternative embodiments are possible which follow the essential spirit of this illustrative example, without specifically using a conical shell and a tubular soda straw section, and it will be further apparent that alternative embodiments of sabot size, or detent positioning, or both, are possible which are intended to adjust for longer total length of the sabot projectile assembly, rather than for shorter total length of the same.

Furthermore, if a user or designer wishes to launch sabot projectile assemblies that are either shorter or longer than the length of the original sabot projectile assembly the blowgun was initially adapted or adjusted to launch, it will be apparent to one skilled in the art that embodiments are possible in which the detent means is further so adapted, or further comprises suitable connecting means so adapted, as to allow the projectile detent or sabot detent or both to able to be repositioned and/or re-oriented relative each other and the bore, and possibly reaffixed or re-secured in each new position and orientation, in order to accommodate and securely hold sabot projectile assemblies of varying lengths. Such detent connecting means might possibly be adjustable in either continuous or incremental fashion. Such ability to adjust positioning and orientation of detent elements also make it possible to accommodate projectiles in which the magnetically attractable projectile portion is dimensioned, or positioned within the projectile, differently than the positioning or orientation of such a portion within the original projectile the blowgun was initially adapted or adjusted to launch. Furthermore, such ability to adjust positioning and orientation of detent elements also make it possible to make adjustments to blowgun performance, such as initial launching resistance, according to user preference and ability, which vary from individual to individual, and which may change over time within the same individual due to the effects of training and practice or adoption of new techniques or methods of use.

Some Additional Notes on Certain Advantages, Alternate Embodiments, and Methods of Use In general, my invention provides a blowgun and associated projectiles which display improved performance in terms of range, trajectory, accuracy, velocity, and convenience and economy of use.

Some specific advantages and performance improvements, and certain alternative embodiments or suitable methods of use, provided by or made possible by my invention may include:

- In certain embodiments, use of the associated detent means has the additional effect of increasing consistency from shot to shot, thus improving accuracy potential.
- In certain embodiments, there may be a boost in exit velocities due to a slight but substantial delay effect, imposed by the associated detent means, which allows higher thrust pressures or earlier peak pressures to develop during launch acceleration.
- In addition to launching subcaliber projectiles, with certain embodiments of my invention the user may, with little or no adjustment, still use the blowgun to launch various types of full caliber projectiles. Furthermore, due to the detent delay effect mentioned above, exit velocities obtained with the full caliber projectiles may in some cases be higher than those obtained shooting the same full caliber projectiles from an otherwise comparable prior-art blowgun, and if the full caliber projectile is appropriately adapted, accuracy and stability may also be improved.

By removing the constraint that a portion of the projectile proper must serve as a full caliber piston, my invention introduces much greater freedom in designing the projectile so as to adjust or modify its properties such as form factor, mass, mass distribution, and configuration of aerodynamic surfaces in order to optimize one or more performance characteristics such as aerodynamic properties, accuracy, balance, stability, target penetration, and transfer of energy to the target. This freedom gives the user or designer much greater control in tailoring the performance of a projectile for any of a great variety of specific applications and methods of use.

My invention provides a number of specific exemplary subcaliber projectiles appropriate for use with the improved blowgun, and in particular a type of exceptionally streamlined subcaliber projectile which exhibits highly advantageous aerodynamic properties and balance characteristics which result in improved ballistic coefficient, increased range, flatter trajectories, improved stability and accuracy, while also providing better target penetration.

My invention further provides an example of such a type of subcaliber projectile which may have a substantially longitudinally elongate area of surface contact with the barrel bore during launch acceleration, and which therefore additionally exhibits improved stability as it traverses the barrel bore under acceleration and in which such improved internal ballistic properties may in turn yield consequently improved stability and accuracy as the projectile travels along its external trajectory. The principle may also be applied to provide a full caliber projectile with improved internal ballistic stability. It may be noted that due to the limited ranges at which prior-art blowguns are effective, accuracy problems caused by internal ballistic shortcomings may not have been as noticeable, or may have been considered to be within acceptable limits. However, at the extended ranges made possible by my invention, it becomes more significantly advantageous to reduce even small deviations or inconsistencies which would be more noticeably amplified over longer ranges.

In some embodiments, my invention provides an alternative or complementary strategy for improving internal ballistic guidance and stability of the projectile, by using a barrel provided with one or more substantially straight, longitudinal grooves or protrusions of the bore that are substantially parallel to the longitudinal axis of the bore and which cooperate with the projectile or projectile assembly to provide more precise guidance to the projectile or sabot projectile during its travel through the bore. Thus, certain embodiments of my invention make it possible to apply improved, more precise internal ballistic correctional guidance to the sabot projectile assembly as it travels through the bore during launch acceleration, which in turn provides greater stability and accuracy as the projectile travels along its external trajectory.

Thus, certain embodiments of my invention may achieve such improved internal ballistic guidance and stability of the projectile in at least two possible different ways, as were just precedingly described, and which may be used either independently or conjointly, as described in more detail elsewhere.

Certain embodiments of my invention, particularly embodiments which include longitudinal bore grooves or bore protrusions, may make it possible to reduce the area of bearing surface in contact between bore and projectile or projectile assembly.

Sabot projectile components, consistent with prior-art shooting tradition, and advantageously for the convenience and economy of the user, may in certain embodiments of my invention be so adapted as to be completely reusable and thus after launching may be retrieved and re-launched again and again, particularly in target shooting.

My invention, in certain embodiments, provides a type of target and associated method of target shooting highly suitable for use with the associated subcaliber projectiles, and which offers a wider variety of shooting methods or experiences to the user. Furthermore, the type of target and the method of shooting provided by certain embodiments make it possible for the user to substantially reduce the potential for damage to projectiles caused by impact with the target as well as by impact with other projectiles either already lodged in the target or subsequently launched at the target. Also greatly reduced is the time and effort, as well as the potential for damage to projectiles, associated with the process of retrieving the projectiles from the target. In brief, such a target may include a shoot-through target face which is adapted to be completely penetrated by the projectile. At a suitable distance, preferably somewhat greater than the length of the projectile, behind the target face, may be positioned a yielding, flexible or moveable backstop which may dissipate the impact of the dart without being penetrated, allowing the spent dart to either drop beneath the target assembly to an external collecting area, or else drop to a collecting area or structure contained within or built into the target assembly itself. Projectiles used with such a target typically have a substantially blunt forward end.

In many embodiments, my invention may achieve its functions without requiring any increase in snugness of fit, and requiring negligible, if any, increase in friction, between the barrel bore and the sabot projectile, when compared to the friction and snugness of fit between the barrel bore and a prior-art full-caliber projectile. Thus, using many embodiments of the improved blowgun and associated projectiles provided by my invention, a subcaliber projectile may be launched with either negligible or no loss of propulsive efficiency and accuracy in comparison to the propulsive efficiency and accuracy of a prior-art blowgun using full caliber projectiles. As will be seen, in certain embodiments my invention actually achieves improved propulsive efficiency, improved accuracy, or both, as compared to prior-art performance. Particularly, due to the flatter trajectories made possible by using subcaliber projectiles, most or all embodiments of my invention may be considered to achieve improved accuracy in the sense of providing improved ease in aiming, due to reduction in the amount of elevation compensation required when aiming, particularly at extended ranges. Furthermore, many embodiments also offer additional accuracy improvements in terms of consistency of shot placement due to improved stability and consistency of projectile launch and flight.

My invention generally achieves its functions and advantages through strategies or principles that operate independently of, and yet compatibly with, prior-art strategies or solutions for improving blowgun performance in terms of launching a projectile or projectile assembly of a given mass with improved velocity and accuracy. Thus, in addition to being used to provide a complete set including a blowgun with associated sabot projectiles, along with, if so desired, an associated target particularly suited for use with the blowgun and projectiles, my invention may alternatively be used to provide stand-alone solutions such as projectiles, sabots, kits, accessories, and targets that would allow a user, for example, to convert a pre-existing blowgun to launch subcaliber projectiles, or to build or assemble from scratch his or her own subcaliber blowgun, or to use pre-existing full caliber projectiles as subcaliber projectiles in a blowgun of larger bore caliber, or, for example, to allow resupply, repair, and maintenance of any of the complete or partial sets, or any of the stand-alone solutions, described or suggested above. It is accordingly desired that protection be provided both to complete sets, to partial sets, and to stand-alone solutions provided by my invention according to its details, spirit, or principles.

Certain embodiments of my invention may be provided with more than one barrel or barrel bore. In certain such embodiments, one of the included bores may have a larger caliber than the caliber of another of the included bores, thereby allowing the user the option to either launch a projectile as a full caliber projectile from the smaller caliber bore, or to launch the same or identical projectile, with the help of an appropriately adapted sabot means, as a subcaliber projectile from the larger caliber bore.

Certain principles of my invention may be used to provide improved full caliber projectiles, that exhibit, for example, improved balance, or increased ease of retrieval from a target, or to launch full caliber projectiles with improved inner ballistic guidance and stability. Improved target designs and strategies provided by my invention for reducing damage to projectiles may be applied to either subcaliber projectiles or full caliber projectiles. It is accordingly desired that protection be provided both to complete sets, to partial sets, and to stand-alone solutions that use such principles.

It will be apparent to one skilled in the art that my invention also makes it possible to efficiently simultaneously launch a plurality of subcaliber projectiles.

The principles of my invention may be applied not only to blowguns, but also, for example, to improve the performance and extend the possible uses of paintball guns and many other types of projectile launching devices. An example is the use of the sabot to transmit rifling spin from a rifled barrel without rupturing the paintball, which had previously prevented the use of grooved barrel rifling in paintball guns. Also, paintballs may be re-shaped or otherwise adapted to function as frangible elongate subcaliber projectiles, with suitable affixed stabilizer portion, for launch from my invention. My invention could also be adapted to launch non-frangible subcaliber projectiles from devices other than blowguns, even including firearms or artillery.

My invention's use, in certain embodiments, of discarding sabots with subcaliber projectiles makes it possible for the subcaliber projectile to engage the sabot asymmetrically, or in other words to engage the sabot at some point or region other than the region at and near, or essentially concentric to, the axial center of the sabot, or center of the front end of the sabot, without adversely affecting the aerodynamic performance or accuracy of the subcaliber projectile proper after sabot discarding occurs. My invention's use, in certain embodiments, of discarding sabots with subcaliber projectiles also makes it possible to use bores and correspondingly shaped and sized sabots whose cross-sectional shape is other than essentially that of a circular disk, without adversely affecting the aerodynamic performance or accuracy of the subcaliber projectile proper. Possible examples of other cross-sectional bore shapes, and matching cross-sectional sabot shapes, might include polygons or other plane closed figures, which could be either symmetrical or assymetrical. Such a bore might allow a variety of new construction techniques and materials for barrels, bores and sabots. Such a bore might also be so shaped that the cross-sectional shape in effect rotates upon the bore axis along the transition from breech end to muzzle end, with each point on the perimeter of the cross-sectional shape describing a helical path from breech end to muzzle end, in order to provide the essential effect of barrel rifling. Another example is a horseshoe-shaped or u-shaped cross-sectional bore, which could be used to provide a raised track for the projectile to travel upon, pushed by a correspondingly u-shaped sabot. It will be apparent to one skilled in the art that similar principles could be applied to provide sabots pre-shaped to engage a particular cross-sectional bore shape or essentially rifled bore, as well as to provide essentially fluted and possibly rifled surfaces on a preferably subcaliber portion of the projectile proper that would allow additional aerodynamic correctional guidance, possibly including aerodynamically induced stabilizing spin, of the projectile in flight.

Certain embodiments of my invention may allow efficient use of bore rifling in the blowgun barrel, generally by using sabots which are pre-graved or pre-shaped to cooperate with the rifled bore with minimal launch resistance, and to thereby stabilizingly spin pellets and paintballs, as well as elongate projectiles. Advantageous texturing of some portion of sabot, such as an optional projectile engagement socket, as well as urging of the accelerating sabot against the inertial mass of the pellet or projectile, may help to provide secure engagement to transmit rotational acceleration applied by barrel rifling.

Certain embodiments of my invention may improve internal ballistic stability by shaping the sabot asymmetrically, such as, for example, shaping the sabot with a slanted aft surface in order that launch thrust might consistently bias the sabot towards a certain side of the bore, thus reducing any tendency of the sabot to bounce from side to side within the bore during launch acceleration, which may be possible when using sabots with a slightly loose fit within the bore, as is typical of blowgun projectiles. After sabot discarding occurs, the asymmetric surface or shape of the sabot will not adversely affect the aerodynamic properties of the projectile proper.

In certain embodiments, the bore may be either tapered or flared for some portion of its length in order to provide either a choke effect or a loosening effect.

In certain embodiments, positive connecting means may be used to secure the sabot means and the subcaliber projectile together prior to loading the sabot projectile assembly into the blowgun barrel bore, to suit user preference or convenience in handling and loading. However, many embodiments of my blowgun will still be fully functional in terms of launching the associated sabot projectiles without the use of such connecting means. When such connecting means are employed, they may be disengaged during actual launch acceleration or exit, as described above, or alternatively, they may be so adapted as to be manually or mechanically disengaged prior to or during the loading process, so that the sabot means and subcaliber projectile, while loaded and in battery disposition prior to launching, have no direct positive connection, but rather a direct abutting connection or direct nestingly abutting connection as explained earlier. Parts which lock and unlock by snapping on and off or by twisting on and off are some examples of positive connecting means suitable for use in such embodiments. In some embodiments, disengagement of the connecting means may also be actuated by the resistance of the detent means against the sabot projectile assembly during loading or launch initiation, or by inertial resistance during launch initiation. For example, the barrel bore might include a short rifled section at or near the breech, adapted to engage the sabot and thereby twist the sabot during loading insertion, in order to disengage a threaded (or other type of twist-on/twist-off) connection between the sabot and the projectile. Such a rifling-twisted sabot might be easier to use with an optional insertion tool that included a sabot pusher member adapted to rotate independently of a handgrip member.

Certain embodiments which provide a positive connection between the sabot means and the subcaliber projectile may exploit the air pressure of launch thrust to actuate the disengaging of the positive connection or positive connecting means. For example, an internal, independently moving piston or bellows-flap style valve may be housed within the sabot and connected or linked to the positive connecting means or structures in such a way that the pressure differential supplied by the user's breath upon the internal piston or flap valve would provide sufficient force to displace the piston or flap along with the linked connecting means enough to disengage the connection. This type of pressurized disengaging actuation would be able to exploit much more total force than could be provided by atmospheric drag upon the sabot at typical blowgun projectile velocities. In some embodiments, use of a positive connection between the sabot means and subcaliber projectile, along with such means for pressurized disengaging actuation, might allow the blowgun and projectile to function without the use of an external detent to resist premature axial displacement of the sabot projectile components forwardly relative the bore. Alternatively, such a detent might be used to engage either the subcaliber projectile or the sabot means, or both, in order to create a slight delay effect to enhance the function of the pressure actuated disengagement mechanism, as well as to secure the sabot projectile assembly in place within the bore prior to launch acceleration. In such embodiments, it may not always be necessary to use a detent to secure the subcaliber projectile against forward displacement. Rather, the detent might only be needed to secure the sabot means in position within the bore, while the positive connecting means might secure the subcaliber projectile to the sabot means. In some embodiments, the inertia of some portion of the sabot projectile assembly or the frictional engagement of the sabot means with the inner surface of the bore might be sufficient, with no need for an external detent means, in order to provide the necessary resistance or delay in order to allow the disengaging mechanism to be actuated by air pressure. It would also be possible to employ pressurized disengagement actuation simply by shaping the sabot means, subcaliber projectile, and any connecting means, in such a manner that their alignment when engaged prior to launch acceleration will shift under the pressure of launch acceleration to a new alignment in which the positive connection is disengaged. Such an arrangement might necessitate an additional source of drag or impulse, such as an indentation, protrusion, or offset in the bore, or a detent means, preferably near the breech Again, such embodiments might be used with or without detent means, depending on if a delay effect were needed to enhance the disengagement actuation function. It should be noted that the means for positive connection may sometimes be a distinct structure from the sabot and subcaliber projectile, but in other cases may be an integral part or parts of one or both of the sabot means and the subcaliber projectile.

Other ways to actuate disengaging of a positive connecting means include using a component that is engaged by the barrel, breech, or mouthpiece in such a manner as to be pulled loose from the sabot projectile assembly and retained near the breech as the rest of the sabot projectile assembly is accelerated down the barrel bore. Also, the sabot or positive connecting means might be provided with a set of aerodynamic surfaces that exploit lift or atmospheric drag upon exit from the barrel bore to move somewhat independently of the body of the sabot proper, or to separate a sectional sabot body, and thus to pull the positive connecting means loose from its engagement or engagements. In particular, if the additional aerodynamic surface or surfaces exits the barrel prior to the sabot proper, and thus encounters atmospheric drag or lift prior to the sabot proper encountering atmospheric drag as the sabot projectile assembly exits the barrel bore, then the disengaging may take place while the sabot and main portion of the subcaliber projectile assembly are still being positively accelerated by launch thrust, greatly enhancing the disengaging function/action and allowing it to exploit higher levels of force or energy.

It should also be noted that in some embodiments of my invention, it may not be necessary for the subcaliber projectile and sabot means to be in direct contact or connection with each other during all phases of the loading and launching sequence. In some embodiments, the subcaliber projectile and sabot means may be loaded sequentially rather than simultaneously, and additionally or alternatively, rather than being directly abutting while in loaded position within the bore prior to launch acceleration, the subcaliber projectile and sabot means may simply be secured within reasonable proximity of one another.

Additional Notes on Advantages, Alternative Embodiments, and Methods of Use, Concerned Particularly with Improved Targets and Target Shooting Methods Certain embodiments of my invention may provide a type of target and associated method of target shooting highly suitable for use with the associated subcaliber projectiles. Furthermore, the target and method of shooting makes it possible for the user to substantially reduce the potential for damage to projectiles caused by impact with the target as well as by impact with other projectiles already lodged in the target or with projectiles subsequently launched at the target. Also greatly reduced is the time and effort, as well as the potential for damage to projectiles, associated with the process of retrieving the projectiles from the target. This represents a very important set of advantages of my invention and is highly in keeping with tradition, convenience, economy, and safety in light of the fact that blowgun projectiles, much like the arrows used in archery, are typically and traditionally intended to be reusable. Accordingly, after a round of shooting at a target, the user will typically retrieve the projectiles from the target where they have lodged, and begin the shooting process anew in which the darts that were retrieved are reused and shot again at the target.

Using the target provided by my invention greatly reduces the potential for damage to projectiles that is associated with prior-art practices of shooting projectiles at targets and retrieving projectiles from the targets, and furthermore reduces the amount of time and effort spent in retrieving projectiles from the target after a round of shooting. Other advantages of the target and method provided by my invention is that it makes possible a substantial improvement in the accuracy of assessment of shot placement on the target face, and makes possible a greater variety of target practice shooting styles and formats. Typically, targets according to prior-art usage operate in a manner comparable to certain targets used for archery. The target face is printed upon, or alternatively attached directly to, a backing that provides sufficient resistance during penetration to catch and hold the projectile. Such a target stops and holds the projectile, which remains lodged in, and usually protruding from, the target face until retrieved by the user. There are several ways in which this method of target shooting exposes the projectile to potential damage. The first is that the projectile lodged in the target face is susceptible to impact by other projectiles subsequently launched at the target, which may cause damage to one or both projectiles involved in the impact. This type of problem with impact between projectiles may also be encountered in archery target shooting. However, with blowgun projectiles, the full-caliber piston portion typically presents an even larger transverse area susceptible to hits than does the aft section of an arrow shaft with attached vanes or feathers. Furthermore, since blowguns are often used at shorter ranges than are bows and arrows, as the user's skill increases and tighter grouping is achieved, the rate of impact incidence may rise. The projectile components may be pierced, punctured, broken, or bent by such impacts, and even if still launchable, will normally no longer be accurate.

Another potential for damage occurs as the target catches, decelerates, and stops the projectile. If the target stops the projectile too suddenly, the mass of the full-caliber piston portion (which is typically positioned at the rear of the projectile), even if quite lightweight, may still have sufficient momentum, and especially lateral moment, to increase the flexing of the shaft beyond its elastic limit, resulting in permanent bending or kinking, or even breakage. Also, if the projectile is stopped too suddenly, the stabilizer may tear loose from or slide loose from its attachment to the rod, and move forward along the narrow rod, possibly damaging the stabilizer and forcing the user to take the time to slide the stabilizer back into position and attempt to reattach it in place Furthermore, the end of the rod, even if blunt, is still usually quite narrow; therefore if the stabilizer slides forward upon the rod a portion of the stabilizer may be punctured by the narrow rear end of the rod, and the grip of the stabilizer may be permanently loosened, so that it is no longer securely attached to the rod.

On the other hand, if the target does not stop the projectile quickly enough, penetration will be too deep and the typically rearwardly positioned piston portion will impact the target face. This may cause more damage to the target face, shortening target life. More importantly, the impact will often also damage the piston or else strip it loose backwards from the rod, so that the user has to find and retrieve the stabilizer and reattach it to the rod. Another potential for damage to the projectile occurs during the process of retrieving the projectiles from the target face. As mentioned before, the target must stop the projectile fast enough but not too fast. This, along with the fact that the rod is often very narrow and affords little surface area to be gripped by the target face, means that if the target has successfully caught and stopped the projectile, then the rod will be lodged very tightly into the target. The user, upon attempting to dislodge or pull the projectile from the target, must firmly grasp the rod, which however, in being very narrow affords little purchase for the user's grip. The user normally cannot grasp the piston to pull out the projectile, since this could either damage the piston or else strip it loose from the rod. The user must therefore either pinch the rod very tightly with his fingers and thumb, or else use a tool, such as pliers, to grip the rod and pull the projectile loose from the target. In either case, a rocking motion must often be employed to carefully work the embedded projectile loose, and care must be taken not to bend or break the rod during this procedure. This may cause discomfort to the user if using fingers, and in any case may cause lost time, extra exertion, and possibly fatigue, during the retrieval process. Even if reasonable care is taken, it is still easy to damage projectiles during such a retrieval process.

There is another disadvantage encountered with target shooting with prior-art full caliber projectiles, which is also associated with the tendency of projectiles lodged in targets to be impacted by subsequent projectiles. This tendency often makes it difficult to accurately assess and measure shot placement precisely. Even though hitting a projectile already lodged in the target may indicate tight grouping, and may for this reason be pleasurable to the user, it does not offer to the user, if so desired, the alternative to precisely map the point of impact of the projectile with the target face that would have occurred were it not for the interference of the intervening projectile.

The problems outlined above with prior-art targets and prior-art projectiles, may often be exacerbated when prior-art blowguns launching prior-art projectiles at higher velocities are used.

My invention offers several ways to eliminate or minimize the potential for damage to projectiles associated with target shooting.

First, by using subcaliber projectiles to shoot at a conventional target in which the projectiles lodge in the target face, the shaft and any additional stabilizing members present a smaller total area exposed to potential impact by subsequent projectiles, so that even with tight grouping the rate of impact incidence will be diminished substantially. Furthermore, the smaller lateral dimensions and lighter weight of the stabilizers used in subcaliber projectiles minimizes the bending forces that the stabilizer mass applies to the shaft during impact deceleration.

Second, the projectiles and the target itself may be adapted or configured in such a way as to completely eliminate the potential for damaging projectile-on-projectile impact. In such a target, the target face may be supported, or suspended, apart from and in front of an impact mat, preferably at a distance from the impact mat which is somewhat longer than the length of the projectile to be used. The projectiles launched at this type of target advantageously have a tip which is essentially blunt rather than sharp. The projectile completely penetrates the target face and travels on to impact the impact mat. The distance between the impact mat and the target face is preferably somewhat greater than the length of the projectile, in order that the projectile may have adequate clearance for complete penetration of the target face before impacting the impact mat. The impact mat is preferably adapted to yield under the projectile's impact and disperse the impact energy without being penetrated, and without causing the projectile to rebound back towards or through the target face. The spent projectile then drops to a collection area below. Impact mats might, for instance, be constructed of one or more layers of flexible, woven cloth that is preferably tightly woven, and strong enough and thick enough to resist penetration or tearing by the impact of the blunt projectiles, and preferably with sufficient weight to help to absorb the momentum and energy of the projectile. The mat might be suspended from its top edge, with the bottom edge hanging loosely and unattached. The impact mat might advantageously be provided with one or more pockets that allow insertion of removeable and replaceable pieces of impact resistant material to reinforce areas of the impact mat that are likely to be hit most often by projectiles. The target face might be paper, cardboard, paper mounted on cardboard, and the like. Thus such a target essentially comprises a target face, preferably completely penetrable by the projectile, suspended apart from and in front of an impact mat/backstop, preferably impenetrable by the projectile, with the target face and impact mat/backstop preferably separated by a distance somewhat greater than the length of the projectile. It will be apparent to one skilled in the art how to provide a suitable housing or frame structure in which to support or suspend the target face and impact mat/backstop. A redundant backstop structure may be advantageously suspended behind the impact mat/backstop in readiness for the event of a projectile unexpectedly penetrating the impact mat/backstop, such as due to structural or material failure of the impact mat/backstop.

Such an impact mat target may also be used with advantageously blunt-tipped full caliber projectiles, provided that the target face and any direct support of the target face may preferably be punctured completely without catching on or damaging the enlarged stabilizer portion of the full caliber projectile. However, the use of subcaliber projectiles, particularly very streamlined subcaliber projectiles, minimizes damage to the target face, extending target life, and making possible very precise assessment of shot placement. In particular, the blunted tip and foreshaft may be shaped in a manner so that the penetration produces a very clean, small hole in the target face, by essentially shaping the foreshaft or head with a section forwardly extending from the widest portion of the foreshaft and tapering to a blunt forward tip or end of somewhat smaller diameter than the widest portion of the foreshaft. Alternatively, the foreshaft or head may be shaped in such a manner to produce larger holes in the target face that are more visible at a distance, by essentially shaping the foreshaft with the widest portion, or a flared widest portion, substantially at the forward end or tip of the foreshaft.

Should the user desire to use sharp-tipped projectiles on such a total-penetration target face, but still minimize the potential for projectile-on-projectile impacts, then the impact mat might be replaced by a backstop adapted to be partially penetrated by projectiles in order to stop, catch, and hold the projectiles, but with the backstop further so adapted as to be moveable in relationship to the target face. An example would be a cylinder, drum, or disk, made of or surfaced with a material adapted to catch and hold the projectiles, and possibly shaped to form distinct facets. Such a cylinder, disk, or the like could be slowly turned or incrementally turned on an axis by motive means such as a motor, a spring, or by each succeeding impact force, or even a string or cable pulled on manually by the user, so that projectiles lodged in the backstop would be moved away from the area where subsequent projectiles were most likely or more likely to strike. Incremental turning of such a backstop could possibly be triggered or actuated by each succeeding impact force, possibly with a ratchet or escapement type of mechanism. Alternatively, such a revolving or rotating cylinder or disk, rather than being used merely as a backstop, could instead be used without a total-penetration target face, possibly with a separate target face attached directly to each of any facets or subdivisions of the cylinder or disk or other backstop.

My invention also offers another strategy for increasing ease of retrieval of projectiles lodged in a target, which may be applied to either full caliber or subcaliber projectiles. In this strategy, the projectile is purposefully so adapted that upon impact with a target, a portion of the projectile's energy is diverted or dispersed through interaction between components of the projectile, particularly when some rearward portion or member is allowed to move forward relative the rest of the projectile during impact, since for every action there must be an equal and opposite reaction. Such a dispersal of energy reduces the projectile's penetration of the target, so that the projectile is gripped less tightly by the target, and is easier to pull out. However, it does not require reduction in projectile velocity or energy in flight, nor does it require increased lateral area or other significant changes in form factor, therefore trajectory performance is substantially unaffected. This greatly reduces the time and effort needed to retrieve the projectile, and reduces wear and tear on the target as well. An example would be a projectile in which a component is purposefully adapted to frictionally engage the shaft in such a manner as to be able to slide forward along the shaft upon impact. Such a component might include the stabilizer portion of a full caliber or subcaliber projectile, or might be structurally distinct from the stabilizer portion, such as a tubular member adapted to somewhat snugly and slidingly fit around the projectile shaft. Alternatively, a component might slideably engage the foreshaft in a similar manner. After retrieval, the sliding or otherwise moveable component may be manually repositioned nearer the back of the projectile (or other original position) prior to launching the projectile at the target again. Another possibility is a shock-absorbing spring means that allows a rearward portion of the projectile to move forwards relative the forward portion and automatically restores the original position after impact, or in which the spring itself becomes the energy dispersal component. Another example is a piston inside a hollow shaft that slidingly engages the inner surface of the shaft, or possibly compresses or displaces air within the shaft upon impact, perhaps through a hole near the front of the shaft or a hole through the piston itself. Such energy-dispersing components are advantageously adapted to remain in fixed relationship relative each other and relative the other portions of the projectile during launch and during trajectory flight up until the moment of impact, in order to promote consistent projectile performance. It will be apparent to one skilled in the art that this strategy could also be adapted for application to other types of projectiles, such as full caliber blowgun projectiles, or such as archery arrows. Additional notes on advantages, alternative embodiments and methods of use, concerned particularly with improved blowgun performance in launching spherical projectiles and other substantially non-elongate projectiles Certain embodiments of my invention may provide much needed improvement in blowgun performance in launching spherical projectiles, such as various sizes and types of pellets and paintballs. Such embodiments could also be adapted to launch substantially non-elongate projectiles other than spherical projectiles. In order to appreciate the significance of this set of advantages it will be necessary to here include some additional review of prior art.

In firearms and artillery, full caliber spherical projectiles generally exhibit low sectional densities in comparison to full caliber cylindroconical projectiles or other elongate full caliber projectiles. In blowguns, however, since full-caliber elongate projectiles are not usually solid metal, but rather typically have an affixed full caliber piston composed of some lightweight material, it may often be the full-caliber spherical projectiles, such as paintballs or metal spheres, which have the greater sectional densities. In fact, such full caliber spherical projectiles may often be of a sectional density too high to be comfortably or efficiently propelled by the user's breath. If, on the other hand, a full-caliber sphere composed of a lighter material such as plastic, glass, or wood is used, the decreased sectional density will often adversely affect trajectory and accuracy. This is especially true since it is generally more difficult to apply aerodynamic correctional guidance to spherical projectiles, than it is to elongate projectiles.

Furthermore, typical methods of using barrel bore rifling to engage and impart stabilizing spin to spherical projectiles used in firearms would cause excessive launch resistance in a blowgun. Another challenge presented by spherical projectiles is that as caliber increases, volume, and therefore mass, increases at a faster rate than does the maximum cross-sectional area. Therefore, with spherical projectiles, thrust-to-mass ratio declines as caliber increases. This helps to explain why blowgun paintball pellets are more common in smaller calibers such as 40 or 50 caliber, rather than the larger 68 caliber paintballs often used in CO2 powered mechanical paintball guns. However, the lighter mass and lower sectional density of the smaller paintballs, although easier to accelerate to satisfactory velocities, also results in low muzzle energy and rapid loss of energy to drag, which may have negative impact on paintballs performing adequately in terms of rupturing sufficiently on impact with a target.

Another limitation with reducing caliber to obtain performance gains with spherical projectiles is that when caliber becomes unduly small, the flow of air from the user's lungs is excessively restricted by the small outlet, yielding poor or very poor acceleration and velocity, and possibly causing discomfort to the user. Thus, it is impractical for many users to use blowguns to launch small caliber spherical projectiles, such as the type of steel BB pellets used in mechanical airguns, as full caliber projectiles. However, my invention makes it possible to use a blowgun to efficiently launch BBs and other pellets, including paintballs, by launching them as subcaliber projectiles in order to obtain a higher thrust-to-mass ratio. Furthermore, certain embodiments of my invention may make it possible to use barrel rifling to impart spin to spherical and non-elongate projectiles, as well as to elongate projectiles, yet in such a way as to avoid excessive launch resistance. The rifling employed might either be recessed grooves in the bore, or else extensions or protrusions from the bore, or a combination of both, with the sabot provided with its own extensions or grooves or notches, as appropriate, sized, shaped, positioned, and oriented to cooperatingly engage the bore rifling. In this way, by using a pre-formed sabot that is already of the shape necessary to securely and smoothly engage the rifling, it is not necessary for the thrust of the user's breath to do the extra work of forcing the sabot onto the rifling with sufficient force to grave the sabot, which would likely cause excessive launch resistance and result either in low velocities or else in failure of the projectile to exit the bore. Use of such sabots would also make it possible to use barrel rifling to stabilize paintballs with spin transmitted through the intermediary sabot, rather than engaging the paintball directly with the rifling, which would prematurely rupture the frangible paintball. Additives such as ferrous particles, or alternatively, flexible magnetic tape or film, could provide ways to manufacture paintballs that are susceptible to magnetic attraction. Since it is within the ability of those skilled in the art to create parts of molded plastic and the like which are susceptible to magnetic attraction, it would also be possible to make paintballs in which any or all of the gelatin capsules, paint filling, or additional flexible structures incorporated therein are attractable by a magnet.

Suction is another method of securing sabots and pellets, such as paintballs, as well as other types of projectiles besides pellets, together in launch position. A mechanical detent disengaged by launch pressure could also be used to secure a saboted paintball in loaded position within the bore. Alternatively, a sabot might be shaped to sufficiently encapsulate a paintball or other subcaliber projectile so as to prevent the paintball from premature forward displacement relative the sabot, yet with hinged, flexible, or separating sections allowing the sabot to open up once clear of the bore and allow separation to occur.

Additional noted on certain advantages, alternative embodiments and methods of use, concerned particularly with improved internal ballistic correctional guidance applied to the projectile, resulting in improved stability and accuracy of the projectile:

Prior art blowguns typically provide substantial correctional guidance during launch acceleration to the typically aft-ward, full caliber piston portion of elongate projectiles by the guidance provided by the barrel or launch tube, which normally has a straight bore transversely sized and shaped so that the full caliber piston portion substantially transversely fills the bore. This arrangement does not absolutely preclude lateral deviations of the aft end or piston portion due to the typically requisite slight looseness of fit of the piston within the bore, but does typically limit such lateral deviations to small or very small distances. However, the forward end of the projectile, which is normally the forward tip of a slender rod, is usually the only point of contact between the bore and the rod, since the rod typically angles down from its point of attachment with or insertion into the center of the piston portion to rest upon the bore. This point of contact at the forward tip of the rod provides only a very small area of support contact with the bore, and thus very minimal direct guidance is applied to the forward end of the projectile by the bore during launch acceleration. This small, essentially non-elongate area of contact is usually the rod's only point of direct contact with the bore. This arrangement, in conjunction with the often slightly loose fit of the piston within the bore, typically necessary to avoid excessive friction, may leave some substantial play in the orientation of the projectile. Particularly, the forward tip of the rod may slide upon the bore and swing towards the left or right, or possibly even oscillate back and forth from side to side. The tip of the rod may also lift off the bore, due to play of the piston or to barrel curvature, such as that caused by gravity-induced sag, in which case no guidance is applied to the forward end of the rod unless contact with the bore is reestablished essentially by luck or happenstance. Thus the projectile may exit the bore and commence external flight without being initially aligned substantially parallel with the longitudinal bore axis or with the initial direction of travel.

The stabilizer portion of either a full caliber or subcaliber projectile may in many instances or situations be able to fairly quickly re-align a projectile with or parallel to the direction of travel, if the projectile does happen to exit the bore oriented at somewhat of an angle to the initial direction of travel. However, it may nevertheless be possible for the guidance efficiency of the stabilizer portion (particularly if the projectile does not have a particularly stable overall balance) to be temporarily compromised by either the initially slanted orientation of the projectile, or possibly as well by perturbations transmitted to the dart during launch. Such perturbations, which might be characterized as yaw, pitch, side-slip, or more complicated types of motion, we will refer to for simplicity's sake as rotational motion. Such slanted orientations or rotational motion or both may change the air flow behavior over the aerodynamic control surfaces of the projectile, thereby temporarily lowering their efficiency and slowing response time to correct deviations. Although the maximum possible total lateral displacement of the projectile's forward end during launch would seem to be relatively small, bounded by the transverse dimensions of the bore, the fact that any such displacement takes place during some portion of the very short length of time that it takes for the projectile to travel through and exit from the bore means that the projectile may acquire a rotational velocity or rotational moment which, although it may at first glance seem rather low, is nevertheless substantial enough to lower or compromise stabilizer efficiency. In extreme cases, tumbling end over end may result, however, even in mild cases when stability and orientation are quickly recovered, and the rotational motion is canceled or damped out, a deviation will already have been introduced into the trajectory at substantially the beginning of the trajectory, which means that the deviation may be amplified during substantially the entire external flight of the projectile.

Perhaps even more importantly, the deviations described above take place in an essentially inconsistent, non-repeatable, unpredictable fashion, since each projectile may exit the barrel bore with a different orientation and different rotational motion from the previous dart. However, accuracy in shooting generally demands as much consistency and repeatability from shot to shot as possible. Even substantial deviations, if they are reasonably consistent and repeatable from shot to shot, will result in tight grouping and thus may be compensated for during aiming to yield good on-target accuracy. On the other hand, inconsistent, non-repeatable deviations will remain unpredictable and defy compensation efforts.

My invention makes it possible to improve internal ballistic guidance and stability of the projectile in at least two possible methods. The first method relies on the fact that in certain embodiments which utilize a magnetic projectile detent, and in which the projectile includes a flexible shaft and a magnetically attractable foreshaft (or in certain embodiments some other magnetically attractable portion), the attraction of the magnetic detent pulls substantially the entire length of the foreshaft, along with any overlapping portion of the shaft, down upon or parallel to the inner surface of the bore, and parallel to the bore axis as well, thereby creating an elongate area of surface contact between the projectile and the bore. However, the consequent flexing of the shaft, as well as any possible play in the orientation of the sabot within the bore, allows the shaft to remain securely engaged by the sabot means. Alternatively, with either a flexible shaft or a rigid shaft, the sabot may be adapted to engage the shaft at a portion of the sabot that is nearer to or even adjacent to the bore surface, rather than at the center or axis of the sabot. The freedom to use assymetrical sabots without detriment to the aerodynamic properties of the projectile proper makes such an off-center engagement even more viable. Another possibility for achieving a similar projectile orientation is using a rigid shaft attached by a hinge or flexible intermediary member to a rigid foreshaft. It would also be possible in certain embodiments to achieve similar effects when using a mechanical projectile detent or other non-magnetic projectile detent, along with a projectile which might not contain a magnetically attractable portion.

When the foreshaft is pulled by the detent down upon or essentially parallel to the bore's surface, the elongate portion of the subcaliber projectile in contact with the bore's surface occupies an area of surface contact with the bore that is rather like a substantially elongate line segment or a slender rectangle, in contrast with the almost point-like, small, substantially non-elongate area of contact between the projectile's forward end and the bore's surface that is typical with many prior-art full caliber projectiles. Such an increased, longitudinally elongated area of surface contact (which may advantageously be substantially aligned parallel to the longitudinal axis of the bore) does not significantly increase launch resistance, but I believe that it does provide significantly increased resistance to side-to-side sliding or transverse displacement of the projectile or projectile forward end. I believe that in certain embodiments this effect may be amplified by the formation of a mild suction or mild adhesion between the foreshaft and any overlapping portion of the shaft in contact with the inner surface of the bore, as a result of the attractive pull between the detent and the foreshaft or other portion of the projectile susceptible to magnetic attraction. Furthermore, I believe that in certain embodiments the tension of the flexed shaft, along with the acceleration of the sabot against the inertial mass of the projectile, creates an oppositionally directed tension. I believe that such an oppositional tension tends to help the sabot and the forward portion of the projectile to keep each other slidingly anchored on the surface of the bore, consistently positioned upon a certain side of the bore, or in a certain substantially consistent position relative the cross-sectional shape of the bore, so as to follow a substantially straight line path along and through the bore, rather than bouncing around from side to side or top to bottom within the bore, during launch acceleration. I believe that in this manner, inertia countering acceleration, along with the flexing of the shaft, keeps the foreshaft slidingly anchored upon the bore surface even after the sabot projectile assembly breaks free of the detent's influence. Even if any such bouncing of the sabot should occur during launch travel, the flexibility of the shaft in certain embodiments may help to resist transfer of the bouncing motion to the foreshaft. Thus, it may be seen that certain embodiments which include a magnetic detent, and in which the projectile includes a flexible shaft and a magnetically attractable foreshaft (or in certain embodiments some other magnetically attractable portion), may provide greatly improved internal ballistic stability. It will be apparent to one skilled in the art that a similar effect may be achieved in certain alternative embodiments which use other types of detents, such as a mechanical detent, to pull an elongate portion of the projectile substantially flat against the surface of the bore while in loaded position. It will also be apparent that a similar effect can be achieved with a projectile that either does or does not have a flexible shaft or other flexible portion, by adapting the projectile and sabot to engage each other in such a way that the entire length of the projectile, or some substantially elongate portion of the length of the projectile, may lie flat upon the inner surface of the barrel bore, which in certain embodiments may require the projectile to engage the sabot asymmetrically rather than at the central region of the sabot's forward end.

My invention also provides another method by which improved internal ballistic stability may be achieved, and which may be used with projectiles with either flexible or rigid shafts. In this method, the barrel bore is provided with one or more substantially straight, longitudinally aligned guidance grooves or projections in or on the bore's inner surface, and which extend along substantially the full length of the bore and are substantially parallel to the axis of the bore. In general, each such groove or projection should extend all the way to the muzzle and be transversely open at the muzzle end. The groove or projection should preferably extend close enough to the breech end that, when the sabot projectile assembly is loaded within the bore, the tip or length of the foreshaft, or other cooperating portion of the projectile as appropriate, may rest in or against the groove or projection. If the guidance groove or projection does extend all the way to the breech end, it may be either open or closed at the breech end. Any such guidance grooves preferably should be of sufficient depth to provide adequate guidance to the cooperating portion of the projectile, and should be of sufficient width to allow the cooperating portion of the projectile to slide along the groove without any binding or excessive friction, yet any such groove should also be narrow enough to provide a precise degree of guidance to the cooperating portion of the projectile. Guidance grooves of various cross-sectional shapes might be employed, including grooves within grooves, or projections within grooves. Alternatively, the projectile may be provided with one or more extensions or protrusions, affixed to or integral with the forward portion or other suitable portion of the projectile, with any such projectile extensions adapted to engage cooperating guidance grooves or projections in the barrel bore. The sabot might also be provided with one or more extensions for cooperatingly engaging guidance grooves or projections of the bore. If the bore is provided with one or more longitudinal guidance projections, the projectile or the sabot or both may be provided with notches or grooves adapted to be cooperatingly engaged by the bore projections or to provide transverse clearance for the projections. Alternatively, the sabot may be adapted to be somewhat flexible or compressible, or may be sized somewhat smaller to fit the bore more loosely, in order to provide transverse clearance for any such guidance projections. A projection might also itself be grooved. An example would be a single longitudinally grooved longitudinal projection, which could be considered to be equivalent to two parallel longitudinal guidance projections, and which would essentially provide a track or channel for guiding some cooperating portion of the projectile, and which might possibly be used with a sabot means which is grooved, notched, or even of an essentially u-shaped or inverted-u-shaped cross-sectional shape, so as to provide transverse clearance for the guidance projection or projections. Longitudinally elongated projections or indentations of the bore might in certain embodiments also provide a means to further limit transverse bounce or play of the sabot, with only a slight increase in snugness of fit or friction with the barrel bore. In fact, use of such longitudinal projections, if deployed or configured correctly, could actually reduce bearing surface contact between the sabot and the bore, and thus reduce friction and launching resistance while increasing the precision of guidance of the sabot or stabilizer. It may be appreciated that the use of grooves or projections or a combination of both, as outlined above, could also be applied to launching full caliber projectiles with increased internal ballistic stability or reduced bearing surface contact, or both. Because the barrel with longitudinal bore grooves or protrusions provides enhanced internal ballistic performance and possibly reduced bearing surface whether used with full caliber projectiles or sabot projectiles, it is desired that protection be provided to this area whether used in conjunction with other features of my invention or used as a stand-alone solution, as is true also for the use of other features of my invention either conjointly, or individually in stand-alone applications.

Any such guidance grooves or projections in the barrel bore should advantageously be of sufficient transverse dimensions to provide sufficient surface engagement of the projectile and/or sabot to ensure adequate guidance, yet preferably with transverse dimensions small enough to limit any air seal losses as much as possible. Sabots might optionally be provided with extensions to substantially cooperatingly fill any transverse gaps within grooves or around or between projections, thereby keeping any air seal losses to a minimum. Guidance grooves or extensions might be transversely directed or aligned radially towards the axis of a bore with a circular disk-shaped cross-sectional shape, however such grooves or extensions would not have to be transversely aligned radially, and such grooves or extensions could also be used in bores with alternate (non-circular disk-shaped) cross-sectional shapes. For example, the grooves or extensions might be transversely aligned in a rectilinear horizontal and vertical fashion rather than in a radially aligned fashion, with transverse dimensions of extensions or grooves so adapted to provide a good cooperating fit for the projectile assembly. It may be appreciated that extensions of the bore surface, or of the projectile, would make it possible to use alternate bore cross-sectional shapes with little or no increase in the amount of bearing surface contact area and friction between the sabot and the bore. This is important because a circle encloses a given amount of area with the minimum perimeter possible. Thus using a different cross-sectional shape for the bore (other than a circular disk) would otherwise normally result in an increase in bearing surface and friction. Applying internal ballistic aerodynamic effects to the sabot projectile assembly during launch, such as aerodynamic lift, ground effect lift, and spoilers might also be more easily employed with bores of alternate cross-sectional shapes. Fairly rigid skeletal structures which support thin film membranes to provide sabots or pistons might in some embodiments be more easily adapted to fit bore cross-sectional shapes that have substantially straight sides rather than circularly curved sides.

Any longitudinal guidance groove or projection in the bore, along with cooperating portions of the projectile or sabot or both, may also possibly be further adapted so as to resist any tendency of the cooperating portion of the projectile to lift up and away from secure contact with the guidance groove or projection. An example would be a longitudinal guidance groove with a longitudinal overhanging lip at the top edge of one or both sides of the groove, so that the transverse gap between the overhanging lips/edges is somewhat narrower than the transverse width of some portion of the groove beneath the overhanging lips. Such a modified guidance groove might be used in conjunction with a projectile in which, for example, a portion of the forward end is sized to slide easily through the widest transverse portion of the groove, yet is too wide, after being inserted into the breech end opening of the guidance groove, to lift vertically through the narrower gap defined between the overhanging lips of the groove. If necessary, the projectile might also be provided with a portion narrow enough to pass through the gap between the groove lips and connect with a fixed piston or a sabot. Alternatively, the entire length of the projectile might rest within the groove beneath the overhanging lips, and a sabot be provided with an extension narrow enough to pass through the gap between the groove lips and rearwardly engage some portion of the projectile.

In certain embodiments, the depth or height of a guidance groove or protrusion might be selectively varied along its length in such a way as to offset any tendency of the barrel and bore to sag under the pull of gravity. It will be apparent to one skilled in the art how to vary the depth or height of a guidance groove or protrusion in such a manner that when the barrel or bore sags under the pull of gravity, the guidance groove or protrusion compensates for any sag to define a substantially straight line path along the appropriate dimension.

Overview and Summary of Some Advantages

My invention makes it possible to use sabots with subcaliber projectiles, which, in comparison to a reference full caliber projectile, therefore:

1. Makes possible higher sectional density, and
2. Very streamlined form factor, thereby yielding
3. Increased ballistic coefficient;
4. and also, within practical limits, makes possible higher thrust-to-mass ratios, by either:
5. Decreasing the subcaliber projectile mass, or
6. Increasing the caliber bore, or
7. Both.

It may be noted that any of the three possibilities described in numbers 5, 6, or 7, directly preceding, may be done in such a manner as to provide a subcaliber projectile which still has higher sectional density than a reference full caliber projectile, after discarding of the sabot occurs, as long as the subcaliber projectile's mass is not excessively reduced in comparison to the controlled mass of the reference full caliber projectile.

Certain embodiments of the blowgun and sabot projectiles provided by my invention may exhibit highly desirable performance characteristics when compared to reference full caliber blowgun projectiles, such as any or all of the following: Subcaliber projectile characteristics such as higher thrust-to-mass ratio, higher sectional density, more streamlined form factor, higher ballistic coefficient, and reduced drag may translate into one or more performance advantages such as, for example, increased exit velocity, flatter external trajectory, and more energy and velocity retained down range. Flatter trajectories in turn translate directly into increased accuracy, since the consequent reduction in vertical drop of the projectile, particularly at extended ranges, makes it easier for the user, when aiming, to compensate for the relatively small or decreased vertical drop, particularly at extended ranges. Increased velocity and/or reduced drag also yield extended maximum range and extended effective range. It is also believed that the forward-of-center balance and radial or lateral compactness of certain embodiments of the subcaliber projectile make such embodiments more stable and accurate in-flight than a typical full caliber fixed piston projectile, and less susceptible to deflection in-flight by wind. Furthermore, higher launch velocities and/or extended retention of velocity ensures stronger airflow over any aerodynamic control surfaces of the projectile throughout a greater portion of the trajectory when compared to a projectile with lower launch velocity and rapid decrease of velocity. Furthermore, accuracy may be improved by the consistency of positioning and orientation or alignment of the subcaliber projectile during each shot by the detent. I believe that the detent system positioning of the subcaliber projectile provides another unexpected benefit of my invention in terms of improvement in internal ballistic stability during launch acceleration, which translates into improved accuracy and stability of the projectile on its external trajectory. In addition to the consistent positioning and orientation, the temporary flexing of the flexible shaft in certain embodiments allows the detent's attraction to pull substantially the entire length of some elongate portion of the foreshaft, along with any overlapping portion of the shaft, substantially flat against the inner surface of the barrel bore, and thus aligned substantially parallel to the longitudinal axis of the bore, and consequently as well to the initial direction of travel along the projectile's external trajectory. I also believe that during lunch acceleration the push of the sabot and the inertia of the foreshaft keeps the shaft flexed and the forward portion of the projectile pressed against the bore's inner surface during the entire travel of the projectile through the bore during launch. This type of orientation and surface contact of an elongate portion of the projectile against the inner surface of the bore may result in an increased resistance to sideways movement of the forward end of the projectile during travel along the bore by applying a much greater degree of guidance to the forward end of the projectile during lunch acceleration, when compared to the minimal degree of guidance typically applied to the forward end of a typical prior art fixed piston full caliber projectile, in which (considering the forward end of the projectile only) only the tip of the forward end of a relatively rigid rod-like section of the projectile is in direct contact with the bore.

I believe that a similar effect may be achieved by adapting the sabot means to engage the subcaliber projectile in such a manner that substantially the entire length, or an extended portion of the length, of the subcaliber projectile may be positioned flat against the bore surface, in which case the subcaliber projectile's shaft could be either flexible or relatively rigid. Another way of enhancing the internal ballistic correctional guidance in some embodiments of my invention is to provide one or more substantially straight longitudinal grooves in the bore's inner surface, with the groove or grooves substantially parallel to the longitudinal axis of the bore. Such a groove would be advantageously cross-sectionally dimensioned so as to provide substantially precise guidance to the forward end of the subcaliber projectile or to the widest cooperating portion of the subcaliber projectile in contact with the groove, without binding or undue friction. The subcaliber projectile might be positioned resting in the groove in several ways, such as, for example, full length surface contact, with partial length contact of a forward section (with a flexed shaft), or with forward contact of substantially only the tip of the shaft or foreshaft, and in any of such cases, groove guidance may be applied to any cooperating portion or portions of the projectile.

The sabot may also be adapted to engage any such longitudinal guidance groove or grooves so that enhanced guidance is applied to control the orientation and position of the sabot as it travels down the bore. A similar effect may be obtained by providing the inner surface of the bore with two parallel longitudinal protrusions between which the forward portion or other cooperating portion of the subcaliber projectile may rest, and by which the projectile may be slidingly engaged and guided during launch travel down the bore. The sabot may, for example, be flexible, or sized slightly smaller, or notched, or some combination of such options, in order to allow the sabot to accommodately slip over any such longitudinal bore guidance protrusions during launch travel.

It will be readily apparent to one skilled in the art that the principles of my invention will lend themselves to application to provide numerous alternative embodiments. The embodiments with conical sabot and slender elongate subcaliber projectile with foreshaft and shaft described in FIGS. 1-51 above were chosen as particularly suitable illustrative examples because they function well, are versatile, and are also well-suited for a version of my intervention in which the user may assemble or make some or all of the components of the blowgun, sabots, and projectiles themselves. This kit approach will be explained further below.

Notes Mainly on Alternative Embodiments of the Sabot and the Projectile

A conical shell sabot, such as either of the ones included in the embodiments described above in FIGS. 1-43, may be molded from plastic or plastic foam, or rolled and trimmed from plastic film or paper that has been suitably treated to the water resistant. It could also be made from other materials, such as, for example, cardboard, or papier-mâché. Even when a conical shell sabot is formed by rolling flexible film or paper, a conical shell, in general, especially considering its light weight, allows excellent strength in the portion near the tip, which portion near the tip is in certain embodiments where the subcaliber projectile engages the sabot. A conical shell sabot could in certain embodiments be ported at the tip by truncating the tip slightly. Such a porthole could serve as an air pressure equalization passage to help prevent any tendency for a partial vacuum to form within the subcaliber projectile shaft due to the possibility of the sabot tip being pushed slightly deeper into the shaft, particularly if the rear end of the shaft might temporarily give or expand slightly under the strong forward push of the sabot during launch acceleration. Another way to prevent the formation of such a partial vacuum or suction between the subcaliber projectile and the sabot would be to provide pressure equalization ports through the foreshaft or through the shaft, or to provide grooves or corrugations in certain sabot and projectile surfaces, such as the forward surface of the sabot or in the rearward surface of the subcaliber projectile shaft, in such a manner that when the subcaliber projectile and the sabot are engaged, the grooves, corrugations, or ports allow pressure equalization airflow between external air and any airspace contained between and defined by the subcaliber projectile and the sabot.

On the other hand, a lightweight solid cone sabot could be molded from strong lightweight foam, for instance, preferably a relatively rigid type of plastic foam. Or conical sabots could be formed which combine solid portions with hollow shell portions.

Whether shell or solid, a conical sabot may, in some embodiments, advantageously be provided, at its tip or other forward facing portion, with a forwardly extending elongate slender protrusion. This slender protrusion might be molded or machined as an integral part of the sabot, or alternatively might be a distinct structure, such as a slender elongate plastic bristle, affixed to the sabot by means such as insertion through a cooperating hole through the sabot and securing therein by frictional engagement or glue. The slender protrusion is preferably substantially much narrower than the inner diameter of the subcaliber projectile shaft, so that when inserted inside the shaft, it encounters negligible frictional engagement with the inner surface of the shaft, and therefore encounters negligible resistance to sliding back out of the shaft. There are several uses for such a slender tip protrusion. One of them is in an embodiment of my invention in which, after the subcaliber projectile has been inserted into the bore and is held partially-loaded within the bore by the projectile detent before the sabot is inserted, the rear end of the projectile shaft is neither flush with, nor protruding past and out, the breech opening of the bore, but is rather in effect withdrawn a distance within the bore from the breech. Such a partially-loaded, withdrawn positioning of the subcaliber projectile may be necessary when using a magnetic detent in which the magnetic field is not of sufficient strength and dimension to securely engage the projectile foreshaft over a relatively wide range of motion. In some instances, a sabot cone without a slender tip protrusion could be used with such an embodiment in which the rear end of the partially-loaded projectile's shaft is not flush with or slightly protruding from the breech, without too much difficulty. Particularly as long as the rear opening of the partially-loaded shaft remains within a distance of the breech opening that is substantially less than the length of the sabot cone, it will often still be fairly easy for the user to insert the tip of the cone into the rear opening of the shaft without undue difficulty. Otherwise, however, it is often much easier for the user to first insert the tip of such a slender protrusion as described above into the rear opening of the shaft, so that the loosely penetrative engagement of the protrusion within the shaft will guide the tip of the sabot cone into the rearward shaft opening as the user continues to push the sabot forward. Or, if the user should choose use the essential method depicted in FIGS. 35-37, to load the subcaliber projectile and the sabot into the bore simultaneously rather than sequentially, a slender tip protrusion of sufficient length forwardly affixed to or integral with the sabot would allow the user at some point during the insertion process to loosen his manual hold somewhat to let the projectile be pulled into place by the magnetic projectile detent, temporarily breaking abutting engagement with the sabot, yet with a forward portion of the slender protrusion remaining within the projectile shaft to prevent excessive lateral dislocation of the sabot relative the projectile, and to thereby guide the sabot tip as the user manually pushes the sabot forward to resume secure abutting engagement with the projectile. Another example of a possible use for a sabot cone provided with a slender tip protrusion would be in an embodiment and method of use similar to the one depicted in FIGS. 1-21, in which such a tip protrusion would allow the user to tilt the barrel at somewhat lower angles of elevation without causing gravity-induced lateral dislocation of the sabot relative the projectile.

It may be noted that the embodiments of sabot cone and subcaliber projectile depicted in FIGS. 1-43, when engaged together to form the sabot projectile assembly, assume a loosely penetrative or loosely nesting relationship in which the sabot cone plays a male role, and the subcaliber projectile plays a female role. Alternative embodiments are possible that essentially reverse any penetrative or nesting relationship and cast the subcaliber projectile in the male role and the sabot in the female role. A simple example could be obtained by turning a conical shell sabot backwards so that after loading, the sabot cone's pointed tip is facing rearward towards the breech, and the sabot cone's hollow base is facing forward towards the muzzle, with the rear end of the projectile shaft abuttingly and loosely penetratively engaged against and within the forward-facing inner surface of the hollow shell, so that the subcaliber projectile plays a male role and the sabot plays a female role in the loosely penetrative aspect of their engagement. It will be apparent to one skilled in the art that alternatively, a shell or solid conical sabot, intended to be loaded with its base facing rearward toward the breech, could be truncated at the tip, and the resulting frustum could be provided in its forward end with a hollow socket that is adapted to be loosely penetratively or loosely nestingly engaged by the projectile's rear end when the sabot rearwardly abuttingly engages the projectile. Such a socket in the forward end of the sabot allows the projectile to play a male role and the sabot to play a female role when engaging each other. Such a socket might be advantageously somewhat wider in diameter or dimension than the rear end of the projectile shaft, in order to prevent excessive frictional engagement with the shaft. A socket with beveled sides that taper from a relatively wide forward opening down to a rear wall that substantially matches the size and shape of the shaft's rear end, may offer relatively secure engagement against lateral dislocation of the sabot relative the projectile, without creating excessive frictional engagement between the sabot and projectile. It should also be noted that such sabots with forward sockets could be used with projectiles that have solid shafts rather than hollow shafts, or in which the hollow shaft has been filled with a plug or matrix or other filler material. It should also be noted that in certain embodiments, a projectile shaft might be either solid or solidly filled for most of its length, but with a hollow section or hollow socket at the rear of the shaft that could be loosely penetrated by a male sabot.

It will be apparent to one skilled in the art that various forms and shapes such as, for example, cones, frustums, cylinders, spheres, disks, or various portions or combinations of such shapes or forms, or various other shapes and forms, either in solid or shell version (or a combination of solid and shell), may readily be adapted to provide suitable sabot means, depending on the particular embodiment of the blowgun and associated sabot projectiles. Such alternative sabot embodiments could be either male sabots or female sabots, according to the particular embodiment and method of use, and possibly also depending on, for example, whether such alternative sabot forms were provided either with forward end sockets, or else with slender forward front end protrusions.

It will also be apparent to one skilled in the art that embodiments are possible in which neither the sabot nor the projectile plays either a male or female role when engaged together. An example is embodiments in which there is simply an abutting engagement between sabot and projectile with no penetrative engagement between them. An example of such an embodiment was described briefly above, as an alternative embodiment obtained by taking the essential embodiment depicted in FIGS. 1-21 and replacing the conical shell sabot with a sabot comprising a lightweight foam cylinder sized to substantially match the caliber of the barrel bore. It should be noted that if such a foam cylinder were somewhat compressible or resiliently compressible, during loading insertion or launch acceleration, when the sabot was being forcefully pushed forward against the projectile, the resulting compression of the sabot could temporarily result in the projectile playing a male role and the sabot a female role.

It will be further apparent to one skilled in the art that embodiments are possible in which both sabot and projectile each have both male and female roles, or in other words in which the sabot and projectile each have one or more portions which penetrate the other, and in which each have one or more portions which are penetrated by the other. To summarize, then, it is apparent that embodiments are possible in which either a portion of the sabot is penetrated, preferably loosely, by a portion of the subcaliber projectile, or in which a portion of the subcaliber projectile is penetrated, preferably loosely, by a portion of the sabot, or in which neither of the sabot and the projectile penetrates the other, or in which both the sabot and the projectile each have portions which penetrate, and portions which are penetrated by, the other.

It should be noted that any nesting relationship between the sabot and projectile does not have to be a loosely nesting relationship, as for example in the sense of the following explanation: In certain embodiments, a socket in the sabot (or the projectile) may match to a desired precision some or all of the contours of the cooperating penetrating portion of the projectile (or sabot). An example would be using a sabot provided with a beveled-sided forward facing socket, as described above, in cooperation with a projectile in which some portion of the rear end has a taper that substantially matches the bevel of the socket's side or sides so that some portion of the tapered rear end of the projectile nests within some portion of the beveled socket fairly precisely, yet without providing any substantial resistance to axial separation of the sabot and projectile. Grooved, ported, textured, or corrugated nesting contact surfaces might be advisable to provide air pressure equalization passages and prevent the possibility of creating a suction or partial vacuum between any substantially precisely nesting portions or surfaces of the sabot and the projectile.

It will also be apparent to one skilled in the art that certain embodiments of the sabot are possible which do not engage the rear end of the projectile. Although some portion or surface of the sabot may generally rearwardly abuttingly engage some rearward-facing contact portion or surface of the projectile, such a rearward-facing contact portion or surface of the projectile may either be positioned at the rear end of the projectile, or alternatively may be positioned elsewhere in or on the projectile.

It should be noted that the conical shell sabot and the elongate subcaliber projectile, with proportionally short heavy foreshaft and long lightweight shaft, such as the illustrative embodiments depicted in FIGS. 1-43, represents only one of many possible types of alternative embodiments of sabot means and subcaliber projectile suitable for launch from the blowgun provided by my invention. There are several reasons for choosing this particular embodiment for depiction as an exemplary illustrative embodiment in FIGS. 1-43, said reasons including that the conical shell sabot and elongate subcaliber projectile with foreshaft and shaft:

1. have a good all-around versatility, and may serve as a basis for many embodiment variations suitable for target shooting, flight shooting, and hunting applications, and
2. are relatively easy and economical to assemble or make from pre-existing parts, and are relatively easy and economical to repair or replace if damaged, and
3. are suitable for embodiments which may be easily adapted as part of an adapter accessory or converter kit for accessorizing or converting a pre-existing blowgun to be able to launch sabot projectiles. Likewise, an external magnetic detent, similar to detent 210 included in the embodiment depicted in FIGS. 22-43, would be especially suitable for attaching to a barrel tube of a pre-existing blowgun without any need for extensive modification to the barrel, and thus especially suitable for adaptation as part of an accessory or converter kit for preparing a pre-existing blowgun to launch sabot projectiles.

Some Notes on Certain Embodiments Especially Suitable for Adaptation as do-it-Yourself Projects or Kits:

The following list indicates several considerations that make embodiments similar to the embodiment depicted in FIGS. 22-43 especially well-suited to adaptation for do-it-yourself projects or kits, and suggests a do-it-yourself method by which the user can make or assemble an embodiment closely resembling the embodiment depicted in FIGS. 22-43:

1. The conical sabots are relatively easy to make from a paper, a plastic film, or other flexible and reasonably lightweight and water resistant material, which may be rolled, glued or taped, and trimmed by hand into the appropriate shapes and sizes, using either common tools (such as, for example, scissors and circle templates), or else more specialized tools (such as, for example, paper punches) for faster production rates.

2. The elongate tubular projectile shaft may be economically and conveniently supplied by various types of plastic tubing. A readily available and economical source is the type of narrow, tubular, plastic beverage straws which are popular for stirring and sipping beverages. These straws typically have a cross-sectional diameter of approximately one-eighth inch, being significantly narrower than the approximately quarter-inch diameter soda straws, and if of good quality or grade in material and forming, such straws possess a combination of resilient flexibility, straightness, light weight, and appropriate length (ranging from about 5 to 7 inches or somewhat more or less uncut, and easily cut to other lengths with blade or scissors), to function well as combination shafts and aerodynamic stabilizers for the subcaliber projectiles. The straws are also generally quite cheap to replace if they break or split during use. Any tendency of the straws to split at the ends under impact, or wedging of the sabot cone, may be counteracted by some type of reinforcement such as a wrapping of tight strong adhesive tape, possibly sealed against moisture with glue or epoxy. Such a tape wrapping makes an effectual tightly fitting reinforcing band. The narrow, approximately eighth-inch straws are particularly well suited for making very streamlined elongate projectiles, however, wider tubing or straws, such as approximately quarter-inch soda straws, may also give good or satisfactory results for certain embodiments, or may even be more suitable for certain embodiments.

3. One do-it-yourself method by which the user may create suitable blunt projectile foreshafts, suitable for target shooting and certain types of hunting, is by using finishing nails with a shank diameter narrow enough to slide inside the sipper straw shaft, while the finishing nail also preferably has a compact nailhead with a diameter slightly larger than the outer diameter of the sipper straw shaft. If the fit of the nail's shank inside the sipper straw shaft should happen not to be snug enough to securely frictionally engage the shank within the shaft, a gasket or bushing may be formed around the shank of the nail by various methods, such as a wrapping of tape or adhesive plastic film around the shank to such a thickness as will provide the desired snug fit and frictional engagement with the straw shaft. It is also advantageous to make another similar bushing between the insertion bushing and the head of the finishing nail, which is somewhat wider than the insertion bushing, so as to form a shoulder bushing for abuttingly engaging the forward end of the sipper straw shaft. It is preferable that any bushing, as well as the outer diameter of the sipper straw, should be somewhat narrower than the diameter or widest diameter of the blunt compact nailhead of the finishing nail, so that the nailhead contains the widest portion of the projectile. This promotes better aerodynamic stability, I believe, and may also provide advantages in penetration. The pointed end of the finishing nail is preferably snipped off with a tool such as wire cutters, bolt cutters or pliers, and the remaining truncated end of the shank smoothed with an abrasive means, in order to avoid possible damage to the straw shaft, particularly the interior of the straw shaft, during any flexing of the shaft during loading, launch, or target impact. The user may also adjust the mass and balance of the projectile by further truncating the nail at the end opposite the end with the nailhead. To add mass, the user may, for example, fill part of the straw shaft with a filler such as putty, clay, plaster, cement or epoxy, possibly with beads, sections of nail shaft, or other filler items set in the putty or epoxy or other matrix. When used with epoxy, for example, such a technique may form, in effect, a tightly fitting plug extension of the foreshaft that may be frictionally secure within the shaft even if the epoxy or other filler does not form a secure chemical bond with the plastic of the straw. A shoulder bushing of the type described above may help to cushion the forward end of the shaft and further protect it from splitting during launch or target impact. Another advantage to such a projectile foreshaft made from some portion of a finishing nail, and possibly provided with one or more insertion bushings or shoulder bushings or both, is that such a foreshaft is very durable, is economical to make, and, should the straw shaft break during use, such bushings would make it especially easy to remove the broken shaft by sliding it off the foreshaft, and then easily sliding on a replacement shaft.

Some Additional Notes, Descriptions, and Suggestions Regarding Possible Alternate Embodiments 1. The blowgun may be operated as either a breech-loader or a muzzle-loader, depending on the particular embodiment and particular method of use.

2. Certain embodiments may include one or more chambers or cartridges into each of which a sabot projectile assembly may be loaded separately before each loaded chamber or cartridge is then inserted into, aligned with, or otherwise securely engaged with the barrel bore (although in certain embodiments or methods of use, loading might take place when the chamber or cartridge is already inserted into, aligned with, or otherwise engaged with the barrel bore). Such a chamber or cartridge might in certain embodiments provide a housing or support for the sabot detent or the projectile detent or both. Such a chamber or cartridge may in certain embodiments have its own bore that substantially matches the barrel bore caliber and thus may form an extension of the barrel bore when correctly positioned and oriented relative the barrel bore. Alternatively, such a chamber or cartridge, especially if used to provide a housing or support for one or more detent means, might be somewhat skeletonized, so as not to include its own section of complete bore surface, but rather to provide a housing or support, especially for the detent means, and which might, for example, be fitted inside the barrel bore, or fitted into recesses in the barrel wall that possibly communicate with the main portion of the barrel bore, or in similar manners be fitted into an affixed optional mouthpiece or an affixed optional barrel bore extension member. Such a chamber or cartridge might in certain embodiments be affixed to the main body of the blowgun in such a way as to be independently movable of the main body of the blowgun, and thus provide part of an articulated action that could allow loading the sabot projectile assembly by reconfiguring the positioning or orientation of the chamber or cartridge relative the barrel bore to allow the bore or cartridge or chamber to in effect to be opened and loaded, and then reclosed and resealed. Certain embodiments of such an articulated action might include several such chambers or cartridges, possibly configured to provide a repeater version of the blowgun, such as a revolver. A multi-chambered embodiment, such as a revolver, might use one or more magnetic detents, or in other words might either use one magnet or a plurality of magnets. Another example of such an articulated action might be a break-action embodiment, in which the chamber might have its own section of bore matching the caliber of the barrel bore, with the chamber affixed by a connecting means, possibly including a hinge, to the main body of the blowgun in such a manner that in closed position the chamber's bore would form an extension of the barrel bore joining the barrel bore at the barrel bore breech, while in open position any hinged articulation of the chamber might allow the chamber to swing down at an angle to the barrel proper, thus opening up what might be termed the chamber muzzle. The opened chamber could then be muzzle-loaded with a sabot projectile assembly and then swung back into a closed position re-aligned with the barrel bore prior to launching the projectile. Such a break-action chamber embodiment, the chamber and main barrel body might advantageously be provided with gaskets or other means of providing a secure air seal when the chamber is closed, and might also be provided, for example, with additional locking detents adapted to hold the action closed and sealed until manually or mechanically re-opened. It may be appreciated that such a break-action chamber embodiment might make it easier to use a sabot detent embodiment (such as, for example, a fixed transverse crossbar) which does not allow the sabot projectile assembly to be inserted into the barrel bore through the barrel bore breech (or into the chamber bore through the chamber bore breech). Furthermore, in certain embodiments of such a break-action chamber embodiment, the chamber bore may advantageously have a length somewhat slightly shorter than the length of the sabot projectile assembly, so that when the action is closed, the front portion of the forward end of the sabot projectile assembly rests upon or within the actual barrel bore, in order to reduce any type of jarring or jolting encountered by the projectile assembly when moving across the transition from the surface of the chamber bore to the surface of the barrel bore (in such an embodiment, if the chamber bore were to include a sabot detent, then the distance between the sabot detent and the muzzle end of the chamber would preferably be somewhat shorter than the length of the sabot projectile assembly). In certain somewhat similar embodiments, such a bore extension-type chamber, instead of being hinged to the main blowgun to form a break action, might instead be completely removable from the main blowgun for loading, and then reattachable for launching.

3. Certain embodiments may launch spherical projectiles or other types of short or non-elongate pellets or projectiles instead of, or in addition to, launching elongate projectiles.

4. Certain embodiments of the projectile shaft may be tapered or flared or both at either or both ends as well as in the middle.

5. In certain embodiments the cross-sectional shape of some portion of the projectile shaft or foreshaft or both may be other than that of a circular disk shape, which would in some embodiments make it possible, by forming the shaft in a twisted or helical fashion, to provide the projectile with spiraling surfaces that would aerodynamically induce stabilizing spin. Thus the shaft or foreshaft or both may be shaped in such a manner so as to provide one or more helically twisted aerodynamic guidance surfaces or other surfaces that produces stabilizing spin in flight.

6. In certain embodiments, the relative positioning and orientation of any projectile detents and sabot detents relative each other and the bore (especially the breech of the bore) may be other than the positionings and orientations or relative positionings and orientations earlier or elsewhere described or depicted.

7. Some embodiments may include both a sabot detent and a projectile detent, other embodiments may include a sabot detent but not a projectile detent, other embodiments may include a projectile detent but not a sabot detent, and yet other embodiments may include neither a sabot detent nor a projectile detent. Some embodiments may operate with both a sabot detent and a projectile detent, other embodiments may operate with a sabot detent but without a projectile detent, other embodiments may operate with a projectile detent but without a sabot detent, and yet other embodiments may operate without either a sabot detent or a projectile detent.

8. Certain projectile embodiments, such as the ones depicted in FIGS. 1-43, may comprise two or more elements, or in other words may be of a two-piece or more-than-two-piece construction. Certain alternate projectile embodiments, on the other hand, may be of a one-piece construction. Some such projectile embodiments may be elongate projectiles, among which certain embodiments may have a forward-of-center balance. In such one-piece elongate projectiles with a forward-of-center balance, the one-piece structure might still be considered, if desired, to have a foreshaft portion and a shaft portion, even though the two portions were not structurally or materially distinct. A possible example might be an elongate one-piece projectile with a denser or heavier forward portion that structurally merges into a more lightweight rearward portion. Other one-piece elongate projectiles are possible, however, which might not have a distinguishable foreshaft portion and shaft portion. A possible example might be a one-piece elongate projectile shaped in the form of an elongate rod, cone, or other suitable shape, and which might be used, for example, simply to test muzzle velocity or target penetration at close ranges, or to be launched at underwater targets, possibly without concern for in-flight stability past very close ranges. Other possible embodiments for an elongate projectile without distinguishable shaft and foreshaft portions might include, for example, a projectile essentially shaped as an elongate rod provided with integrally formed transverse extensions protruding from its rearward portion to provide in essence one or more vanes or other types of stabilizing fletching to serve as aerodynamic stabilizers. Some other examples of possible one-piece projectile embodiments include certain embodiments of spherical projectiles and certain other types of essentially non-elongate projectiles.

9. In certain embodiments, a portion of the foreshaft may serve double-duty as the head or point of the projectile. Alternatively, in certain embodiments the foreshaft may be adapted or provided with means to allow the foreshaft to be removably or permanently affixed to any of a variety of types of structurally or materially distinct projectile heads or points, possibly with one or more intermediary connecting extension members, which preferably would be aligned coaxially with any head and foreshaft and shaft. Any such extension members could be affixed to either the front or the rear of the foreshaft, therefore in some cases possibly overlapping the shaft. Distinct heads or points would generally be affixed forwardly to the foreshaft, although some arrangements, particularly one in which the head or point actually comprised several distinct elements, might affix to the sides or rear end of the foreshaft (an example might be a head embodiment that comprises one or more broadhead blade elements). In certain embodiments the portion of the projectile forward the shaft might be considered as either a foreshaft or a head, so that it would be possible to consider the projectile as comprising a shaft and head without a foreshaft, or else simply a foreshaft and shaft; this suggests that in some embodiments the distinction between head and foreshaft might be somewhat arbitrary and the definitions of head and foreshaft essentially interchangeable. Shaft extension members may also be affixed forwardly or rearwardly to the shaft in order to extend the shaft length, adjust projectile balance, or possibly to serve as additional aerodynamic control surface or surfaces, depending on the specific embodiment of the shaft extension. Foreshaft extensions might also incorporate additional aerodynamic control surfaces. The ability or option to affix structurally distinct heads or points or extension members to the foreshaft or shaft gives the user or designer valuable flexibility in more precisely adjusting the function, mass, balance, and aerodynamic characteristics of the projectile.

10. In certain embodiments a portion of the foreshaft may insert inside the shaft. Alternatively, a portion of the shaft may inserts inside the foreshaft. Or a portion of each may insert inside or within the other. Or neither may insert within the other. Any inserting, frictional, or force-fitted engagements between the shaft and foreshaft may be enhanced by means such as, for example, cooperating threads that screw together, glue, or epoxy, or structural means that allow components to snap together.

11. In certain embodiments the foreshaft may be hollow for some portion or entirety of its length, and such an inner hollow portion may also possibly be open at one or both ends of the foreshaft.

12. In certain embodiments one or more inserts, or outserts, or both may be added to or affixed to the shaft or the foreshaft or to both, in order to, for example, adjust projectile mass, or balance, or both.

13. In certain embodiments the sabot detent may engage some portion of the sabot frictionally, or by force-fit, or by both, rather than abuttingly engaging the sabot. Such a sabot detent might possibly include a slightly circumferentially narrower section of bore, or a textured section of bore, or a section of bore that is both textured and narrowed. In certain embodiments, the sabot detent may function either frictionally or abuttingly, depending on the method of use. In certain embodiments the sabot detent may simultaneously engage the sabot detent at various portions frictionally and abuttingly. In certain embodiments the categories of frictional and abutting may overlap, but with one or the other type of engagement predominating so that the engagement is either essentially abutting or essentially frictional.

14. In certain embodiments, the blowgun may function without a sabot detent or may not comprise a sabot detent. In some such embodiments, the sabot piston may be sized and shaped so that the sabot's widest portion fit snugly enough within the bore to frictionally engage the bore in such a manner as to prevent or resist axial displacements of the sabot projectile assembly in the direction towards or out the breech. This type of frictional engagement with the bore may be enhanced in certain embodiments by an effect in which a backpressure (possibly induced by gravity, magnetic attraction, or mechanical spring bias) of the subcaliber projectile pressing rearward against its area of engagement with the sabot causes the sabot to attempt to pivot sideways in the bore, thereby possibly somewhat increasing the sabot's resistance to backwards motion axially through the bore. In some embodiments or methods of use, either with or without a sabot detent, the sabot may be sized more loosely so as to frictionally engage the bore less securely, yet be held in place or within a suitable range of positions by frictional engagement of the bore's inner surface, in which case the sabot simply rests on the surface of the bore under its own weight, or in other words under the urging of gravity, especially when the bore is oriented substantially horizontally; in such embodiments or methods of use, the sabot generally does not need to support any substantial portion of the weight of the projectile. Adhesion due to breath moisture condensation in the barrel bore may, in certain embodiments, also contribute to the tendency of certain embodiments of the sabot (or the projectile) to engage the surface of the bore in such a manner so as to resist or prevent excessive premature axial displacement while loaded within the bore. It should be noted that in certain embodiments that do include a sabot detent, the sabot detent may in some embodiments also function as a primary or redundant anti-inhalation safety means to help prevent the user sucking the sabot out through the breech. Therefore, in embodiments that do not use or comprise a sabot detent, it is preferable to provide the blowgun with some alternate type of anti-inhalation safety means.

15. The blowgun in some embodiments, may function without a projectile detent. One example of such an embodiment is one in which the subcaliber projectile and sabot means may be held in a suitable loaded position simply by their frictional engagement with the bore due to the subcaliber projectile and sabot each simply resting on the effectual support of the inner surface of the bore under the urging of gravity, or in other words by the pressing of their own weight, especially when the bore is oriented substantially horizontally. Thus, in some embodiments the blowgun may function either without a sabot detent, without a projectile detent, or without both. In certain such embodiments, the barrel bore itself might possibly be considered as being a type of detent, possibly either as a projectile detent, or as a sabot detent, or as a combination of both, but the barrel bore will not be actually termed as a type of detent in this disclosure for the sake of clarity.

16. Depending on the specific embodiment, the sabot's widest transverse portion or portions may be at either the base or rear end of the sabot, or alternatively, may be positioned transversely at various other locations along the axial length of the sabot, including the forward end of the sabot.

17. In certain embodiments such as or somewhat similar to those depicted in FIGS. 1-43, the conical sabot functions, in effect, primarily as a pusher plug type sabot component, although the conical sabot may also be considered to function somewhat as a sabot carrier in that the engagement of the cone inside the rear opening of the subcaliber projectile shaft may tend to support some rearward portion of the projectile above and out of contact with the inner surface of the bore, so that in effect such a conical sabot cone may partially carry the subcaliber projectile during travel through the bore during launch. This means that the embodiments depicted in FIGS. 1-43 also illustrate or exemplify that in certain embodiments it is not necessary to completely support the subcaliber projectile with a carrier type of sabot component, since in certain embodiments the blowgun may function and perform quite satisfactorily with part or all of the length of the subcaliber projectile resting against and supported directly by the surface of the bore, without need for the intermediary support of a sabot carrier component. It is indeed possible in some embodiments to adapt or orient the subcaliber projectile and the sabot in such a way that when they are engaged as a functional unit, substantially the entire length, or an elongate portion of the length, of the projectile is in direct contact with and resting upon the inner surface of the bore when in loaded position and/or during launch. Alternatively, it is possible in some embodiments to adapt the subcaliber projectile and the sabot means such that some portion of the sabot means functions as a sabot carrier that supports the subcaliber projectile in such a way that no portion of the subcaliber projectile is in contact with the inner surface of the bore while in loaded position and/or during launch acceleration. Such a carrier type of sabot might be most appropriate for use with a spherical projectile or pellet, particularly if barrel rifling is being used to spin the sabot and transmit spin to the pellet. In such rifled barrel embodiments, the pellet, when in loaded position and during launching, would preferably be axially centered within the bore, and also preferably aligned with the axial center of the sabot, as substantially as possible. In such embodiments it would also be preferable that the sabot and the bore have been pre-shaped in such a manner as to cooperate to produce rifling spin during launch acceleration. Pre-shaping or pre-forming the sabot and the bore to co-operate in such a way would substantially reduce launching resistance when compared to the launching resistance that would occur if the barrel rifling needed to grave the sabot during launch.

18. The externally mounted magnetic detent used in the illustrative example depicted above in FIGS. 22-43 was not in direct contact, as in direct surface contact, with the subcaliber projectile when the projectile was in loaded position or being launched. Action or influence of the magnetic detent upon the loaded projectile was indirect, or at a distance. However, some embodiments may employ a magnetic detent that does have substantially direct surface contact with some portion of the subcaliber projectile when the projectile is loaded within the bore. One method of employing such a direct contact magnetic projectile detent could generally be accomplished by providing a receptacle recess or hole into or through the wall of the barrel, communicating with the bore and possibly also communicating with the exterior of the barrel. Within such a receptacle recess or hole may be positioned and possibly affixed some portion of the magnetic detent. Such a receptacle recess or hole would essentially transversely extend a portion of the hollow barrel bore. Thus, such a direct contact magnet could be placed into a recessed socket that opened into the barrel bore, but did not completely penetrate the barrel wall, if the barrel walls at that portion were sufficiently thick, or the magnet sufficiently small or thin, or alternatively, the recessed socket or hole might completely penetrate the barrel wall. In either such type of embodiment, the top surface of the magnetic detent would be preferably aligned and positioned in such a manner that it would not protrude out from the receptacle recess or hole past the inner surface of the bore. The top surface of the magnetic detent might also be shaped in such a way as to match (and possibly be continuous with and flush with) the curve or perimeter of the cross-sectional shape of the bore where the magnetic detent is located. If necessary a thin surface coating or covering of paint, varnish, plastic, or the like may be applied to any surfaces of the magnet or magnetic detent which might come in contact with moisture condensation of the breath, or be abraded by surface contact with the swiftly accelerating projectile and sabot during launch. Despite any such intervening protective coating or covering, such a magnetic detent could still be understood to be in substantially direct contact with the projectile when engaged. If the fit of the magnetic detent within such a receptacle recess or hole does not produce a substantially airtight seal, an appropriately sized and shaped gasket might be used to seal any gap between the magnetic detent and the sides of the receptacle recess or hole, or a filler matrix such as some type of epoxy might be used both to fill the gap and to affix the magnetic detent in position. Alternatively, a rigid or semi-rigid covering plate or patch could be affixed to the exterior of the barrel in such a manner as to cover and seal part or all of the external opening of the receptacle hole and thereby seal any gap between the magnetic detent and the sides of the receptacle hole. Such a covering plate or patch might in some embodiments include a cowl portion shaped and positioned in such a manner as to provide interior clearance for any portion of the magnetic detent protruding from the receptacle hole past the exterior of the barrel, and to completely cover and seal any opening or gap between the magnetic detent and the sides of the receptacle hole. Such a covering plate or patch or cowl with interior clearance might result in a small air space enclosed within the covering, however, provided the airseal remains substantially intact and the volume enclosed by the air space is relatively small, this need not in any way significantly diminish the performance of the blowgun. Direct contact magnetic detents could be useful in situations in which it is needful or desirable to employ a magnet that would not have sufficient strength and dimension of magnetic field to securely attract and hold the subcaliber projectile through a relatively wide range of insertion motion. In such an embodiment, it may be possible that after initial loading insertion of the subcaliber projectile, the projectile will be held in initially loaded position within the bore with its rearward shaft end positioned at a distance past the sabot detent that substantially matches or is only slightly less than the length of the sabot cone from base to the portion of the sabot cone that directly abuttingly contacts and engages the rear of the subcaliber projectile. In such embodiments, especially when using a sequential method of loading insertion, the user may find it easier to load the sabot in such a manner as to securely engage the sabot projectile, if the tip of the sabot cone is provided with a narrow, lightweight extension, which is narrow enough that when inserted into and loosely penetrating the projectile shaft, there is no substantial force fit or frictional engagement with the inner surface of the projectile shaft. It may incidentally be noted that in certain embodiments or methods of use the initial partially loaded position of the subcaliber projectile is substantially the same or substantially almost the same as the final fully loaded position of the subcaliber projectile.

It should be noted that another way to provide a direct-contact magnetic detent would be either to use a barrel that includes some structural portion composed of steel (or some other highly magnetizeable material) with the magnet affixed or held against the exterior of the barrel, or else to provide a nonmagnetic barrel with a communicating receptacle opening or hole as described above, but with the opening filled or partially filled with a member of steel (or other suitable magnetically attractable material), and with a magnet in either direct or indirect contact with the external end of the steel member, and the projectile in substantially direct contact with the interior end of the steel member. Using a barrel composed of steel or other magnetically attractable material would allow the magnetic detent to be affixed to the barrel by magnetic attraction without need for any additional connecting means between the barrel and magnetic detent; however, this might generally somewhat weaken the effectual influence of the magnetic detent upon the projectile, therefore in many embodiments that utilize a magnetic detent it is advantageous to use a barrel composed of a nonmagnetic or nonmagnetizeable material such as aluminum, plastic, wood, and the like.

It should also be noted that with a magnet not intended to make direct contact with the projectile, or in other words intended to exert its influence indirectly or at a distance, the wall of the barrel could be made thinner at that portion where the magnetic detent was externally affixed or positioned, in order to lessen the distance between the magnet and the magnetizable portion of the projectile, in order to thereby allow a stronger attraction between the magnet and the projectile.

19. It will be apparent to one skilled in the art that the magnetic detent or other type of detent, and any intermediary connecting means used to secure or affix the detent in proper position and orientation relative to barrel and barrel bore, may optionally be so adapted to allow the detent to be, for example, removed or repositioned, or reoriented, and reaffixed or re-secured relative the barrel or mouthpiece. It will be appreciated that if preparing to load and launch a sabot projectile assembly that has a substantially different total length than the length of the original sabot projectile assembly which the blowgun was initially adapted or adjusted to launch, the distance between the projectile detent and the sabot detent may need be adjusted or tuned in order to securely hold the current sabot projectile assembly in loaded position within the bore. (Usually such an adjustment of distance between detents may be accomplished by making the projectile detent repositionable. It would also be possible to make the sabot detent repositionable, however it is in many embodiments generally preferable to keep the sabot detent as close to the breech as possible in order that the sabot projectile assembly be accelerated along substantially the full available length of the barrel bore. Therefore in such embodiments there would preferably be no need to substantially axially reposition the sabot detent relative the barrel bore. Certain embodiments, however, might advantageously make use of, for example, a ratcheting-type mechanism to keep the sabot detent securely biased against the rear of the sabot.)

Any such connecting means to allow adjustment of the positioning and orientation of the projectile detent or other detent might include simple mounting hardware that could be snapped or screwed to securely but re-positionably clamp on to the barrel while holding the magnet or magnetic detent, or could include more sophisticated connecting means adapted to slidingly affix the magnet or magnetic detent in such a manner as to be continuously or incrementally repositionable along some portion of the barrel, preferably relatively near the breech end or proximal portion of the barrel. In addition to sliding axially back and forth or being axially moved or repositioned to various locations along the barrel or along a portion of the length of the barrel, the connecting means might also make it possible for the magnetic detent to be reoriented or repositioned in terms of the detent's proximity to the exterior surface of the barrel (thereby also adjusting the detent's lateral distance from the nearest inner surface of the barrel bore), as well as in terms of the detent's or magnet's tilt angle with respect to the longitudinal axis of the bore. It would also be possible to provide connecting means that allow adjustable positioning and orientation of direct-contact magnetic detents. Any enlargements in communicating openings through the wall of the barrel communicating between the bore and the exterior of the barrel might be externally enclosed by an expanded cover or cowl that provides adequate clearance for the magnets, mounting and connecting means, and provides a secure air seal. Adjustments of the proximity and orientation of the magnet respective the barrel bore allows the user to adjust and tune the strength and orientation of the attractive pull between the subcaliber projectile and the magnetic detent.

20. In certain embodiments, the projectile detent might also be adapted as to be repositionable during the loading process in such a way as to help it maintain connection with the sabot projectile throughout a certain range of motion of the sabot projectile involved in the loading process. An example would be either a direct or indirect contact magnetic detent that is slidably affixed to the barrel and is initially positioned so as to be attractively engaged by the sabot projectile when the projectile is partially inserted into the bore, after which the moveable detent is pulled, by its magnetically attractive engagement with the sabot projectile, further along the bore or barrel in the direction away from the breech.

21. The projectile detent might make use of detent means other than magnets or electromagnets. Detents could also be used that included mechanical detents, or even used suction applied through a small communicating opening between the bore and the barrel exterior, for example. Or possibly a suction or partial vacuum formed behind the sabot means and effectually transmitted to the subcaliber projectile by a communicating opening through the sabot means.

22. The sabot detent, projectile detent or both may be affixed to or integral with either an optional mouthpiece or an optional affixed extension member that may essentially provide an extended length of bore, possibly with an integrated mouthpiece portion. In certain embodiments, the projectile detent, sabot detent, or both may be affixed to or integral with an optional sleevelike member that slides over the exterior of barrel and is possibly affixed or secured in place, perhaps slidably or re-positionably. The detent means might also be affixed to or integral with some other type of optional bracket or other intermediary connecting member or members that is mounted on or affixed to the barrel. Such extension members, sleevelike members, and other types of brackets or intermediary connecting members may be adapted to serve as part of an adaptor or conversion accessory or kit for helping to affix one or more sabot detents, projectile detents, or both, to a pre-existing blowgun in order to help convert or adapt the blowgun for launching sabot projectiles.

23. In certain embodiments the blowgun may have or be able to accept an optional barrel bore extension member affixed at muzzle end, breech end, or both (and preferably coaxially aligned with the barrel bore proper). Such bore extension members may use, for example, spring ball detents with cooperating indentations, possibly with one or more rail structures, to provide a strong connection to and accurate coaxial alignment with the barrel bore proper.

24. In order to increase user convenience in retrieving discarded sabots after launching, in certain embodiments the blowgun may advantageously include an optional sabot catcher means positioned near the muzzle, or otherwise affixed to some portion of the blowgun, and so adapted as to engage and stop the sabot after the sabot exits the muzzle or is otherwise no longer positively by launch thrust. Such an optional sabot catcher might advantageously be used with a ported bore or bore extension that allows air pressure to drop before the sabot exits the muzzle, and preferably as the sabot approaches fairly near the muzzle, in order to encourage quicker separation of the sabot from the subcaliber projectile, perhaps even while the subcaliber projectile or sabot is still within or partially within the bore. The bore near or at the muzzle may also advantageously be somewhat choked or reduced in caliber near the barrel, preferably with a smooth, gradual taper, as an aid in stopping or slowing the sabot, but preferably choked in such a way that any portion of the bore that will be in direct surface contact with the subcaliber projectile is not in any way bent or curved in such a way as would introduce trajectory inaccuracies by bumping or deflecting the projectile from the path it has been following down the bore. The optional sabot catcher's structure should be adapted to intercept the sabot means at some point on the sabot's path of travel, preferably at some point on the sabot's external path after exiting the muzzle, but the sabot catcher structure should also preferably not impinge upon or block any portion of the internal or external path of the subcaliber projectile proper and should also preferably not substantially interfere with the free flow of air from the muzzle as the sabot projectile assembly pushes a column of air ahead of it down the barrel during launch acceleration, nor should the sabot catcher, when engaged with the sabot means during capture of the sabot, substantially block the free flow of residual air flowing from the muzzle after the sabot or sabot projectile assembly exits the barrel bore. The sabot catcher's structure may include various types of surfaces that are adapted to grip, catch, shunt, frictionally engage, or otherwise engage the sabot. In certain embodiments, the sabot catcher's sabot engagement surfaces may, for example, slant inwards towards each other as distance increases from muzzle, so as to progressively tighten grip or squeeze in upon the sabot in order to gradually slow or stop the sabot. In certain embodiments, the sabot catcher's sabot engagement surfaces may be composed of or faced with materials such as, for example, yielding or compressible foam or foam fingers, flexible bristles, nonskid rubber materials. Any such optional sabot catcher structure or mechanism would preferably be so adapted as to not stop the sabot too suddenly, and so as not to substantially block or trap any air flow from the barrel bore muzzle before and after the sabot projectile assembly exits the muzzle. The sabot catcher's sabot engagement surfaces would preferably be somewhat yielding, soft, and smooth, or otherwise adapted in such a manner so as not to excessively abrade the sabot's surface or excessively deform the sabot or puncture the sabot, thereby helping to extend sabot life. In certain embodiments, part or all of the sabot catcher may yield during engagement with the forwardly moving sabot, and in certain embodiments part or all of the sabot catcher may move relative its connection to the barrel or optional stock as the sabot catcher absorbs momentum and energy transferred from the decelerating sabot. In certain embodiments the optional sabot catcher may even slide off or otherwise disconnect from the blowgun proper and fall, possibly still holding the captured sabot; in certain such embodiments the sabot catcher might completely disconnect from the blowgun proper and fall off, while in certain other such embodiments the sabot catcher when moving or falling might remain movably anchored to the blowgun proper, by, for example, a connecting linkage mechanism, or a string, cable, or chain, by which the main body of the sabot catcher might also be retrieved for surface-to-surface reattachment to the blowgun proper. In certain embodiments, sliding motion of the sabot catcher engaged with the decelerating sabot may unlock a spring bias that swings the catcher and captured sabot out of the line of fire in case the user forgets to retrieve or remove the captured sabot prior to launching another sabot projectile assembly, and also to serve as a more visible visual cue to remind the user to retrieve the captured sabot prior to loading or launching the next sabot projectile assembly. In certain embodiments, the optional sabot catcher might also merely slow or deflect the sabot (preferably downward) without completely stopping the sabot, thus merely limiting how far the sabot travels past the muzzle in order to thereby reduce the work and time for the user to find and retrieve discarded sabots. A sabot catcher catching and retrieving line could even be permanently attached to a sabot, in a manner similar to the string attached to the cork in a toy pop gun. A sabot catcher could also include a loop of string affixed to and trailed by a sabot in such a manner as to engage a hook affixed to the barrel or barrel bore near the muzzle.

25. The optional mouthpiece may be provided with optional intermediary connecting means to connect the mouthpiece to the barrel or other appropriate portion of the blowgun, and in general, optional intermediary connecting means may be provided to connect together any appropriate set of elements or optional elements, including accessories, of the blowgun and associated sabot projectiles.

26. In certain embodiments, the subcaliber projectile may be provided with optional additional aerodynamic fletching in, for example, the form of one or more vanes or feathers, possibly helically wrapped, or in the form of one or more subcaliber cones, cylinders, spheres, disks, or some portion or combination of such shapes or forms. Other means of applying additional aerodynamic guidance in certain embodiments might include optional projectile surfaces in the general form of a propeller, air screw, or turbine. Such propeller- or turbine-like surfaces might be affixed to the subcaliber projectile in order that pressure or lift of air displaced by the propeller or turbine surfaces would spin some portion or entirety of the subcaliber projectile on its longitudinal axis. Additional aerodynamic guidance surfaces might also in certain embodiments be grooves or recessed surfaces in or on the projectile, rather than extensions on the projectile. Certain embodiments might apply additional aerodynamic guidance or stabilizing spin by using an air scoop (somewhat in the manner of a ramjet) to channel displaced pressurized air through exhaust nozzles aligned in such a manner to spin the subcaliber projectile or some portion of the projectile. Certain embodiments might also use aerodynamic or stabilizing means including counter-rotating propeller-like or turbine-like sections rotating independently of each other and/or rotating independently of the main body of the subcaliber projectile. In certain embodiments in which the projectile may be hollow throughout some or all of its length, and with any such hollow portion open-ended to allow airflow therethrough, some or all of the inner projectile surfaces may also serve as additional means of aerodynamic stabilization.

27. Rather than comprising a shaft and a foreshaft that are structurally or materially distinct from each other, the elongate subcaliber projectile may be formed in one piece, or in other words as a single unitary monolithic structure, in a number of ways, such as the following examples:

a. A one-piece projectile that is wider or thicker at the front than at the back, so as to create a forward-of-center balance.

b. A one-piece projectile composed of certain types of wood, foam, or other suitable materials that may be differentially compressed to yield a permanently compressed structure with the forward section denser and heavier than the rearward section, thereby yielding a forward-of-center balance even if the cross sectional dimensions are constant throughout the length of the structure after compression.

c. A one-piece projectile, either with or without a forward-of-center balance, in which additional aerodynamic control surfaces are integrally formed in the one piece structure by methods such as molding, machining, or carving. An example would be a projectile composed of a dense plastic that could be molded to form, all in one piece, a relatively thick, rigid, heavy forward body section, tapering down to a thinner, lighter rear body section, with very thin, lightweight fletching vanes extending radially from the narrow rear portion. Certain types of aerodynamic control surfaces could also be formed by fraying, puffing, or foaming a portion of a relatively solid structure composed of appropriate material, such as certain types of plastic and wood.

d. Casting, molding, machining, carving or otherwise forming a one-piece monolithic structure with a solid forward portion and a hollow rearward portion containing one or more hollow cavities, in which the solid portion serves as a relatively heavy foreshaft portion and the hollowed portion serves as a relatively lightweight shaft portion.

e. Rolling a thin layer of material such as plastic film or paper. An example would be an L-shaped piece of paper or plastic film rolled so that one arm of the L would be rolled either inside of, or else around outside of, the rolled-up remaining portion of the L, thereby essentially forming a heavier foreshaft portion, with part of the remaining portion or arm of the L forming a relatively lightweight shaft portion. Another example would be spirally rolling a rectangular strip of plastic film or paper in such a way as to form an elongate cone with a forward-of-center balance due to more layers of film or paper being rolled at the forward end than at the rear end.

28. Some portion of the subcaliber projectile may, when engaged with the sabot, penetrate an opening through the sabot and extend rearwardly past some portion of the sabot.

29. The sabot detent means may be affixed in such a way as to allow it to move relative the barrel or barrel bore. This is particularly useful in embodiments in which the subcaliber projectile, after being loaded into the initial partially loaded position, is further inserted only a relatively small distance to assume final completely loaded position, or else in which the initial loaded position of the subcaliber projectile is also substantially its final loaded position. In this case, since there may in some such embodiments not be any substantial back-following motion, as described above, to keep the projectile securely followingly engaged against the sabot, being able to move the sabot detent forward after the sabot has been inserted past the sabot detent helps to ensure that the sabot and subcaliber projectile are firmly seated against each other, or in other words firmly abuttingly engaged. Such a followingly movable sabot detent means might in some embodiments be provided with a ratchet type mechanism in order to help prevent slackening or loosening of pressure or contact against the sabot. Such a moveable sabot detent may advantageously be used in conjunction with sabots provided with slender tip protrusions or other similar provision adapted to slide very loosely either into or around (or both) a portion of the projectile in order to thereby guide the main portion of the sabot and the subcaliber projectile together or back together after any axial separation that did not exceed the length of the tip protrusion, and to thereby give an extended buffer zone to help provide more resistance to premature or excessive lateral dislocation of the sabot relative the projectile.

30. In certain embodiments, the projectile shaft need not necessarily be of constant inner diameter or outer diameter. On the other hand, in certain embodiments the projectile foreshaft may, for example, be of constant diameter, or may have a forward portion narrower than a rearward portion, or may be shaped in an essentially non-cylindrical fashion, such as, for example, a foreshaft shaped in an essentially conical or cylindroconical fashion.

31. In certain embodiments the sabot may be provided with means to partially or completely encapsulate the subcaliber projectile. One particularly useful version of such a sabot could include a pusher plug section rearwardly affixed to one or more forwardly extending longitudinally aligned elongate members that are substantially as long as or longer than the projectile. If the sabot included two or more such longitudinal elongate members, then each member could include a protrusion extending radially inward from the forward end of the member so that the radially aligned protrusions would meet or overlap, in a manner similar to upper teeth meeting lower teeth in the mouth. When closed together or against each other, the radial protrusions might combine to define a forward partition or socket that in cooperation with some portion of the pusher plug may longitudinally encapsulate the projectile abbuttingly. The longitudinal members or radial protrusions or both may be pivoted, hinged, or flexible so as to be able to spread apart, when not constrained by the transverse dimensions of the bore, and thereby release the forward end of the projectile so that sabot discarding may occur. Additionally or alternatively, the radial protrusions might be independently compressible or resiliently compressible and able to spread apart to release the projectile without requiring the longitudinal elongate members to spread apart. The longitudinal elongate members or radial protrusions might in certain embodiments also be provided with or linked to additional forward extensions adapted to exit the muzzle and be pushed apart laterally by atmospheric drag, thereby helping to disengage the linked elongate members or radial protrusions from contact with the forward end or portion of the projectile before the sabot has completed exiting from the muzzle. If only one lateral elongate member is used, it could be provided at its forward end with a transverse protrusion that would abut the inner surface of the bore in order to define a forward containment partition or socket to cooperate with some portion of the pusher plug to partially encapsulate the projectile, especially if the forward end of the projectile rests on or is pressed against the inner surface of the bore. The forward protrusion or protrusions would not have to be actually abutting with each other or with the bore, but simply close enough together or close enough to the bore so that the remaining gap would be too narrow for the forward end of the projectile to slide through, so that there would still be secure abutting forward engagement of the projectile. A parallelogram type linkage could be used to allow axially forward motion of the projectile to essentially transversely move or swing the forward sabot extension or protrusion out from directly in front of the forward end of the projectile.

32. In certain embodiments, some portion of the projectile other than, or in addition to, some portion of the projectile foreshaft, may comprise a magnetically attractable portion to cooperate with a magnetic detent. In certain such embodiments, then, the projectile foreshaft might not include any magnetically attractable portion.

33. In certain embodiments, a magnetic detent may also be further utilized to hold one or more magnetically attractable projectiles within easy reach on the exterior of the blowgun. In certain such embodiments or similar embodiments, the sabot might also include a magnetically attractable portion, such as a lightweight strip of the type of tape used in tape recorder cassettes, to allow the sabot to be held by a magnetic detent on the exterior of the blowgun.

34. Rather than using a magnetic detent containing one or more magnets that attracts some magnetically attractable portion of the projectile to confine the projectile in loaded position, alternatively the projectile itself might contain one or more small magnets, while the blowgun proper contains some magnetically attractable portion. Or both the projectile and the blowgun may each contain one or more actual magnets, which might either attract or repel each other, according to the specific embodiment, in order to confine the projectile in loaded position.

35. It was noted earlier above that certain embodiments may utilize an electromagnetic detent means. Certain embodiments that include an electromagnetic projectile detent may be substantially identical with or similar to embodiments that use permanent magnets, but with the simple exception that the permanent magnets are merely replaced by suitably adapted electromagnets that may in certain embodiments be substantially sized, shaped, positioned and oriented, and possibly re-positioned and re-oriented adjustably, much as the permanent magnets were in various embodiments (in such embodiments, each electromagnet might typically have its own specialized core element distinct from the other elements of the embodiment). In certain other embodiments, however, the electromagnet might utilize a portion of the blowgun barrel itself as a core, provided the barrel or suitable portion of the barrel is composed of a suitable material to serve as an electromagnet core. Embodiments are also possible in which a magnetically attractable portion of the projectile might serve as a core or movable core for an electromagnetic detent, which might possibly thus resemble a type of electromechanical solenoid, especially if the induction coil were wound around a portion of the barrel (or might alternatively possibly resemble a simpler electromagnet if the induction coil was wound directly around a portion of the projectile). Thus various embodiments are possible in which the inductive coil of the electromagnetic detent may be wrapped around a portion of the barrel, in order to thereby in certain embodiments use the barrel portion itself as a core, or in other embodiments use the magnetically attractable portion of the projectile as a movable core. Other embodiments are also possible, in which the inductive coil of the electromagnetic detent might be wrapped around a core element other than a portion of the barrel or portion of the projectile, thus substantially resembling in many ways certain embodiments that include permanent magnetic detents. However, embodiments that include the various types of electromagnetic detents do offer certain possibly unique advantages and additional features appropriate for certain situations and methods of use. A list of some of the advantages and features of embodiments that include electromagnetic detents includes:

a. The electromagnetic detent's magnetic field may in certain embodiments be able to be switched off, either manually or automatically, when the blowgun is not in use. This might be convenient when storing the blowgun near items that would be sensitive to a strong magnetic field.

b. Certain embodiments may include means for manually or automatically adjusting or varying the strength of the electromagnetic detent's magnetic field, in order to make it easier to fine tune blowgun performance or initial launching resistance for example. Means might also be included that allow variation or adjustment, possibly automatically, of the electromagnetic detent's magnetic field strength during various stages of the loading and launching sequence.

c. Certain embodiments might include means for automatically switching on electric current to the electromagnetic detent upon insertion of the magnetically attractable portion of the projectile within an appropriate portion of the barrel bore. Certain such embodiments might, for example, use the attraction of a small permanent magnet to the projectile's magnetically attractable portion in order to switch on the flow of current to the electromagnet.

d. Certain embodiments might include means for automatically switching off electric current to the electromagnetic detent at some point during launch acceleration, or after the completion of launch acceleration, or even just prior to launch acceleration. Such embodiments might, for example, utilize electric switching means possibly actuated by changes in air pressure during launch, or possibly actuated by inductance effects or magnetic attraction between the accelerating projectile and the electromagnet or electromagnetic coil. Use of an in-line pressure release valve to temporarily block the air passage through the mouthpiece, breech, or bore, as described earlier above would provide one way of allowing a pressure sensitive switching means to be actuated by launch pressure and cut current to the electromagnetic projectile detent somewhat slightly before the actual commencement of launch acceleration.

e. Certain embodiments might allow for physical repositioning and reorientation of the electromagnetic projectile detent relative the bore and relative the sabot detent in order, for example, to accommodate projectiles or sabot projectile assemblies of varying lengths. On the other hand, embodiments would also be possible in which such adjustments for varying sabot projectile assembly lengths were made by selectively energizing one or more of various sequentially positioned electromagnets affixed in relatively immovable or permanent positions along the barrel or barrel bore, or by selectively energizing one or more portions of the coil of a single extended electromagnet so that only a portion rather than the total of the electromagnet's length is energized or generating a magnetic field.

f. In certain embodiments the electromagnet or the electromagnet's coil might itself form a portion of the body or wall of the barrel, or of a barrel bore extension member, or of a mouthpiece (preferably with a suitable protective coating or sealant applied to the electromagnet).

36. In certain embodiments, rather than including a magnetic projectile detent, the embodiments may include various types of essentially non-magnetic projectile detents, such as, for example, various types of direct-contact mechanical projectile detents. It will be apparent to one skilled in the art that suitable positioning and orientation of mechanical projectile detents or other nonmagnetic projectile detents relative the barrel bore and relative the sabot detent will substantially follow, perhaps with certain modification or adjustment, the essential principles or considerations, set forth earlier, for suitably positioning or orienting a magnetic projectile detent relative the bore and relative the sabot detent (as well as any considerations or adjustments necessitated for example, by affixing detent elements to a cartridge, chamber, mouthpiece, or bore extension member, rather than to the barrel proper or barrel bore proper of the blowgun). A few brief examples are listed below to serve to illustrate some of the possibilities for such mechanical projectile detents, and may suggest numerous alternative embodiments or versions to one skilled in the art:

a. One type of preferred embodiment including such a mechanical projectile detent would also include a straight longitudinal guidance groove in the inner surface of the barrel bore, as described above (or possibly with some other type of groove or recess in the bore). Such a mechanical projectile detent might comprise, for example, one or more hinged or flexible fingers affixed within and extending transversely across some portion of the guidance groove, with the finger or fingers internally or externally biased yieldingly towards a resting position or initial position partially or completely transversely obstructing the guidance groove. The forward end of the projectile or projectile assembly, or other appropriate projectile portion adapted to cooperatingly engage the guidance groove, may, when in loaded position within the bore, rest in the groove and abuttingly rearwardly engage the mechanical detent finger or fingers. The detent finger or fingers may be adapted to partially yield when the projectile is being inserted into loaded position, but once loading insertion is complete, the detent finger/s should preferably still abuttingly engage the front end of the cooperating portion of the projectile with sufficient firmness to prevent or resist premature excessive forward axial displacement of the projectile prior to launch acceleration. The detent finger or fingers should preferably also be adapted to yield readily enough to be readily pushed aside when the projectile forcefully moves forward during launch acceleration, or in other words the initial launch resistance imposed by the detent finger/s should preferably be able to be readily overcome by the operating pressures provided by a typical human user's breath. The advantage of positioning, orienting, and otherwise adapting the mechanical projectile detent to partially or completely transversely obstruct the guidance groove and thereby engage some portion of the projectile that cooperates with the guidance groove, is that after the cooperating portion of the projectile has pushed past the mechanical detent during launch acceleration, the remaining portions of the projectile and of any sabot means can pass by through the barrel bore proper, thereby avoiding any contact with the mechanical projectile detent (this of course assumes that the mechanical projectile detent is advantageously so adapted that no portion of the mechanical projectile detent protrudes out of the guidance groove, or otherwise protrudes into or across the barrel bore proper). It will be apparent to one skilled in the art that such a mechanical projectile detent within a guidance groove in the barrel bore might, rather than comprising detent fingers, instead comprise other types of extensions, protrusions, or other suitable means to partially or completely transversely obstruct the guidance groove and thereby engage and hold the projectile when in loaded position. It would even be possible for such a projectile detent within a guidance groove to simply comprise a transversely narrower portion of guidance groove that could engage the cooperating portion of the projectile in an abutting, frictional, or mildly force-fitted manner, depending on the particular embodiment.

b. Certain embodiments that comprise a mechanical projectile detent or other nonmagnetic projectile detent may have portions of the projectile detent which protrude into or across the barrel bore proper, especially when the projectile is in loaded position and engaged with the projectile detent. Such embodiments may or may not have a guidance groove in the bore, but are perhaps more likely to occur when there is no guidance groove. In such embodiments, the mechanical projectile detent might, for example, comprise a gripper element that transversely snaps on and off some portion of the projectile, or that inserts into and snaps into or frictionally engages a portion of the projectile, or that wraps around a portion of the projectile (this last might possibly include an element such as a piece of string that could be configured as a type of slip knot or sliding loop that could slide open or release as the projectile moves forward during launch). Any such projectile detent elements that protruded into or across the bore proper might, in certain embodiments, be so adapted or provided with means so adapted as to be biased in such a way that when the cooperating portion of the projectile released from the detent's hold or engagement, the protrusive portions of the detent could retract into a hole or recess through or in the barrel wall in order to clear the bore and substantially avoid engagement with or obstruction of the remaining or trailing portions of the projectile and any sabot means. In certain embodiments any such protrusive projectile detent elements might alternatively simply be adapted to either yield under contact with any portions of projectile or sabot means, and preferably be yieldingly pushed back into cooperating recesses or holes in the barrel walls, or alternatively any such protrusive projectile detent elements might simply be sized, shaped, and/or otherwise so adapted as to let any contacting portions of the projectile or sabot means to ride over the protrusive detent elements fairly smoothly. Certain embodiments in which portions of the projectile detent retracted into openings or recesses in the barrel wall might advantageously be provided with a push button or other means suitably linked to the retractable detent elements in order to allow the detent elements to be reset to suitable positioning and orientation to engage the next projectile loaded into the bore.

c. Certain embodiments may use a mechanical projectile detent that inserts through a longitudinal opening pierced in a sabot to thereby engage some portion of a projectile. An illustrative example might be a blowgun provided with a transverse crossbar removably affixed across the breech opening, with the crossbar provided at its substantial center with a forwardly extending, slender metal or plastic protrusion, advantageously resiliently flexible, and preferably substantially narrower than the inner diameter of the projectile shaft's rear opening (assuming use in this embodiment of a projectile similar to the one used in the embodiment depicted in FIGS. 1-21.). The rear end of the projectile shaft might advantageously be plugged with a small piece of foam rubber or other suitable material force-fitted into the rear end of the shaft. The sabot means might advantageously be a conical shell sabot with a small hole pierced through the sabot tip, with the hole preferably just large enough for the crossbar protrusion to fit through, yet with the hole small enough that the sabot structure would still be able to securely abuttingly and loosely penetratively engage the rear end of the projectile shaft (in other words, so that the cone tip would not be overly weakened and collapse, or so that the cone's tip hole would not be so large that the shaft's rear end could slip into or through the sabot hole). To use this embodiment, the user could remove the transverse crossbar from the breech end of the barrel and insert the slender crossbar protrusion, which might advantageously have a somewhat sharp point, through the tip opening of the conical shell sabot and therethrough push the slender protrusion into the rear end of the projectile shaft to somewhat firmly penetratively engage the foam plug within the projectile shaft. The user could then preferably push the projectile back to firmly seat the projectile's rear end against the sabot, and also seat the sabot's rear end against the main body of the transverse crossbar. The user could then insert the projectile assembly into the barrel bore and re-attach or re-affix the transverse crossbar across the breech opening of the bore. During launch acceleration, launch thrust may push the projectile and sabot forward so that the projectile and sabot slide completely off of the slender protrusion, and so that the slender protrusion releases its penetrative engagement with the foam plug or other portion of the projectile or sabot, and the projectile and sabot are thereafter free to separate freely after completing launch exit from the muzzle.

d. Certain embodiments that include a mechanical projectile detent might include a frangible detent element that may be torn, broken, or cut in order to release the projectile during launch, and in particular with the frangible element weak enough to be broken by operating pressures supplied by human lungs. An example might be a paper loop that is looped around some portion of the projectile and is affixed to the barrel or bore, with the loop materially composed and structured and otherwise so adapted so as to be able to be broken, torn, or cut by the push of the engaged portion of the projectile as the projectile is pushed forward during launch.

e. Certain embodiments might include different types of nonmagnetic projectile detents than those listed or suggested above. For example, one type of nonmagnetic projectile detent, which might incidentally be considered to operate without direct mechanical contact with the projectile, might be a projectile detent that utilized suction or a partial vacuum applied to the projectile (and possibly also to the sabot) through one or more communicating holes or passages through the barrel wall, or possibly through one or more communicating holes or passages through the body of the sabot means (actually, such a suctional detent could be used to provide either a projectile detent means or a sabot detent means or both). For example, a suction bulb or piston could be affixed externally to the barrel wall, with the bulb or piston air chamber linked to one or more holes or air passages through the barrel wall. One or more appropriate cooperating portions of the projectile (or sabot, as appropriate) could be positioned against the inner surface of the bore and above the appropriate air passage opening or openings in the bore. The user could then manipulate the bulb or piston to introduce a suction or partial vacuum into the air passage holes and thereby suck and seal some portion of the projectile or sabot against the inner surface of the bore over the air passage opening/s in the bore. The strength of the suctional hold on the projectile or sabot should preferably be suitable to operate compatibly with the range of operating pressures provided by human lungs so that the user's breath could overcome and break the detent's sectional hold on the projectile or sabot. It would also be possible in certain embodiments to use valves and perhaps additional air passages in order to allow the user's breath during launch to directly fill the detent vacuum and thus actually substantially eliminate the detent's suctional hold on the projectile or sabot.

37. Certain embodiments of my invention may include one or more optional in-line pressure-release valves across or within or opening into the barrel bore at the breech or muzzle or both, or possibly also or alternatively positioned elsewhere along or within the barrel bore. One or more such valves could also or alternatively be positioned within an optional mouthpiece or optional bore extension member affixed to the blowgun barrel. An illustrative example of such an embodiment could include such a pressure-release valve housed within a mouthpiece affixed to the blowgun barrel. In this exemplary embodiment, an intermediary portion of the mouthpiece's hollow interior passage could be a cube-shaped void or chamber, which would have four square sides, and two square end openings, and the pressure-release valve could comprise a hinged flap so sized and shaped as to substantially match the size and shape of one of the square end openings of the cubical void or chamber in the mouthpiece. The square valve flap could be hinged at one edge to the body of the mouthpiece (with the flap preferably hinged to the mouthpiece body at the lip of the square end opening closest to the air inlet end of the mouthpiece), in such a manner that the valve flap could swing down to a closed, transversely-aligned orientation in order to thereby substantially completely obstruct and seal the cubical chamber's square end opening closest to the air inlet end of the mouthpiece, and with the valve flap also hinged and positioned in such a manner that the valve flap could swing up within the cubical chamber to assume an open, longitudinally-aligned orientation substantially flat against one of the sides of the cubical chamber in order to thereby allow a substantially unobstructed flow of air through the cubical chamber. The mouthpiece body would advantageously also have one or more extensions, affixed to or integral with the mouthpiece's inner surface, and positioned at or near to one of the edges of the cubical chamber's square-shaped opening that is nearest the air inlet end of the mouthpiece, with any such extensions sized, shaped, and otherwise so adapted to abbuttingly or otherwise engage the valve flap in order to prevent or resist the flap swinging past the position of substantially transverse alignment that would provide the best obstruction or seal of the square chamber opening. Such an embodiment might also advantageously have some portion of the valve flap composed of a substance strongly susceptible to magnetic attraction, and have a magnet affixed to or within the main body of the mouthpiece, with the magnet positioned and oriented in such a way as to exert substantial magnetic influence on the susceptible portion of the valve flap when the flap is oriented in its closed, transversely sealing position, with the amount of magnetic attraction between the magnet and flap still readily overcome by the breath pressure of the user. To use the blowgun provided by this embodiment, the user could insert the projectile or projectile assembly through the mouthpiece, with the projectile or projectile assembly pushing the flap up to an open position during loading, with the flap able to swing back shut after the projectile or projectile assembly has been pushed past it and finger or optional insertion tool withdrawn (the flap might swing shut under gravity, or attraction to the magnet, or an internal or external spring balance, or some combination thereof). An optional insertion tool or mechanism might make it easier for the user to push the projectile into loaded position. When the user blows into the air inlet end of the mouthpiece to initiate launch, the flap would preferably be held momentarily in place by the magnet, before the pressure of the user's breath overcame the hold of the magnet on the flap and forced the flap into open position. Thus such a valve could allow higher launch pressures or earlier peaks in launch pressures to develop. It will be recognized that this is similar to the detent delay effect that may be produced as a result of using a projectile detent in certain embodiments. Such a pressure-release valve or valves could be used either in conjunction with a projectile detent or else without a projectile detent, depending on the particular embodiment, and due to the higher launch pressures or earlier peak pressures that may develop, such embodiments that include one or more pressure-release valves may achieve higher launch velocities when used either with sabot projectiles or with fixed-piston full caliber projectiles. Any pressure-release valve located between the projectile or projectile assembly and the muzzle opening of the bore (or located at the muzzle opening) may also achieve a similar effect, since the column of air trapped between the projectile piston or sabot will keep the projectile or projectile assembly essentially immobilized until pressure builds sufficiently to release the valve flap from the magnet's hold. It will be apparent to one skilled in the art that numerous alternate embodiments of such a pressure release valve are possible, and that certain such embodiments might use, for example, a mechanical latch rather than a magnet to hold a flap or other valve portion in sealed position.

38. Certain embodiments may include a multi-stage sabot or sabot, which may possibly be adapted for transition between two or more sections of bore with differing calibers.

39. When using a blowgun, muscular effort of the user and compressed air from the user's lungs provide the energy to launch the projectile. It is advantageous, therefore, to very carefully match or adjust particular weapon variables to particular user variables in a way that is substantially individually customized. With the blowgun, some major weapon variables are bore caliber, barrel/bore length, projectile mass, projectile sectional density, and projectile form factor. Also to be considered is whether overall dimensions will be comfortable or awkward for a user to hold and engage with the mouth (as well as the fit of the mouthpiece itself). For example, a typical young user may not have enough lung capacity to use a relatively large-bore, long-barreled blowgun. Likewise, projectiles of a given mass may be too heavy for a typical young user to propel without undue strain and poor velocity. In this case, a blowgun with a relatively medium or small bore, with a short or medium length barrel, and relatively lightweight projectiles might be indicated as preferable for helping a typical young user to achieve improved results, and if the lightweight projectiles happen to be of relatively low sectional density, perhaps due to being full caliber fixed-piston projectiles, it might also be indicated or recommended that such projectiles be used at close range to offset the low sectional density. On the other hand, lightweight subcaliber projectiles might be adapted to have relatively high sectional densities, with correspondingly increased effectiveness at longer ranges.

A perhaps subtler but still relevant example of considerations when attempting to match blowgun characteristics with individual user characteristics or preferences: Consider either an adult user or a young user with sufficient lung capacity and muscular strength carry, handle, and otherwise make efficient, controlled use of a blowgun with a relatively large bore and long barrel. Generally speaking, many users may not be willing to use the strictly optimal or maximum barrel length (for achieving maximum projectile velocities or increased accuracy) of which they are technically capable of handling and using, because they may feel that an excessively long barrel is awkward to use and carry, or hard to store. Therefore it is advisable, at some point in the customization process, to determine the maximum barrel length the user wants to use or is willing to use (barrel extensions may be used to extend or adjust barrel/bore length in certain situations).

User preferences may also possibly differ or change according to the intended application or method of use. For example, target shooting preferences and hunting preferences may possibly differ from each other in that hunters generally wants to deliver as much energy as reasonably possible to the target, in addition to delivering a projectile with reasonable accuracy, while target shooters on the other hand may perhaps be interested only in maximizing accuracy.

Following is a list of considerations or tests which may help to customize blowgun and projectile characteristics for improved performance with a particular individual user:

Measure lung capacity volume by user. Possibly test lung pressure or breath pressures developed as well.

Determine any limiting factors such as user preference, or comfort or ability in handling, that may place additional limits on how long the barrel or bore may be.

Use the above to narrow down to an initial range of preferable bore sizes (length and caliber). For a different barrel or bore length optimal bore caliber may change.

Test user's performance with each preferably bore size with increments of dart mass, measuring muzzle velocities with chronograph or other appropriate instrument. Also monitor user's subjective comfort levels.

Provide a trajectory map for each bore+length+dart mass+form factor+sectional density+ballistic coefficient. Set up a default ideal sight template.

Optimal projectile balance also to be considered and systematically tested.

Initial launching resistance and detent delay effect, including possible subjective reactions or flinching on the part of the user should be considered.

Preferable to let the user "warm up" first with "neutral" or non-customized average specimens of blowgun and projectiles in order to have more of an informed basis for gauging performance and comfort improvements with various customized or tuned adjustments.

Once matching of optimal bore, barrel length, and projectile mass for the particular user and particular method of use or application has been done, optimal form factor and sectional density of projectiles, especially subcaliber projectiles, can be calculated. Ideal trajectory/projectile paths could be plotted out to desired range (say, up to 50 yards for example) and corresponding sighting or targeting reticles (or other sight devices) could be printed or configured.

The probable tendency of some shooters to eschew long barrel lengths, say, for convenience of handling or storage, may be offset by some degree by the option to increase bore caliber and decrease projectile mass, within practical limits, while still being able to achieve good sectional density levels, possible with certain embodiments that use subcaliber projectiles.

Lung capacity, strength and conditioning of relevant muscle groups, and technique in utilizing said capacity and strength, are all part of determining how effectively a particular user is able to use a given blowgun and projectiles. With a blowgun, propulsive thrust is supplied essentially by the user's lungs and diaphragm. Each user will have a certain lung capacity, with a certain portion of that lung capacity able to be utilized to produce thrust, and a certain amount of strength, stamina, training, and skill in the relevant muscle groups to produce thrust and to achieve stable balance, handling, aiming orientation and the like. Accordingly, some users may have limits on the length and weight of barrel they can manually handle and aim proficiently. Without taking these variables into account, many users will, even if unwittingly, be matched with a blowgun and projectiles that are an actual handicap. Comfort level and velocity may preferably be optimized in tandem with regard for both rather than for just one. When using subcaliber projectiles, it may be easier for undue user strain to be avoided, since somewhat lower velocities may still yield good trajectories.

It is preferable that various methods of matching, customizing, or adjusting will be provided so that the user may either use somewhat high-tech routes or somewhat low-tech routes to get a good match or achieve good tuning.

Some of the weapon variables that may be adjusted or customized, tuned, or otherwise personalized to optimize an individual's performance and comfort include:

Air volume or displacement volume of the barrel bore (a function of bore caliber and bore length).

Barrel length, Bore Caliber, and Bore Length.

Projectile mass, balance characteristics, and configuration of aerodynamic surfaces.

Projectile form factor matched to anticipated range of velocities, anticipated methods of use, and projectile mass.

Snugness of fit within the bore of the projectile piston or sabot piston.

The strength of the initial launching resistance and of any detent delay effect.

Frictional coefficients of projectile assembly components in surface contact with the bore, and of the bore itself.

40. Certain embodiments of my invention may utilize means for providing a positive connection between the subcaliber projectile and the sabot means, in which the positive connecting means may be considered as actually being an integral component or set of components of the sabot projectile assembly, and as such, in some embodiments may also undergo launch acceleration or discarding. An illustrative example of an embodiment which includes such positive connecting means may be obtained by somewhat modifying or adapting a sabot projectile assembly similar to the one depicted in FIGS. 22-43. The user could even make certain embodiments of such a modification or adaptation connecting means by hand, although it will be apparent that essentially equivalent modification adaptations could be manufactured by commercial processes. For convenience of illustration or description, it will be assumed that in this case the subcaliber projectile has been made by hand from a truncated finishing nail foreshaft, and a plastic sipper/stirrer straw shaft (as was described in more detail elsewhere). To hand-make such a modification connecting means, the user could take a short section (perhaps 1.5 inches long, more or less), of another sipper/stirrer straw and split (slit both sides of) the straw section lengthwise for all but about one-half or one-quarter inch of the length at one of the ends of the section. By trimming the two half-sections along the length of the section that was split, the user may make two strips or arms that extend from the short unsplit section, with the strips or arms preferably edge-to-edge along one of the original slits, with the opposite original slit having been widened by trimming. Preferably each strip or arm would be trimmed so as to appear essentially flat. The user may now take the short, heretofore unsplit section and slit it along one of its sides (preferably the side opposite the side with the unwidened original slit between the two arms that were already made). It will likely be advantageous to widen the slit in the short section by trimming along its edges, until the short section may fairly easily be transversely snapped onto and off of the straw shaft of the subcaliber projectile. The resilient flexibility of the sipper-stirrer straw material will allow the slit short section to spread apart and snap onto and off of the projectile shaft, and will also allow the two arm sections to be spread apart somewhat. The two arm sections can then be spread apart and affixed, possibly with tape or glue, one on each side of the conical shell sabot. The arms should preferably be affixed in such a manner that when the short section is snapped onto the projectile shaft, and the sabot tip is inserted into and engaged with the rear end of the projectile shaft, the arms fastened to the sabot will constrain the sabot to rest at somewhat of an angle to the longitudinal axis of the projectile shaft. Thus the arms and short section together form a structure rather like a yoke or harness, with the spread-out position of the arms helping to add some rigidity to the arms. When loading such a sabot projectile assembly, the user may start with the sabot projectile assembly fully assembled and snapped together with the short section of the yoke snapped onto the projectile shaft in order to hold the sabot and projectile engaged together. The user may insert the sabot projectile assembly partially into the bore and allow the magnetic detent to hold the sabot projectile in place against the inner surface of the bore in partially loaded position. The user may then manually tilt or rock the sabot to the opposite side of its original tilt, in such a manner that the sabot tip stays within the rear end of the shaft, and the tension of the sabot being tilted to the opposite side causes the short yoke section, pulled by the yoke arms, to transversely snap off of the projectile shaft. The user may now complete manual insertion of the sabot projectile assembly, in which the positive connecting yoke means has now been disengaged, and continue to launch in the manner described in FIGS. 22-43. It will be apparent to one skilled in the art that numerous versions similar to this embodiment are possible, with, for example, less or more yoke arms, or other differences, and that there are numerous other embodiments possible which use different specific means to allow a snap-on/snap-off positive connection, or a twist-on/twist-off connection, or various other types of connections between the sabot and the projectile, or which might be used with other specific embodiments of the sabot and projectile than those embodiments similar to the ones depicted in FIGS. 22-43.

41. The sabot may in some embodiments be provided with a port hole or other air passage means in order that during launch compressed air may pass through the sabot port hole or air passage to enter into and collect within the hollow shaft or other internal air spaces defined within the body of the projectile in certain embodiments, so that after discarding of the sabot means, the compressed air would expand and flow back out the back opening of the hollow shaft or air space, thereby possibly generating a base bleed effect to reduce vacuum behind the moving projectile and possibly increase aerodynamic stability of the projectile, or possibly serving as a means to disperse a powder or aerosol for a tracer projectile effect.

42. The projectile detent may in some embodiments be positioned along the barrel between the sabot detent and the breech, or even affixed to a mouthpiece or bore extension member and therefore possibly beyond the breech (and therefore not along or overlapping the barrel). The sabot detent may also be affixed to the mouthpiece or a bore extension member. If both the projectile detent and the sabot detent are affixed to the mouthpiece, the projectile detent may in some embodiments be positioned closer to the air inlet end of the mouthpiece than is the sabot detent.

GENERAL PRINCIPLES, CONCLUSIONS, RAMIFICATIONS, AND SCOPE

The prior-art obstacles to utilizing sabot projectiles in blowguns, presented in the foregoing discussion, may be substantially eliminated by employing a sabot projectile adapted to operate efficiently at the operating pressures and velocities typical of blowguns and associated projectiles. More specifically, this may be made possible by using sabot projectiles and blowguns so adapted as to greatly minimize projectile assembly launching resistance and sabot discarding resistance, yet preferably also so adapted as to prevent premature axial or lateral dislocation of the sabot projectile components relative each other and relative the barrel bore prior to launch acceleration and exit from the barrel muzzle. Thus in many embodiments it is important, for the purposes of securing the sabot projectile components as a functional unit during certain stages of the loading and launching sequence, and of maintaining the loaded sabot projectile assembly unit in proper position relative the barrel bore prior to launch acceleration, to employ such means as are preferably adapted to substantially eliminate or greatly reduce the use of positive connecting means, force fit, frictional engagement, and the like, and which are preferably further so adapted as to ensure that after the sabot projectile assembly has exited the barrel muzzle and propulsive thrust has dissipated, there is substantially no positive connection between the subcaliber projectile and the sabot means, either directly or via intermediary connecting means, which would provide any substantial resistance to axial displacement of the subcaliber projectile forwardly relative the sabot means, nor to axial displacement of the sabot means rearwardly relative the subcaliber projectile. Thus any direct positive connection that may exist between sabot and subcaliber projectile, either directly or via intermediary connecting means, during earlier stages of handling, loading, or launching, should preferably have been disengaged or disconnected prior to the completion of exit from the muzzle by the sabot projectile assembly.

I have accordingly determined that launching subcaliber projectiles efficiently and accurately from a blowgun can be accomplished in certain embodiments of my invention by adapting the blowgun and associated projectiles and sabots according to one or more of the principles and methods detailed in the following list of general principles:

1. First, in certain embodiments, sabot discarding resistance is reduced or virtually eliminated by adapting the sabot means and the subcaliber projectile in such a manner that, while engaged together as a functional unit during some or all of certain stages of the loading and launching sequence, such as, for example, while being loaded or inserted into the bore, while being held loaded in a predetermined battery disposition within the bore prior to launching, or while undergoing launch acceleration through the bore, the sabot means and the subcaliber projectile have little or no direct positive connection to each other, but rather have a direct connection which may be essentially characterized as a direct abutting connection or direct abuttingly nesting connection, with some portion of the subcaliber projectile abuttingly engaged rearwardly by some portion of the sabot means. In such embodiments, the essential lack of positive connection between the sabot means and the subcaliber projectile provides negligible or no resistance to axial displacement of the subcaliber projectile forwardly relative the sabot means, nor to axial displacement of the sabot means rearwardly relative the subcaliber projectile. Therefore, in many such embodiments, the sabot means and the subcaliber projectile are maintained in connection as a functional unit, which functional unit we may refer to as the sabot projectile assembly, during some or all of certain stages of the loading and launching sequence by being externally urged, biased, or confined against each other by one or more external connecting or restraining means, such as one or more detent means. In many such embodiments, the external connecting or restraining means also serves to prevent any premature axial displacement of the sabot projectile assembly relative the barrel bore after loading insertion and prior to commencement of launch acceleration. The abutting or nestingly abutting connection between the sabot means and the subcaliber projectile, as described above, enables them, once they have exited the barrel bore and are thus removed from the influence of any detent means or any other type of connecting means, are also clear of frictional engagement with the barrel bore, and are furthermore no longer secured together by acceleration of the sabot means against the inertial mass of the subcaliber projectile, to separate very cleanly and quickly with minimal or virtually no transmission of drag, impulse, torque, or other pertubations from the sabot means to the subcaliber projectile during the discarding process.

2. Second, in certain embodiments, launching resistance is reduced or minimized by adapting the external connecting means, restraining means, detent means or any other means used to prevent premature axial displacement of the sabot projectile assembly as mentioned above, in such a manner so as to impose an initial launching resistance readily overcome by the pressure differential established upon the sabot projectile assembly by the user's breath during launch. Different types of such external connecting means, which, according to the particular embodiment, may be employed either individually or in various combinations, include, but are not limited to: one or more associated magnetic detent means, one or more electromagnetic detent means, one or more mechanical detent means, as well as, or alternatively, gravity, inertia, mild frictional engagement with the barrel bore, mild force-fit, suction, and the manual grip of the user. When used in combination in certain embodiments, such detent means or other connecting means may, for example, function antagonistically to press the sabot means against the subcaliber projectile, or to confine the sabot means and subcaliber projectile either against each other or within a predetermined proximity to one another. Generally speaking, in certain, though not all, embodiments of my invention, the external connecting means or detent means, although it might be considered as a type of positive connecting means, is not an integral component or set of components of the sabot projectile assembly, and therefore does not undergo launch acceleration or discarding, but rather is usually affixed to or integral with the blowgun barrel or mouthpiece or both, and is reused from shot to shot.

3. Third, in certain embodiments, launching resistance is further kept to a minimum by utilizing a sabot means which, after the initial launching resistance described above has been overcome, is able to travel down a given bore with as little, or even less, resistance than the piston means of a typical full caliber blowgun projectile sized and shaped to fit the same bore. Certain embodiments of my invention may indeed make this possible, being able to efficiently utilize a sabot means shaped and sized so that the amount of surface area contact and snugness of fit between the sabot and the bore is essentially equal to or even somewhat less than that of the fixed piston means of a full caliber projectile sized to fit the same sized bore. It should be noted that many full caliber blowgun projectiles, although dimensioned to fit the bore somewhat loosely, still tend to be fitted snugly enough to prevent them sliding too easily down the bore before launch, due to gravitational urging when the barrel is tilted away from a horizontal level, or due to normal movement and reorientation of the barrel during carrying and handling the blowgun. Even so, the user of many types of prior art blowguns must be careful not to tilt the barrel too abruptly or insert the projectile too forcefully, or else the projectile may slide partially or completely down the barrel before launch. Certain embodiments of my invention correct this situation in one or more ways. First, the detent means or other means employed to prevent premature axial displacement of the sabot projectile assembly components may be so adapted as to hold the projectile assembly sufficiently strongly to prevent premature axial displacement of the sabot projectile assembly components due to gravitational urging, jolts, jars, or swinging of the barrel, and so forth. In some embodiments, therefore, the user can even tilt the barrel vertically with the muzzle down, without dislodging or displacing the sabot projectile assembly from its secure loaded positioning, which is preferably at or near the breech. Some of such embodiments that use the detent means or other means to prevent premature axial displacement of either a sabot projectile assembly, or even of a full caliber projectile, may also provide one or more of the following benefits:

a. The fit of the piston or sabot means within the bore may, if desired, be made slightly looser, since secure frictional engagement between the sabot means and the bore is no longer necessary to prevent premature axial displacement of the projectile or projectile assembly. The slightly looser fit of the piston or sabot means in the bore may result in a reduction in total remaining launching resistance after the initial launching resistance is overcome.

b. The loaded positioning and loaded orientation of the sabot projectile assembly may in certain embodiments be made very consistent and repeatable with each shot, yielding improved shot-to-shot accuracy.

c. As launch thrust commences, the initial launching resistance, imposed by the detent means or other means of preventing premature axial displacement of the projectile or projectile assembly, may cause a delay in the movement of the projectile or projectile assembly. This delay, although usually so slight or short in duration as to be virtually undetectable by the user, nevertheless may allow higher launch pressures to develop, or at least allow pressures to develop to a given level at earlier stages of the projectile's or projectile assembly's travel along the bore during launch. The additional thrust generated by the higher launch pressures, or earlier peak in pressures, may help to offset the slight delay caused by the initial launching resistance, and in fact may result in increased exit velocity of the projectile or projectile assembly. This effect may be amplified by using a piston or sabot means with a slightly looser fit as described above, in which case the higher launch pressures developed may also help to offset the slightly reduced lateral area of the looser fitting piston or sabot means, thereby possibly avoiding any substantial reduction in thrust and in some embodiments possibly actually yielding increased thrust.

Note: It may be understood that premature or excessive transverse displacement of the sabot means and subcaliber projectile relative each other before and during launch acceleration may be substantially prevented by any nesting relationship or loosely penetrative relationship in their connection, or alternatively by the transverse travel limits imposed by the cross-sectional dimensions of the barrel bore.

As was mentioned above, in general, in certain embodiments of my invention, the external connecting means or restraining means or detent means, although it might be considered as a type of positive connecting means, is not an integral component or set of components of the sabot projectile assembly, and therefore does not undergo launch acceleration or discarding, but rather is usually affixed to or integral with the blowgun barrel or mouthpiece or both, and is reused from shot to shot. Other embodiments of my invention, do, however, utilize means for providing a positive connection between the subcaliber projectile and the sabot means, in which the positive connecting means may be considered as actually being an integral component or set of components of the sabot projectile assembly, and as such, in some embodiments may also undergo launch acceleration or discarding. The option to use such integral positive connecting means provides a wider range of responsiveness to user preference or convenience in storing, carrying, handling, and loading the sabot projectile assembly. In cooperation with such integral positive connecting means, some embodiments of my invention may also employ a means of providing an additional or alternative source of force or impulse, in addition to or in place of atmospheric drag, to actuate sabot disengagement and discarding. Some embodiments may employ a positive connection or positive connecting means which is manually disengageable prior to or during loading. Additional information about certain embodiments which utilize integral or affixed positive connecting means between the projectile and the sabot will be provided in later sections. Various advantages, methods of use, and alternate embodiments will also be listed or described in later sections.

It should also be noted that in some embodiments of my invention, it may not be necessary for the subcaliber projectile and the sabot means to be in direct contact or connection with each other during all stages of the loading and launching sequence. In some embodiments, the subcaliber projectile and sabot means may be loaded sequentially rather than simultaneously, and additionally or alternatively, rather than being directly abutting while in loaded position within the bore prior launch acceleration, the subcaliber projectile and sabot means may simply be secured or confined within reasonable proximity of one another, so that they may assume an abutting relationship once launch acceleration commences. Furthermore, in some embodiments it may not be necessary for the sabot means, after being loaded, and before launch acceleration, to be in direct contact or actual engagement with the sabot detent, in which case the sabot detent may simply serve to ensure that the sabot means does not exit back out the breech or does not undergo axial displacement past a certain predetermined distance from the subcaliber projectile after loading insertion has been completed and before launch acceleration commences. In some embodiments similar qualifications may apply to the projectile and projectile detent.

The ability to launch subcaliber projectiles efficiently and accurately from a blowgun is a major strategy for improving blowgun performance set forth by this disclosure. However, this disclosure also sets forth several other strategies for improving blowgun performance which may be used complementarily with the strategy of launching subcaliber projectiles, and which allow the user to exploit the ability to launch subcaliber projectiles to achieve complementary or related improvements in areas such as internal ballistic stability as the projectile or projectile assembly is accelerated through the bore, as well as improvement in methods of target shooting. Several of these complementary strategies may also be used on their own, independently of the strategy of launching subcaliber projectiles, in order to provide stand-alone solutions for improving blowgun performance even when using full-caliber projectiles rather than subcaliber projectiles. Indeed, my invention achieves its functions and advantages through strategies or principles that operate independently of, and yet in certain embodiments compatibly with, prior-art blowgun embodiments. Thus, in addition to being used to provide a complete set including a blowgun with associated sabot projectiles, as was described in the brief outline above, along with, if so desired, an associated target particularly suited for use with the blowgun and projectiles, as will be described below, my invention may alternatively be used to provide stand-alone solutions such as projectiles, sabots, kits, accessories, and targets that would allow a user, for example, to convert a pre-existing blowgun to launch subcaliber projectiles, or to build or assemble from scratch his or her own subcaliber blowgun, or to use pre-existing or other full caliber projectiles as subcaliber projectiles in a blowgun of larger caliber, or, for example, to allow resupply, repair, and maintenance of the complete set described above, or of any of the accessory kits or converter kits or stand-alone solutions suggested above. It is accordingly desired that protection be provided to such stand-alone solution embodiments as well as to embodiments that provide a complete set such as the blowgun with associated sabot projectiles described in the outline above. Other stand-alone solutions include embodiments such as the improved type of full caliber projectiles which comprise an elongate subcaliber projectile converted into a full caliber projectile by essentially permanently affixing a full caliber piston to the otherwise subcaliber projectile, as was described above. Another example of a stand-alone solution provided by the principles of my invention, and described and illustrated earlier, is a blowgun barrel bore provided with one or more substantially straight longitudinal bore grooves (or/and in certain embodiments straight longitudinal bore protrusions) in order to thereby provide enhanced internal ballistic guidance to the forward end or other cooperating portion of either a sabot projectile assembly or a full caliber projectile, thus providing enhanced internal ballistic stability to either an appropriately adapted subcaliber projectile or an appropriately adapted full caliber projectile, depending on the particular embodiment and particular method of use. In turn, such improved internal ballistic guidance and internal ballistic stability of the projectile may yield improved external ballistic stability and accuracy of the projectile. Due to the performance advantages of such a straight-grooved barrel bore in terms of providing improved projectile guidance, stability, and accuracy, and the ability to selectably use such a straight-grooved barrel bore with either full caliber (fixed piston) projectiles or subcaliber (discarding piston) projectiles, it is desired that protection be provided to this area (the straight-grooved barrel bore) whether used in conjunction with other features of my invention or used as a stand alone solution, as is true also for the use of other features of my invention either conjointly or individually in complete sets, in partial sets, or in stand-alone applications.

I claim:

1. An apparatus for launching subcaliber projectiles, comprising:

an elongate barrel, said barrel including an elongate, substantially straight bore communicating between a breech opening and a muzzle opening;

a sabot means, said sabot means comprising a sabot sized, shaped and adapted for launch through and out said bore by the breath of the user;

a subcaliber projectile means, said subcaliber projectile means comprising a subcaliber round shot containing a magnetically attractable portion, said subcaliber projectile means being sized, shaped, and adapted for launch through and out said bore by thrust transmitted by abutting engagement with said sabot means; and a detent means, said detent means including a detent magnet adapted to produce a magnetic field, said detent magnet disposed in proximity of said bore and thereby configured to permit said magnetically attractable portion of said subcaliber round shot to be brought within influence of said magnetic field when said subcaliber projectile means and said sabot means are fully inserted together within said bore and disposed in readiness for launching, thereby enabling said detent magnet to exert a magnetic restraint upon said magnetically attractable portion and thereby magnetically engage and hold said subcaliber round shot within said bore in proximity of said sabot means pending commencement of launch acceleration; wherein:

said detent magnet is configured to release said subcaliber round shot when the pressure of the user's breath received into said bore establishes a pressure differential across said sabot means sufficient to overcome the said magnetic magnetic restraint of said detent magnet as launch acceleration commences;

wherein:

said subcaliber projectile means is adapted to abuttingly engage said sabot means in such manner that, during launch acceleration, at least one portion of said subcaliber projectile means is configured to, touch the inner surface of said bore;

wherein:

said sabot means is adapted to separate from and discard from said subcaliber projectile means after launch acceleration under the influence of atmospheric drag; and wherein:

said sabot means and said subcaliber projectile means are adapted to exit said muzzle opening after launch acceleration.

2. The apparatus of claim 1, wherein said subcaliber round shot projectile comprises a steel shot.

3. The apparatus of claim 1, wherein said sabot means comprises a cylindrical body portion.

4. An apparatus for launching subcaliber projectiles, comprising:

an elongate barrel, said barrel including an elongate, substantially straight bore communicating between a breech opening and a muzzle opening;

a sabot means including a sabot having some portion transversely sized and shaped to substantially slidingly seal with said bore, said sabot means including firstly a rearward facing thrust-pressurization face adapted to receive thrust pressure and thereby be accelerated during launch and secondly a forward facing thrust-transmitting face; and a subcaliber projectile means comprising a subcaliber projectile containing a magnetically attractable portion, said subcaliber projectile means being sized, shaped, and adapted for launch through and out said bore by thrust transmitted by abutting engagement with said thrust-transmitting face; and a detent means, said detent means including a detent magnet adapted to produce a magnetic field, said magnetic field being disposed in overlapping proximity to said bore in such manner as to permit said magnetically attractable portion of said subcaliber projectile to be brought within influence of said magnetic field when said subcaliber projectile means and said sabot means are fully inserted together within said bore and disposed in readiness for launching, thereby enabling said detent magnet to exert a magnetic restraint upon said magnetically attractable portion and thereby magnetically engage and hold said sub-caliber projectile within said bore in proximity of said thrust-transmitting face pending commencement of launch acceleration;

wherein:

said magnetic means is configured to release said subcaliber projectile when launch pressure received into said bore as launch acceleration commences establishes pressure differential across said sabot means sufficient to overcome the said magnetic restraint;

wherein:

said sabot means and said subcaliber projectile Means are adapted to be configurable, when fully inserted together within said bore and disposed in readiness for launching, in such manner that at least one portion of said subcaliber projectile means is configured, pending commencement of launch acceleration, to touch the inner surface of said bore;

wherein:

said sabot means is adapted to separate from said) subcaliber projectile means after launch acceleration and thereby permit said subcaliber projectile means to travel in flight unencumbered by said sabot means; and wherein:

said sabot means and said subcaliber projectile Means are adapted to exit said muzzle opening after launch acceleration.

5. The apparatus of claim 4, wherein said sabot means includes a cylindrical body portion disposed between said thrust-pressurization face and said thrust-transmitting face.

6. The apparatus of claim 4, wherein said subcaliber projectile means includes a subcaliber round shot projectile; and wherein:

said sabot means and said subcaliber projectile means are adapted to be configurable, when fully inserted together within said bore in readiness for launching, in such manner, that at least one portion of said subcaliber round shot projectile is configured, pending commencement of launch acceleration, to touch the inner surface of said bore.

7. The apparatus of claim 4, further including a mechanical detent means disposed in proximity of said breech opening, said mechanical detent means including a crossbar portion extending within and across said bore in such manner that said crossbar portion is configured to abuttingly stop said sabot means from exiting said bore through said breech opening.

8. The apparatus of claim 4, in which said sabot means is sized, shaped, and adapted in such manner as to permit said sabot means to slide along and through said bore under the urging of gravity when said bore is oriented vertically.

* * * * *